US012252222B2

(12) United States Patent
Uggeri et al.

(10) Patent No.: US 12,252,222 B2
(45) Date of Patent: Mar. 18, 2025

(54) BOATS, METHODS, AND DEVICES USED TO GENERATE A DESIRED WAKE

(71) Applicant: MasterCraft Boat Company, LLC, Vonore, TN (US)

(72) Inventors: Michael J. Uggeri, Knoxville, TN (US); David F. Ekern, Knoxville, TN (US); Colin J. Schweigert, Whitehall, MI (US); Chad A. Lynema, Knoxville, TN (US); Zach C. Gordon, Vonore, TN (US); Zachary A. Dedmon, Friendsville, TN (US); Maggie K. Dutmers, Knoxville, TN (US)

(73) Assignee: MasterCraft Boat Company, LLC, Vonore, TN (US)

( * ) Notice: Subject to any disclaimer, the term of this patent is extended or adjusted under 35 U.S.C. 154(b) by 699 days.

(21) Appl. No.: 17/482,667

(22) Filed: Sep. 23, 2021

(65) Prior Publication Data

US 2022/0089258 A1 Mar. 24, 2022

Related U.S. Application Data

(60) Provisional application No. 63/128,365, filed on Dec. 21, 2020, provisional application No. 63/081,948, filed on Sep. 23, 2020.

(51) Int. Cl.
*B63B 34/75* (2020.01)

(52) U.S. Cl.
CPC ..... *B63B 34/75* (2020.02)

(58) Field of Classification Search
CPC ..... B63B 34/75; B63H 11/10
See application file for complete search history.

(56) References Cited

U.S. PATENT DOCUMENTS

| | | | |
|---|---|---|---|
| 667,482 | A | 2/1901 | Albarda |
| 704,729 | A | 7/1902 | Zerbe |
| 1,196,682 | A | 8/1916 | Harriss |
| 1,264,320 | A | 4/1918 | Metzler |
| 2,199,333 | A | 4/1940 | Dunklin |
| 2,663,276 | A | 12/1953 | Ouellet |

(Continued)

FOREIGN PATENT DOCUMENTS

| | | | |
|---|---|---|---|
| CA | 2 271 332 | A1 | 2/2000 |
| CN | 2597328 | Y | 1/2004 |

(Continued)

OTHER PUBLICATIONS

Centurion Boats, Adjustable Wake Plate, http://wwww.centurionboats.com/features-and-options/adjustable-wake-plate.html, 2011.

(Continued)

*Primary Examiner* — Stephen P Avila
(74) *Attorney, Agent, or Firm* — Venable LLP

(57) ABSTRACT

A boat includes a propulsion device and a surf device. The propulsion device is configured to move the boat in a forward direction through a body of water to generate a wake having a port-side wave and a starboard-side wave. The surf device includes an inlet, an impeller, and an outlet. The surf device is configured to draw water from the body of water through the inlet, accelerate the water by rotating the impeller, and discharge the accelerated water through the outlet to create a surfable wake.

20 Claims, 33 Drawing Sheets

(56) References Cited

U.S. PATENT DOCUMENTS 2,807,228 A 9/1957 Vandre
2,832,304 A 4/1958 Elyosius et al.
2,890,673 A 6/1959 Chadwick, Jr.
2,994,290 A 8/1961 Merchant, Sr.
2,998,791 A 9/1961 Light
3,058,442 A 5/1962 Curtis
3,046,928 A 7/1962 Sherrill
3,062,167 A 11/1962 Bennett
3,106,178 A 10/1963 Cale
3,111,103 A 11/1963 Bennett
3,143,857 A * 8/1964 Eaton ..... B63H 11/10 60/221
3,159,134 A 12/1964 Winnen
3,200,782 A 8/1965 Walden et al.
3,247,820 A 4/1966 White
3,259,097 A 7/1966 Van Veldhuizen et al.
3,294,052 A 12/1966 Jones
3,327,671 A 6/1967 Comins
3,372,663 A 3/1968 Bue
3,391,667 A 7/1968 Bue
3,399,643 A 9/1968 Bennett
3,577,948 A 5/1971 Frey
3,628,484 A 12/1971 Banner
3,628,486 A 12/1971 Bennett
3,628,487 A 12/1971 Bennett
3,650,310 A 3/1972 Childress
3,670,685 A 6/1972 Milessa
3,695,204 A 10/1972 Bennett
3,698,343 A 10/1972 Boome
3,760,759 A 9/1973 Lang
3,763,812 A 10/1973 Rowe
3,982,493 A 9/1976 Cronin
4,211,180 A 7/1980 Brooks
4,232,626 A 11/1980 Kern
4,237,808 A 12/1980 Doerffer
4,261,278 A 4/1981 Gaudin
4,434,738 A 3/1984 Barkemeyer
4,577,580 A 3/1986 Diffely, Sr.
4,597,742 A 7/1986 Finkl
4,644,893 A 2/1987 Zepp
4,718,872 A 1/1988 Olson et al.
4,763,219 A 8/1988 Nakamura
4,776,295 A 10/1988 Kline et al.
4,854,259 A 8/1989 Cluett
4,895,093 A 1/1990 Dalsbo
4,910,419 A 3/1990 Hayashi et al.
4,967,682 A 11/1990 O'Donnell
5,058,520 A 10/1991 Fahrney
5,113,780 A 5/1992 Bennett et al.
5,142,473 A 8/1992 Davis
5,193,478 A 3/1993 Mardikian
5,235,926 A 8/1993 Jones
5,263,432 A 11/1993 Davis
5,315,951 A 5/1994 Finkl
5,359,956 A 11/1994 Lee
5,377,610 A 1/1995 Goebel
5,385,110 A 1/1995 Bennett et al.
5,445,100 A 8/1995 Finkl
5,474,012 A 12/1995 Yamada et al.
5,474,013 A 12/1995 Wittmaier
5,549,071 A 8/1996 Pigeon et al.
5,572,944 A 11/1996 Slikkers et al.
5,628,272 A 5/1997 Thomas
5,664,910 A 9/1997 Lochtefeld et al.
5,694,337 A 12/1997 Macken
5,846,104 A * 12/1998 Corcoran ..... B63H 11/10 441/71
5,860,384 A 1/1999 Castillo
5,860,766 A 1/1999 Lochtefeld et al.
5,881,666 A 3/1999 Crews, Jr.
5,911,190 A 6/1999 Lochtefeld et al.
6,006,689 A 12/1999 Olofsson
6,012,408 A 1/2000 Castillo
6,026,759 A 2/2000 Hazelett et al.
6,044,788 A 4/2000 Larson et al.
6,047,657 A 4/2000 Cox
6,105,527 A 8/2000 Ochtefeld et al.
6,138,601 A 10/2000 Anderson et al.
6,148,756 A 11/2000 Pavlov et al.
6,158,375 A 12/2000 Stuart, Jr.
6,213,044 B1 4/2001 Rodgers et al.
6,354,237 B1 3/2002 Gaynor et al.
6,415,729 B1 7/2002 Nedderman, Jr. et al.
6,427,616 B1 8/2002 Hagen
6,520,104 B1 2/2003 Svensson
6,523,489 B2 2/2003 Simard et al.
6,523,490 B1 2/2003 Watkins
6,606,959 B1 8/2003 Shen
6,773,316 B1 * 8/2004 Keehn, Jr. ..... B63B 1/08 114/151
6,782,839 B1 8/2004 Nozaki
6,827,031 B2 12/2004 Aoyama
6,874,441 B2 4/2005 Pigeon
6,923,136 B1 8/2005 D'Alesssandro
6,923,137 B2 8/2005 Waits, Jr.
6,935,263 B1 8/2005 Bandyopadhyay
6,941,884 B2 9/2005 Moore
7,004,097 B2 2/2006 Zeromski
7,007,621 B1 3/2006 Bootes
7,018,252 B2 3/2006 Simard et al.
7,063,031 B2 6/2006 Earl, Jr. et al.
7,140,318 B1 11/2006 Gasper
7,174,843 B1 2/2007 Tossavainen
7,188,581 B1 3/2007 Davis et al.
7,210,422 B1 5/2007 Hickok et al.
7,216,601 B1 5/2007 Mann
7,246,565 B2 7/2007 Snook et al.
7,252,047 B1 8/2007 Baucom, Jr.
7,311,058 B1 12/2007 Brooks et al.
7,318,389 B2 1/2008 Boning
7,380,514 B2 6/2008 Loui et al.
7,381,108 B1 6/2008 Salmon
7,434,531 B1 10/2008 Zsido et al.
7,467,596 B2 12/2008 Salmon
7,497,748 B2 3/2009 Salmon
7,617,026 B2 11/2009 Gee et al.
7,641,525 B2 1/2010 Morvillo
7,707,956 B2 5/2010 Moore
7,780,490 B2 8/2010 Lundgren
7,905,193 B2 3/2011 Beamer
7,958,837 B1 6/2011 Fraleigh
8,096,255 B2 1/2012 Morand et al.
8,100,079 B2 1/2012 Buzzi
8,191,493 B2 6/2012 Baywol
8,201,514 B2 6/2012 Coles
8,216,007 B2 7/2012 Moore
8,251,006 B2 8/2012 Kalil
8,261,682 B1 9/2012 DeVito
8,387,551 B2 3/2013 Muller
8,468,964 B2 6/2013 Hoberman et al.
8,480,445 B2 7/2013 Morvillo
8,522,706 B2 9/2013 Larson et al.
8,534,214 B1 9/2013 Gasper
8,539,897 B1 9/2013 Gasper et al.
8,578,873 B2 11/2013 Gasper et al.
8,622,012 B2 1/2014 Olofsson
8,631,753 B2 1/2014 Morvillo
8,798,825 B1 8/2014 Hartman
8,833,286 B1 9/2014 Sheedy et al.
8,967,070 B2 3/2015 Kalil
9,038,560 B1 5/2015 Brendel
9,045,204 B1 6/2015 Murphy
9,067,644 B2 6/2015 Sheedy et al.
9,150,289 B1 10/2015 Brendel
9,174,703 B2 11/2015 Sheedy et al.
9,199,695 B2 12/2015 Gasper et al.
9,260,161 B2 2/2016 Gasper et al.
9,272,752 B1 3/2016 Miller et al.
9,296,447 B1 3/2016 Morgan et al.
9,315,235 B1 4/2016 Wood
9,315,236 B2 4/2016 Gasper
9,334,022 B2 5/2016 Gasper et al.
9,394,032 B1 7/2016 Pigeon
9,446,823 B2 9/2016 Sheedy et al.

(56) References Cited

U.S. PATENT DOCUMENTS

| | | | |
|---|---|---|---|
| 9,505,464 | B1 | 11/2016 | Wood |
| 9,540,074 | B1 | 1/2017 | Pigeon |
| 9,545,977 | B1 | 1/2017 | Swiatek |
| 9,550,551 | B2 | 1/2017 | Swiatek |
| 9,573,655 | B1 | 2/2017 | Pigeon |
| 9,580,147 | B2 | 2/2017 | Gasper et al. |
| 9,611,006 | B1 | 4/2017 | Miller et al. |
| 9,643,697 | B2 | 5/2017 | Sheedy et al. |
| 9,669,903 | B2 | 6/2017 | Gasper et al. |
| 9,694,873 | B2 | 7/2017 | Gasper et al. |
| 9,708,031 | B1 | 7/2017 | Miller et al. |
| 9,796,451 | B2 | 10/2017 | Brendel |
| 9,802,684 | B2 | 10/2017 | Sheedy et al. |
| 9,862,457 | B2 | 1/2018 | Pigeon |
| 9,889,909 | B2 | 2/2018 | Morgan et al. |
| 9,891,620 | B2 | 2/2018 | Green et al. |
| 9,914,503 | B2 | 3/2018 | Huyge et al. |
| 9,914,504 | B2 | 3/2018 | Gasper et al. |
| 9,926,043 | B1 | 3/2018 | Miller et al. |
| 9,937,984 | B2 | 4/2018 | Herrington et al. |
| 9,988,126 | B2 | 6/2018 | Wood |
| 10,179,628 | B2 | 1/2019 | Gasper et al. |
| 10,183,726 | B1 | 1/2019 | McNaughton |
| 10,202,171 | B1 | 2/2019 | Miller et al. |
| 10,259,534 | B2 | 4/2019 | Sheedy et al. |
| 10,266,241 | B2 | 4/2019 | Sheedy et al. |
| 10,308,321 | B1 | 6/2019 | Miller et al. |
| 10,322,777 | B2 | 6/2019 | Gasper et al. |
| 10,358,189 | B2 | 7/2019 | Sheedy et al. |
| 10,377,453 | B2 | 8/2019 | Sheedy et al. |
| 10,386,834 | B2 | 8/2019 | Green et al. |
| D864,838 | S | 10/2019 | Clover et al. |
| 10,501,156 | B1 | 12/2019 | Sheedy et al. |
| 10,683,061 | B2 | 6/2020 | Gasper et al. |
| D893,395 | S | 8/2020 | Spendlove |
| 10,822,055 | B2 | 11/2020 | Sheedy et al. |
| 10,858,068 | B1 | 12/2020 | Miller et al. |
| 10,899,416 | B1 | 1/2021 | Sheedy et al. |
| 11,001,341 | B2 | 5/2021 | Spendlove |
| 11,046,393 | B2 | 6/2021 | Sheedy et al. |
| 11,067,979 | B2 | 7/2021 | Green et al. |
| 11,214,338 | B2 | 1/2022 | Moore et al. |
| 11,225,307 | B2 | 1/2022 | Moore et al. |
| 11,230,356 | B2 | 1/2022 | Eberhardt |
| 11,352,117 | B1 | 6/2022 | Blew |
| 11,370,508 | B1 | 6/2022 | Dugger et al. |
| 11,459,069 | B1 | 10/2022 | Miller et al. |
| 11,518,482 | B1 | 12/2022 | Dugger et al. |
| 11,524,750 | B1 | 12/2022 | Galloway |
| 2002/0078875 | A1 | 6/2002 | Bertrand et al. |
| 2003/0139101 | A1 | 7/2003 | Mardikian |
| 2004/0261684 | A1 | 12/2004 | Pigeon |
| 2005/0124234 | A1 | 6/2005 | Sells et al. |
| 2005/0155540 | A1 | 7/2005 | Moore |
| 2006/0054067 | A1 | 3/2006 | Hoberman et al. |
| 2006/0217011 | A1 | 9/2006 | Morvillo |
| 2007/0078575 | A1 | 4/2007 | Wilson et al. |
| 2007/0125287 | A1 | 6/2007 | Walker |
| 2007/0137550 | A1 | 6/2007 | Davis et al. |
| 2007/0202757 | A1 | 8/2007 | Moore |
| 2008/0257245 | A1 | 10/2008 | Stella |
| 2008/0271660 | A1 | 11/2008 | Zsido et al. |
| 2008/0281478 | A1 | 11/2008 | Gee et al. |
| 2009/0165694 | A1 | 7/2009 | Beamer |
| 2010/0101475 | A1 | 4/2010 | Mueller |
| 2010/0121493 | A1 | 5/2010 | Christensen et al. |
| 2010/0251952 | A1 | 10/2010 | Baywol |
| 2011/0017115 | A1 | 1/2011 | Olofsson |
| 2011/0126751 | A1 | 6/2011 | Muller |
| 2011/0320072 | A1 | 12/2011 | Morvillo |
| 2012/0079977 | A1 | 4/2012 | Gai |
| 2013/0000542 | A1 | 1/2013 | Muller |
| 2013/0213293 | A1 | 8/2013 | Gasper et al. |
| 2013/0228113 | A1 | 9/2013 | Gasper et al. |
| 2014/0026799 | A1 | 1/2014 | Kalil |
| 2014/0102348 | A1 | 4/2014 | Gasper |
| 2014/0137786 | A1 | 5/2014 | Gasper et al. |
| 2014/0137787 | A1 | 5/2014 | Gasper et al. |
| 2014/0261135 | A1 | 9/2014 | Gasper et al. |
| 2015/0197314 | A1 | 7/2015 | Gasper et al. |
| 2015/0217835 | A1 | 8/2015 | Gasper et al. |
| 2019/0118907 | A1 | 4/2019 | Larson et al. |
| 2019/0210694 | A1 | 7/2019 | Forrest et al. |
| 2019/0217921 | A1 | 7/2019 | Shibayama et al. |
| 2020/0290712 | A1 | 9/2020 | Duclos et al. |
| 2021/0354793 | A1 | 11/2021 | Wang |
| 2022/0048605 | A1 | 2/2022 | Connell |
| 2022/0097813 | A1 | 3/2022 | Swiatek |
| 2022/0153391 | A1 | 5/2022 | Sheedy et al. |
| 2022/0177103 | A1 | 6/2022 | Marohl et al. |

FOREIGN PATENT DOCUMENTS

| | | | |
|---|---|---|---|
| DE | 2634573 | A1 | 2/1978 |
| DE | 10159040 | A1 | 9/2002 |
| EP | 1 409 341 | A1 | 4/2004 |
| EP | 1 058 645 | B1 | 6/2004 |
| EP | 1 435 325 | A1 | 7/2004 |
| FR | 2556312 | A1 | 6/1985 |
| GB | 332315 | A | 7/1930 |
| SU | 975490 | A1 | 11/1982 |
| WO | 96/20105 | A1 | 7/1996 |
| WO | 99/44885 | A1 | 9/1999 |
| WO | 99/55577 | A1 | 11/1999 |
| WO | 03/011685 | A1 | 2/2003 |
| WO | 2005/118384 | A1 | 12/2005 |
| WO | 2006/058232 | A1 | 6/2006 |
| WO | 2007/072185 | A2 | 6/2007 |
| WO | 2008/095323 | A1 | 8/2008 |
| WO | 2009/113923 | A1 | 9/2009 |
| WO | 2011/099931 | A1 | 8/2011 |
| WO | 2013/040576 | A1 | 3/2013 |
| WO | 2013/071148 | A1 | 5/2013 |

OTHER PUBLICATIONS

Declaration of David Kennedy in Support of Nautique Boat Company, Inc.'s Opposition to Malibu Boats, LLC's Motion For Preliminary Injunction, Dec. 13, 2013, including Exhibit A: Volvo QL User and Installation Instructions; and Exhibit B: Volvo QL Boat Trim System brochure.

Humphree Installation Manual, dated 2009.

Humphree Operator's Manual, dated 2009.

Prweb, Malibu Makes Boating Easier and More Fun With MaliView, http://www.prweb.com/releases/Malibu/Boats/prweb 1285684.htm, Sep. 4, 2008.

Wakeboarding Magazine, Wakeboard Boat Review, Sanger Boats V237, Jan. 1, 2008.

Images of a Model Year 2008 MasterCraft CSX 265 equipped with a Volvo QL Boat Trim System.

Malibu Boats, 2009 Owner's Manual.

Tige Boats, 2012 Tige Touch User Manual.

Defendant Nautique Boat Company, Inc.'s Opposition to Malibu Boats, LLC's Motion for Preliminary Injunction, with all exhibits, filed on Dec. 16, 2013, in *Malibu Boats, LLC* v. *Nautique Boat Company, Inc.*, E.D. Tenn. Case No. 3:13-cv-00656.

Mastercraft, 2013 Owner's Manual, pp. cover, ix, and 3-7 to 3-19.

Enco Marine Inc., Electric Trim Tab Kits, Oct. 2007.

Bennett Marine, 2013 Catalog.

Mike Lewis, Tige Releases New Wakesurfing Specific Convex VX, Transworld Business, Dec. 17, 2012, available at http://business.transworld.net/117711/news/tige-releases-new-wakesurfing-specific-convex-vx/.

Bill Yeargin, Nautique Surf System, Nautique Insider, Jan. 3, 2013, available at http://www.nautique.com/blog/index/nautique-surf-system.

David Williams, First Look: Nautique Surf System, Wake World, Jan. 16, 2013, available at http://www.wakeworld.com/news/feature/first-look-nautique-surf-system.html.

(56) References Cited

OTHER PUBLICATIONS

Brandon Judd, Video: Supra Boats Swell Surf System, Wakeboarding, Nov. 21, 2013, available at http://www.wakeboardingmag.com/videos/2013/11/21/video-supra-boats-swell-surf-system/.
Brandon Judd, Video: Go With the Flow—Moomba Boats Flow Surf, Wakeboarding, Dec. 20, 2013, available at http://www.wakeboardingmag.com/features/2013/12/20/video-go-with-the-flow-moomba-boats-flow-surf/.
Alliance Wakeboard, Pavati Wake Boats New Website, Feb. 21, 2014, available at http://www.alliancewake.com/wake/pavati-wake-boats-new-website/.
Debut of new Sanger Surf Series, WakeWorld (posts dated Oct. 4, 2008 through Feb. 9, 2009), http://www.wakeworld.com/forum/showthread.php?t=632602 (accessed through Internet Archive, https://web.archive.org/web/20120530134144/http://www.wakeworld.com/forum/showthread.php?t=632602 (captured: May 30, 2012).
Armstrong, Surf Sanger, YouTube (Apr. 30, 2008), https://www.youtube.com/watch?v=WcVIZZ7QZus (last visited, Jan. 11, 2016).
Bigger Wakes for Wakeboards, International Hydrofoil Society (posts dated Oct. 5, 1999 through Jun. 4, 2002), http://www.foils.org/bigwake.htm (last visited: Jan. 8, 2016).
Search Report and Written Opinion dated Jan. 19, 2022, in International Patent Application No. PCT/US2021/051678.

* cited by examiner

BOATS, METHODS, AND DEVICES USED TO GENERATE A DESIRED WAKE

CROSS REFERENCE TO RELATED APPLICATIONS

This application claims the benefit under 35 U.S.C. § 119(e) of U.S. Provisional Patent Application No. 63/128,365, filed Dec. 21, 2020, and titled "BOATS, METHODS, AND DEVICES USED GENERATE A DESIRED WAKE" and U.S. Provisional Patent Application No. 63/081,948, filed Sep. 23, 2020, and titled "BOATS, METHODS, AND DEVICES USED GENERATE A DESIRED WAKE." The entirety of the foregoing applications is incorporated herein by reference.

FIELD OF THE INVENTION

The inventions relate to boats used for water sports, especially wakesurfing and wakeboarding. In particular, the inventions relate to devices and features of those boats used to modify the wake. The invention also relates to methods of using such boats for water sports, such as wakesurfing and wakeboarding.

BACKGROUND OF THE INVENTION

Recreational sport boats are often used for water sports, such as water skiing, wakeboarding, wakesurfing, and the like. The optimal wake for the boat depends on which of these water sports a boat is used for, as well as the preferences and skill level of the performer. Water skiers generally prefer a relatively smooth water surface, while wakeboarders and wakesurfers desire bigger wakes and wakes with more defined shapes. Wakesurfers generally prefer a large wake that is shaped similarly to ocean waves.

In recent years, the sport of wakesurfing has gained in popularity. The trend in recent years has been to load boats evenly with a large amount of ballast and deploy a mechanical surf device to create a wake for surfing. Examples of such surf devices are disclosed in U.S. Pat. Nos. 8,833,286; 9,802,684; and 10,358,189 and U.S. Patent Application Publication No. 2019/0118907, the disclosures of which are incorporated by reference herein in their entirety. Although such devices have provided a large wake for wakesurfing, the inventors have continued to strive for even further improvement in the wake and in the operation of the boat to create such wakes.

SUMMARY OF THE INVENTION

In one aspect, the invention relates to a boat including a propulsion device and a surf device. The propulsion device is configured to move the boat in a forward direction through a body of water generating a wake having a port-side wave and a starboard-side wave. The surf device includes an inlet, an impeller, and an outlet. The surf device is configured to draw water from the body of water through the inlet, accelerate the water by rotating the impeller, and discharge the accelerated water through the outlet to create a surfable wake.

In another aspect, the invention relates to a boat including a hull, a propulsion device, a port surf device, and a starboard surf device. The hull has a bow, a hull bottom, a port side, a starboard side, and a transom. The propulsion device is configured to move the boat in a forward direction through a body of water generating a wake having a port-side wave and a starboard-side wave. The port surf device includes an inlet, an impeller, and an outlet. The outlet is located on the outer third of the port side of the boat. The port surf device is configured to draw water from the body of water through the inlet, accelerate the water by rotating the impeller, and discharge the accelerated water through the outlet to create a surfable wake. The starboard surf device includes an inlet, an impeller, and an outlet. The outlet is located on the outer third of the starboard side of the boat. The starboard surf device is configured to draw water from the body of water through the inlet, accelerate the water by rotating the impeller, and discharge the accelerated water through the outlet to create a surfable wake.

In another aspect, the invention relates to a method of operating a boat to produce a surfable wake. The method includes moving a boat in a forward direction through a body of water using a propulsion device to generate a wake having a port-side wave and a starboard-side wave. The boat is moved through the body of water at a surf speed. The method also includes drawing water from the body of water through an inlet of a surf device, accelerating the drawn water in the surf device to a speed greater than the surf speed, and discharging the accelerated water through an outlet of the surf device in at least one of an aft direction and an outboard direction to create a surfable wake.

In another aspect, the invention relates to a boat including a hull having a port side a starboard side, a port deployable hull side, and a starboard deployable hull side. The port deployable hull side is movable between a non-deployed position and a deployed position. The port deployable hull side includes a flap pivotably attached to the port side of the hull and movable about a pivot axis to rotate outboard from the port side of the hull to move from the non-deployed position to the deployed position. The starboard deployable hull side is movable between a non-deployed position and a deployed position. The starboard deployable hull side includes a flap pivotably attached to the starboard side of the hull and movable about a pivot axis to rotate outboard from the starboard side of the hull to move from the non-deployed position to the deployed position.

In another aspect, the invention relates to a boat including a hull having a hull bottom, a port deployable hull bottom, and a starboard deployable hull bottom. The port deployable hull bottom is movable between a non-deployed position and a deployed position. The port deployable hull bottom includes a panel pivotably attached to the hull bottom and movable about a pivot axis to rotate downward from the hull bottom to move from the non-deployed position to the deployed position. The starboard deployable hull bottom is movable between a non-deployed position and a deployed position. The starboard deployable hull bottom includes a panel pivotably attached to the hull bottom and movable about a pivot axis to rotate downward from the hull bottom to move from the non-deployed position to the deployed position.

In another aspect, the invention relates to a boat including a hull having a hull bottom and a transom, a port slidable hull bottom, and a starboard slidable hull bottom. The port slidable hull bottom is movable between a non-deployed position and a deployed position. The port slidable hull bottom includes a panel slidably attached to the hull bottom and movable in an aft direction to move from the non-deployed position to the deployed position. At least a portion of the panel is aft of the transom in the deployed position. The starboard slidable hull bottom is movable between a non-deployed position and a deployed position. The starboard slidable hull bottom includes a panel slidably attached to the hull bottom and movable in an aft direction to move from the non-deployed position to the deployed position. At least a portion of the panel is aft of the transom in the deployed position.

In another aspect, the invention relates to a boat including a hull having a hull bottom, a propulsion device, and a hydrofoil device. The propulsion device is configured to move the boat in a forward direction through a body of water generating a wake having a port-side wave and a starboard-side wave. The hydrofoil device is movable between a non-deployed position and a deployed position and connected to the hull at a longitudinal position proximate the longitudinal center of gravity of the boat such that, when the hydrofoil device is in the deployed position and the propulsion device moves the boat in a forward direction, the hydrofoil device increases the displacement of the boat.

In another aspect, the invention relates to a boat including a propulsion device and a hull. The propulsion device is configured to move the boat in a forward direction through a body of water generating a wake having a port-side wave and a starboard-side wave. The hull has a hull bottom and a pocket formed in the hull bottom. The pocket is configured to reduce the hydrodynamic lift of the hull bottom as the propulsion device moves the boat through the boat in a forward direction through the body of water.

In another aspect, the invention relates to a boat including a propulsion device and a planing hull. The propulsion device is configured to move the boat in a forward direction through a body of water generating a wake having a port-side wave and a starboard-side wave. The planing hull has a keel and a bulb. The bulb protrudes forward of a forward portion of the keel. The bulb is configured to create a surfable wake as the propulsion device moves the boat through the boat in a forward direction through the body of water.

In another aspect, the invention relates to a boat including a propulsion device and a surf device. The propulsion device is configured to move the boat in a forward direction through a body of water generating a wake having a port-side wave and a starboard-side wave. The surf device including a channel. The channel has an inlet and an outlet. The inlet has a larger surface area than the outlet such that, as the propulsion device moves the boat through the boat in a forward direction through the body of water, the water flowing through the channel is accelerated. The channel is configured discharge the accelerated water through the outlet to create a surfable wake.

In another aspect, the invention relates to a boat including a planing hull, a propulsion device, and a pair of foils. The propulsion device is configured to move the boat in a forward direction through a body of water generating a wake having a port-side wave and a starboard-side wave. The pair of foils extend outward from the planing hull. Each foil of the pair of foils is positioned on the planing hull such that when the propulsion device moves the boat in a forward direction through a body of water at a speed from 9 mph to 12 mph, the foil interacts with the water to create an upward force on the planing hull or a downward force on the planing hull.

In another aspect, the invention relates to a boat including a hull and a swim platform. The hull has a port side, a starboard side, and a transom. The swim platform is connected to the transom. The swim platform has a port-side edge and a starboard-side edge. A panel is connected to each of the port-side edge and the starboard-side edge. Each panel has an outboard surface. The swim platform movable between a neutral position to a port deployed position and a starboard deployed position. In the port deployed position, the panel on the port-side edge is flush with the port side of the hull. In the starboard deployed position, the panel the starboard-side edge is flush with the starboard side of the hull. In the neutral position, the panel on each of the port-side edge and the starboard-side edge is spaced inboard from the port side and the starboard side of the hull, respectively.

These and other aspects of the invention will become apparent from the following disclosure.

BRIEF DESCRIPTION OF THE DRAWINGS

FIG. 5A shows a stern drive with a propeller aft of the transom of the boat, and FIG. 5B shows a forward drive.

In FIG. 22, the starboard-side surf device is shown in the deployed position and the port-side surf device is shown in a stowed position.

In FIG. 71, the surf device is in its non-deployed (neutral) position.

DETAILED DESCRIPTION OF THE PREFERRED EMBODIMENTS

Figure 1:
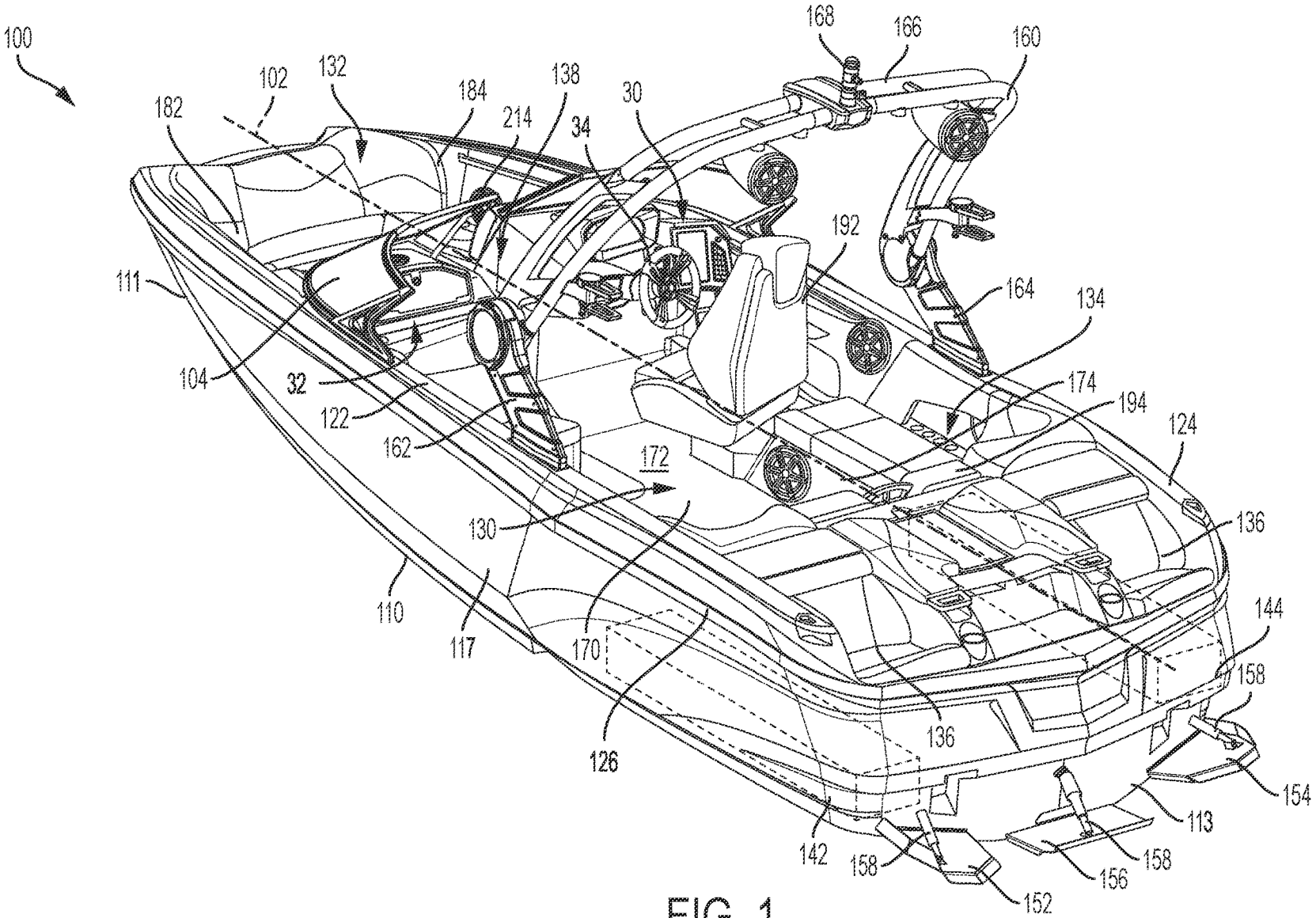
FIG. 1 shows a boat that may be used with the various embodiments of the invention discussed herein.

As used herein, directional terms forward (fore), aft, inboard, and outboard have their commonly understood meaning in the art. Relative to the boat, forward is a direction toward the bow, and aft is a direction toward the stern. Likewise, inboard is a direction toward the center of the boat and outboard is a direction away from it.

Unless otherwise indicated, a component that is attached to another component may be either directly attached to each other or indirectly attached to each other with one or more intervening components therebetween.

Some features and components of the embodiments discussed herein are the same or similar between the different embodiments. A common reference character will be used to refer to such features and components, and a detailed description of such features and components may be made in one embodiment and omitted from others.

Various different devices will be discussed herein to generate wakes suitable for surfing behind a boat. These different surf devices, although described as separate embodiments, may be used in conjunction with each other. For example, some embodiments discussed herein may be used to supplement or replace ballast and increase the displacement or angle of attack of the boat (e.g., the fourth, fifth, and ninth embodiments). These embodiments may be suitable for use in conjunction with embodiments that help refine, clean up, and/or otherwise shape the wake for wakesurfing, such as the downturned-surface surf devices shown in FIG. 1, the surf devices of the first through third embodiments, and the surf devices of the sixth through tenth embodiments. In addition, a boat and specific features and variations thereof will be described with reference to FIGS. 1-7. This description of the boat (including the specific features and variations) applies to each of the embodiments discussed herein.

Figure 2:
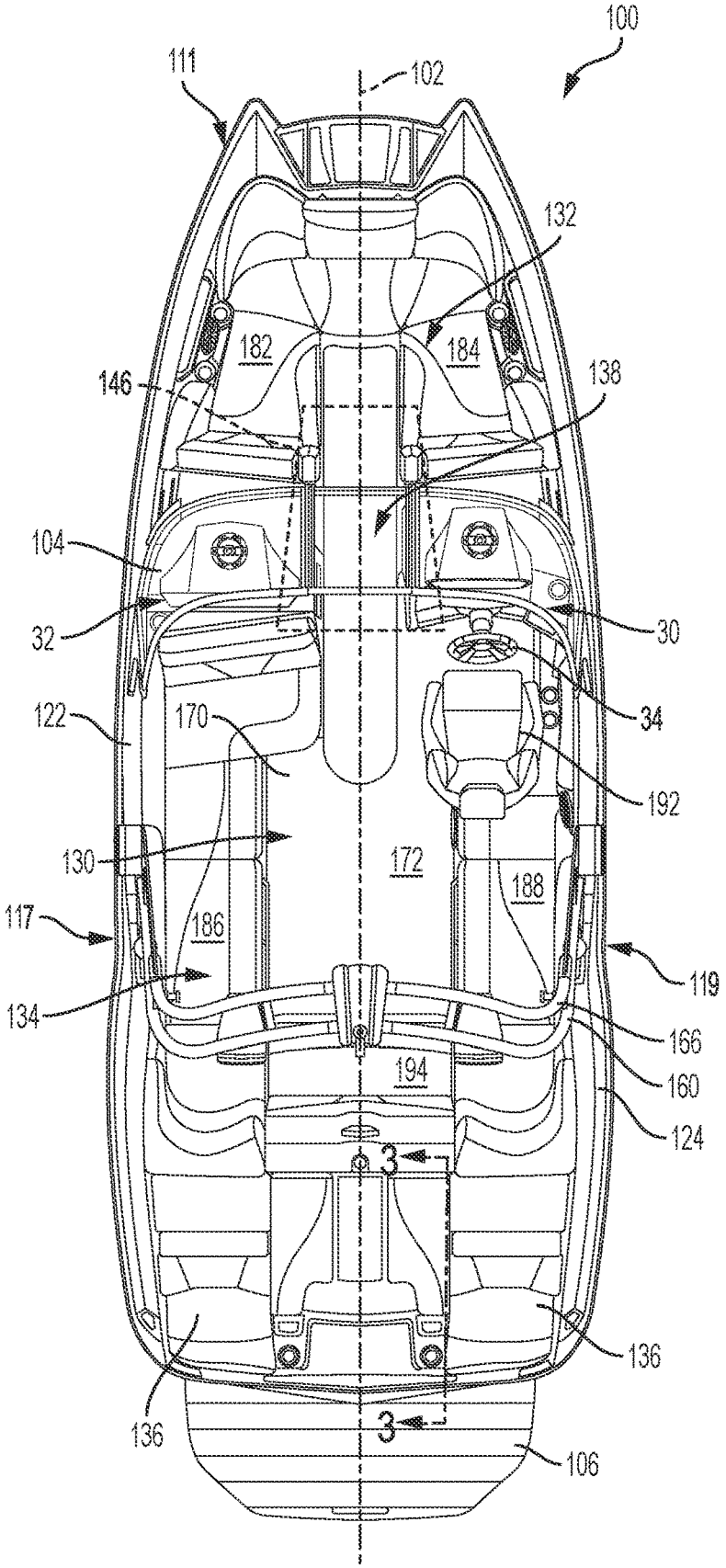
FIG. 2 is a top view of the boat shown in FIG. 1 with a swim platform.

FIGS. 1 and 2 show a boat 100 that may be suitably used with the various surf devices discussed herein. The boat 100 includes a hull 110 with a bow 111, a transom 113, a hull bottom 115 (see FIG. 3), a port side 117, a starboard side 119. The hull bottom 115 includes the portions of the hull 110 between the chines. The port and starboard sides 117, 119 have port and starboard gunwales 122, 124, respectively. The boat 100 has a centerline 102 running down the middle of the boat 100, halfway between the port and starboard sides 117, 119. Collectively, the bow 111, the transom 113, and the port and starboard sides 117, 119 define an interior 130 of the boat 100. In some embodiments, the hull 110 may be a planing hull. When planing hull boats reach a certain speed, the resistance of the hull dramatically drops as the boat is supported by hydrodynamic forces instead of hydrostatic (buoyant) forces. This is referred to as planing. To achieve planing, the boat must overcome the drag produced by the hull and any appendages, such as the propeller and rudders. Appendages increase the drag of the hull. In general, the more appendages there are, the greater the drag. Some characteristics of the hull 110 that are typical of planing hull boats include lifting strakes, a chine that is a hard chine, and a deadrise from 0 degrees to 30 degrees.

In the embodiment shown in FIGS. 1 and 2, the boat 100 is a bowrider having both a bow seating area 132 positioned in the bow 111 of the boat 100 and a primary seating area 134 (sometimes also referred to as the cockpit) positioned aft of a windshield 104. The boat 100 shown in FIGS. 1 and 2 also has a pair of aft-facing seats 136, such as those described in U.S. Pat. No. 9,650,117, which is incorporated by reference herein in its entirety. Although described in reference to a bowrider this invention may be used with any suitable boat including cuddies, center consoles, and cruisers, for example. Various embodiments discussed herein may also be suitable for use with other boats such as pontoon boats.

The boat 100 may include a horizontal swim platform 106 attached to the transom 113 to make it easier for people to get into the water from the boat 100 or into the boat 100 from the water. A top view of the swim platform 106 is shown in FIG. 2, but the swim platform is omitted from FIG. 1 for clarity. The swim platform 106 should be capable of supporting a human and is preferably capable of supporting at least 500 lbs., and even more preferably 1250 lbs. The swim platform 106 may be constructed from any suitable material that may be used in a marine environment including, for example, fiberglass or teak. In this embodiment, the swim platform 106 is attached to the transom 113 of the boat 100 using two brackets screwed to the transom 113; however, the swim platform 106 may be attached to the transom 113 by any suitable means. While the swim platform 106 is described as an attachable/detachable platform, it is not so limited. For example, the swim platform 106 may be integrally formed with the stern of the boat 100 (see FIGS. 5A, 5B, and 7).

The boat 100 may include the capability to add ballast. Ballast may be used to increase the weight and displacement of the boat 100 and increase the size of the wake for water sports such as wakeboarding or wakesurfing. Any suitable means to add ballast may be used including ballast bags (sacks) or ballast tanks. The boat 100 shown in FIG. 1 includes three ballast tanks. Preferably, at least two ballast tanks are positioned in the stern of the boat near the bottom of the hull 110, one on each side of the boat (a port ballast tank 142 and a starboard ballast tank 144), and a third ballast tank 146 is positioned along the boat's centerline 102 near the bottom of the hull 110, forward of the two stern ballast tanks 142, 144. Ballast bags may be used in addition to the ballast tanks 142, 144, 146 and may be plumbed into the ballast system of the boat 100. Preferably, the ballast bags are positioned above the stern ballast tanks 142, 144 in a compartment underneath the aft-facing seats 136. Both the ballast tanks 142, 144, 146 and the ballast bags operate similarly in that water may be pumped into the tank or bag by ballast pumps to add weight. As will be discussed further below, in some embodiments, the surf devices discussed herein may be used to supplement ballast or even replace the ballast. As such, the ballast tanks 142, 144, 146 may be omitted in some embodiments. In some embodiments where the tanks ballast tanks 142, 144, 146 are omitted, the boat 100 does not include ballast.

As noted above, the various embodiments discussed herein, and particularly those that are intended to supplement or replace ballast, may be used with additional surf devices (including both other embodiments discussed herein and other surf devices), and the boat 100 may be equipped with these additional surf devices. One such surf device may be, for example, the port and starboard wake-modifying devices disclosed in U.S. Pat. No. 8,833,286, which is incorporated by reference herein in its entirety, and these surf devices 152, 154 are shown in FIG. 1. To distinguish them from the other surf devices discussed herein, the surf devices 152, 154 shown in FIG. 1 are referred to as downturned-surface surf devices 152, 154. A pair of downturned-surface surf devices 152, 154 is shown in FIG. 1. One is a port downturned-surface surf device 152 on the port side of the centerline 102, and the other is a starboard downturned-surface surf device 154 on the starboard side of the centerline 102. Other examples of suitable alternative surf devices are shown and described in U.S. Pat. Nos. 9,802,684 and 10,358,189, the disclosures of which are incorporated by reference herein in their entirety.

Each of the port and starboard downturned-surface surf device 152, 154 includes a plate-like member that is pivotably attached to the transom 113 of the boat 100. The plate-like members pivot about pivot axes to move between a non-deployed position and a deployed position. In their respective deployed position, each of the downturned-surface surf devices 152, 154 is pivoted downwardly relative to their position in the non-deployed position, and preferably such that at least the downturned surface, if not the plate-like member, interacts with the water flowing under the hull bottom 115. In this embodiment, the pivot axes are hinges. Here, the hinges are piano hinges that are welded to a leading portion of each plate-like member and attached to the transom 113 of the boat 100 using screws. However, any suitable pivotable connection may be used and may be affixed to the transom 113 of the boat 100 and the port and starboard downturned-surface surf devices 152, 154 using any suitable means, including, but not limited to, bolts, screws, rivets, welding, and epoxy. Each of the port and starboard downturned-surface surf devices 152, 154 also may include one or more downturned and/or upturned surfaces, such as downturned surfaces at the trailing edge of the plate-like members that are angled at a downward angle relative to the plate-like member.

As shown in FIG. 1, the boat 100 is also equipped with a central trim device (center tab 156) positioned to span the centerline 102 of the boat. Any suitable trim device may be used, but in this embodiment, the center tab 156 is a generally rectangular trim tab that is pivotably attached to the transom 113 of the boat 100. The center tab 156 includes a plate-like member and pivots about a pivot axis to move between a non-deployed position and a deployed position. Like the pivot axes of the surf devices 152, 154, the pivot axis of the center tab 156 may be any suitable pivotable connection affixed to the transom 113 of the boat 100.

Each of the surf devices 152, 154 and the center tab 156 is movable between the deployed position and the non-deployed position by a drive mechanism 158. In the embodiment shown, one drive mechanism 158 is used for each surf device 152, 154 and the center tab 156, allowing them to be independently operated. Each of the drive mechanisms 158 shown in this embodiment is a linear actuator. The linear actuator preferably is an electric linear actuator, such as one available from Lenco Marine. One end of the linear actuator is connected to the transom 113 of the boat 100 and the other end is connected to the surf device 152, 154 or center tab 156. Any suitable means may be used to move the surf devices 152, 154 and the center tab 156 between the deployed and non-deployed positions, including, but not limited to, hydraulic linear actuators, gas assist pneumatic actuators, and electrical motors.

The boat 100 is also equipped with an apparatus for towing a water sports participant. As shown in FIGS. 1 and 2, the towing apparatus is a tower 160 that is particularly used for towing a wakeboarder. Any suitable tower 160 may be used including, for example, those described in U.S. Pat. Nos. 9,580,155 and 10,150,540, which are incorporated by reference herein in their entireties. The tower 160 includes two legs: a port leg 162 and a starboard leg 164. The port leg 162 is attached on the port side of the centerline 102 of the boat 100, and the starboard leg 164 is attached on the starboard side of the centerline 102 of the boat 100. Preferably, the port and starboard legs 162, 164 are attached to the port gunwale 122 and to the starboard gunwale 124, respectively. The tower 160 also includes a header 166. The header 166 is connected to an upper portion of each of the two legs 162, 164 and spans the interior 130 of the boat 100 at a height suitable for passengers to pass underneath while standing. In addition, the tower 160 has a tow-line-attachment structure 168 at an upper portion of the tower 160 (the header 166 in this embodiment). This tow-line-attachment structure 168 may be used to connect a tow-line suitable for towing a water sports participant, such as a wakeboarder. Any suitable tow-line-attachment structure may be used, including, but not limited to, the integrated light and tow-line-attachment assembly disclosed in U.S. Pat. No. 6,539,886, which is incorporated by reference herein in its entirety.

The boat 100 has a deck 170 which includes a floor 172. Passenger seating, such as port and starboard bench seating 182, 184, 186, 188 in both the bow seating area 132 and primary seating area 134, may be constructed on elevated portions (seat support structures 174) of the deck 170. As used herein, these portions are elevated with respect to the level of the floor 172. Other seating locations within the boat's interior 130 include a captain's chair 192 at the control console 30 and a reversible bench seat 194. Although the invention is described with reference to a particular seating arrangement, different seating arrangements are contemplated to be within the scope of the invention.

Within the boat's interior 130 is a control console 30 for operating the boat 100. Here, the control console 30 is positioned on the starboard side of the boat 100 proximate to and aft of the windshield 104. A passenger side console 32 is located on the port side of the boat 100, opposite the control console 30. Together, the control console 30 and the passenger side console 32 separate the bow seating area 132 from the primary seating area 134, as seen in FIG. 2. A walkway 138 connects the bow seating area 132 with the primary seating area 134 and separates the control console 30 and the passenger side console 32. The windshield 104 is mounted, in part, on forward portions of the control console 30 and the passenger side console 32. In this embodiment, the windshield 104 is mounted directly to a forward portion of the control console 30 and the passenger side console 32 and to the gunwales 122, 124.

Figure 3:
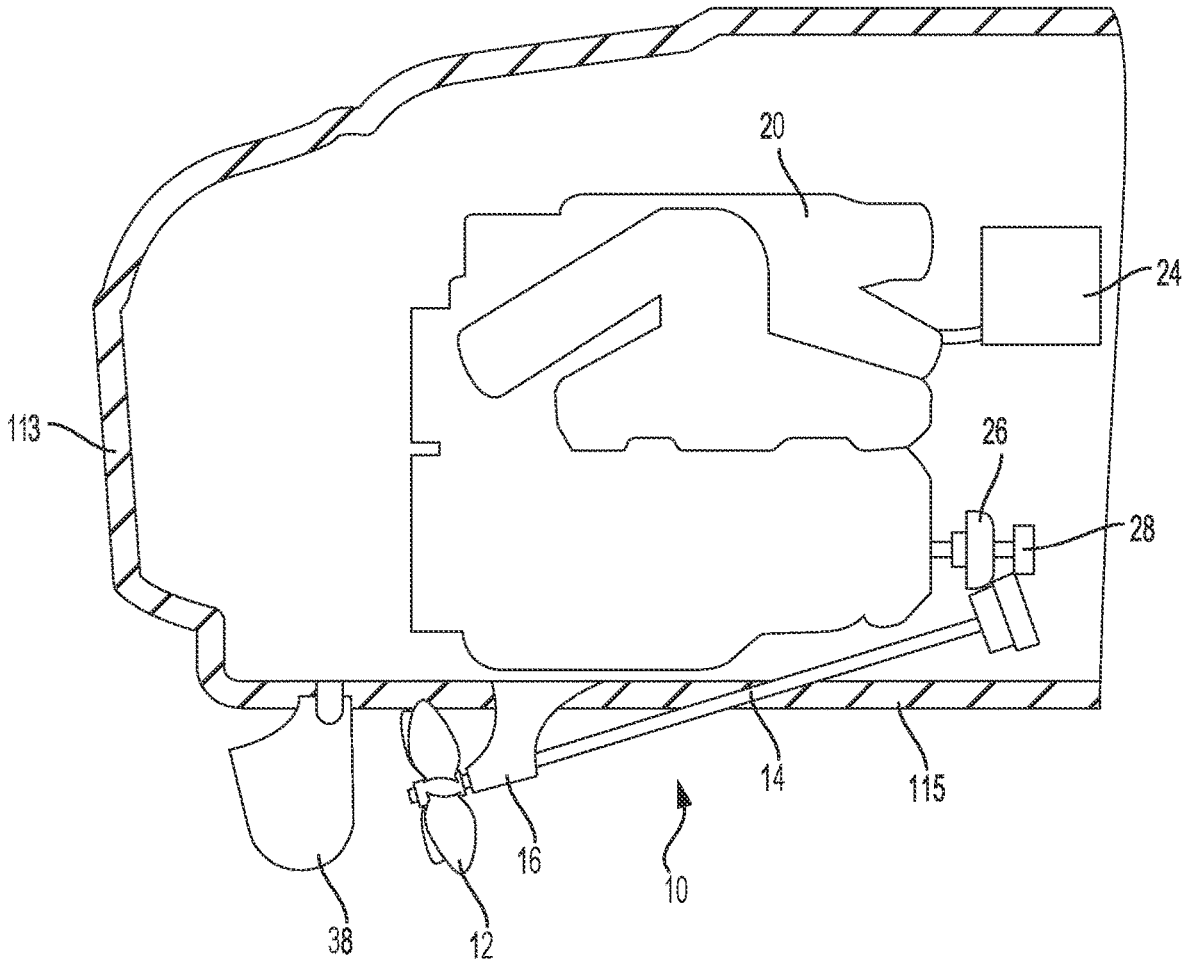
FIG. 3 is a cross-sectional view of the boat of FIGS. 1 and 2 taken along section line 3-3 in FIG. 2.

The boat 100 may be placed in a body of water, and the boat 100 may be propelled through the body of water by a propulsion device 10. The boat 100 shown in FIGS. 1 and 2 is an inboard boat. FIG. 3 is a cross-sectional view of the boat 100 taken along section line 3-3 in FIG. 2. As shown in FIG. 3, the propulsion device 10 includes a propeller 12 positioned forward of the transom 113 and beneath the hull bottom 115. The propeller 12 is driven by an engine 20 positioned inside the boat 100. Any suitable engine 20 may be used, including the MV8 5.7 L engine manufactured by Ilmor Marine of Mooresville, NC.

The propeller 12 is connected to the engine 20 by a drive shaft 14. A strut 16 extends from the hull bottom 115 to support the drive shaft 14 and thus the propeller 12. The drive shaft 14 extends through a bushing in the strut 16. In this embodiment, the propeller 12 and the drive shaft 14, when viewed from below the boat 100 or above the boat 100, is aligned with the centerline 102 of the boat 100. The engine 20 is also preferably positioned along the centerline 102 of the boat. In this embodiment, the engine 20 and the drive shaft 14 are arranged in a V-drive arrangement and the engine 20 is positioned in the stern of the boat, proximate to the transom 113, to increase the displacement of the stern of the hull 110 for water sports such as wakeboarding and surfing. Other suitable arrangements, however, may be used, including, for example, a direct drive arrangement.

Figure 4:
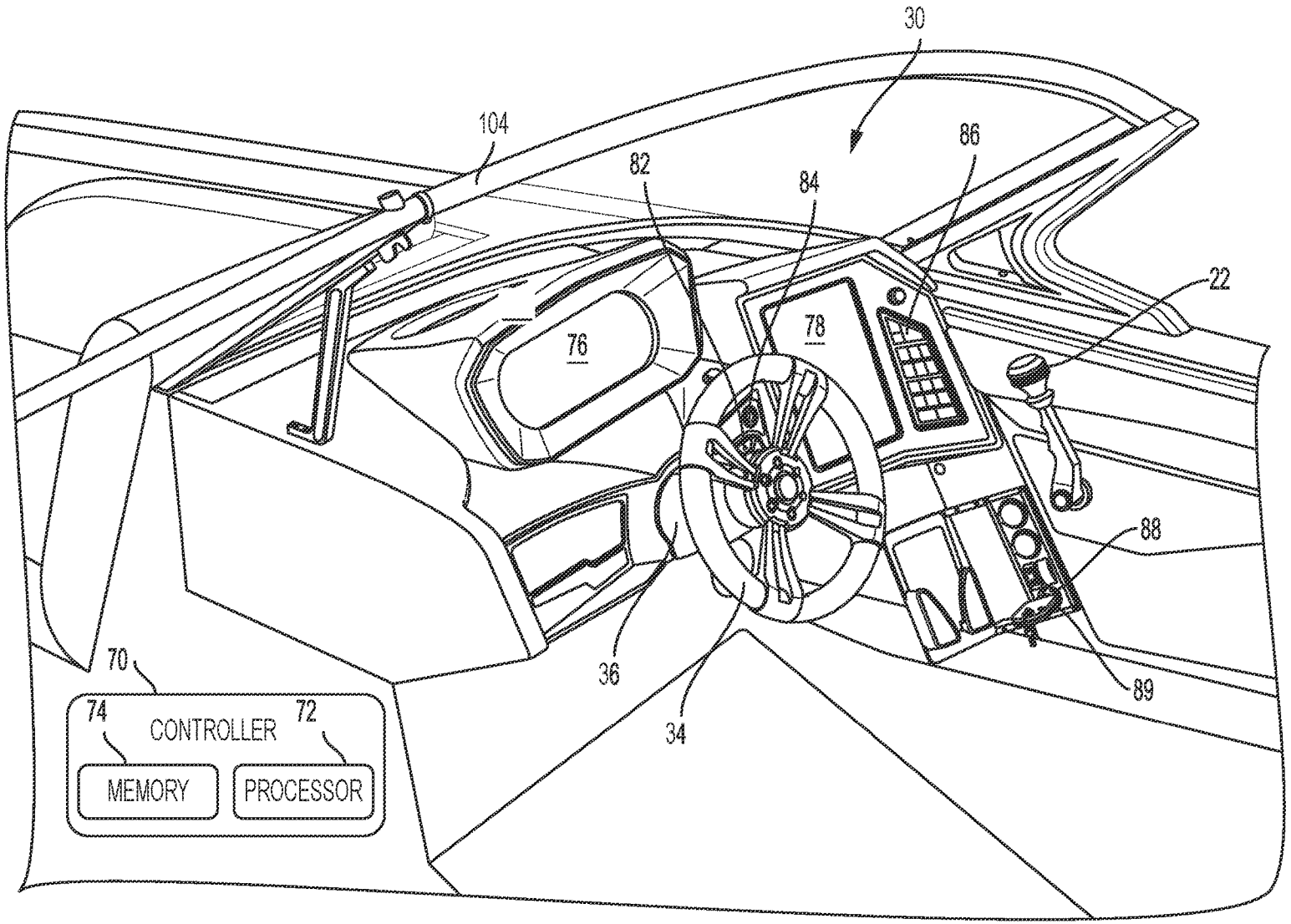
FIG. 4 is a perspective view of the control console of the boat shown in FIG. 1.

In this embodiment, the engine 20 and the propeller 12 may be operated by a user at an operator station located at the control console 30. A detailed view of the control console 30 is shown in FIG. 4. A control lever 22 is used to operate a throttle 24 (see FIG. 3) of the engine 20 and engage the engine 20 with the drive shaft 14. The control lever 22 has a neutral position, and the user may move the control lever 22 forward from the neutral position to engage a running gear 26 (see FIG. 3) with the drive shaft 14, to accelerate the engine 20 using the throttle 24, and to rotate the propeller 12 counterclockwise to drive the boat 100 forward. To move the boat 100 in reverse, the user may move the control lever 22 back from the neutral position to engage a reverse gear 28 (see FIG. 3) with the drive shaft 14, to accelerate the engine 20 using the throttle 24, and rotate the propeller 12 clockwise. Other suitable means may be used to operate the engine 20 and engage it with the drive shaft 14.

As shown in FIG. 3, a rudder 38 is used to turn the inboard boat 100. The rudder 38 includes a rudder post that extends through the hull bottom 115 and is used to rotate the rudder 38. The rudder 38 rotates about a rotation axis, which extends through the center of the rudder post. The rudder 38 is positioned behind (aft of) the propeller 12 and preferably is positioned laterally within the diameter of the drive shaft 14. The rudder 38 (and rudder post) may be positioned on the centerline 102 of the boat 100, when viewed from above, but in some instances, it may be preferable to offset the control console 30 to one side of the centerline of the boat 100 to facilitate removal of the drive shaft 14 without removing the rudder 38. Preferably, the rudder 38 is positioned forward of the transom, but other suitable locations, including on the transom, are contemplated to be within the scope of the invention. Other suitable rudder arrangements may also be used, such as, for example, the rudder system shown and described in U.S. Pat. No. 9,611,009, which is incorporated by reference herein in its entirety.

The neutral position of a rudder 38 is its position when the boat 100 is moving straight and not turning. In this embodiment, when the rudder 38 is in its neutral position, the chord of the rudder 38 is parallel to the centerline 102 of the boat 100 when viewed from above or below the boat 100. In embodiments where the rudder 38 is positioned on the centerline 102 of the boat 100, the chord of the rudder 38 is preferably aligned with the centerline 102.

As shown in FIG. 4, a steering wheel 34 is located at the control console 30. A user may turn the boat 100 by rotating the steering wheel 34, which in turn, rotates a steering column 36. Hydraulic steering is used in this embodiment, although any suitable steering mechanism may be used, including rack-and-pinion cable steering or electric steering, for example. A hydraulic pump is located on the steering column 36 and pumps hydraulic fluid into or out of a hydraulic cylinder to extend or retract the ram of the hydraulic cylinder. The hydraulic cylinder is connected to a tiller arm of the rudder 38 and when the ram of the hydraulic cylinder is extended, the rudder 38 rotates in one direction and when the ram is retracted, the rudder 38 rotates in the opposite direction.

Inboard boats are often preferred for water sports because the propeller 12 is positioned underneath the boat 100 and away from water sports performers and swimmers. However, the surf devices discussed herein may also be suitably used with boats having other propulsion devices 10. Other suitable propulsion devices 10 include, for example, the stern drive 40 (also referred to as an inboard/outboard) shown in FIGS. 5A and 5B, the outboard motor 50 shown in FIG. 6, and the jet drive 60 shown in FIG. 7. When a single propulsion device 10 is used, these propulsion devices 10 are preferably located along the centerline 102 of the boat 100. When multiple propulsion devices 10 are used, they are preferably located symmetrically about the centerline 102 of the boat 100 and closer to the centerline 102 than either the port side 117 of the hull 110 and the starboard side 119 of the hull 110.

Figure 5A:
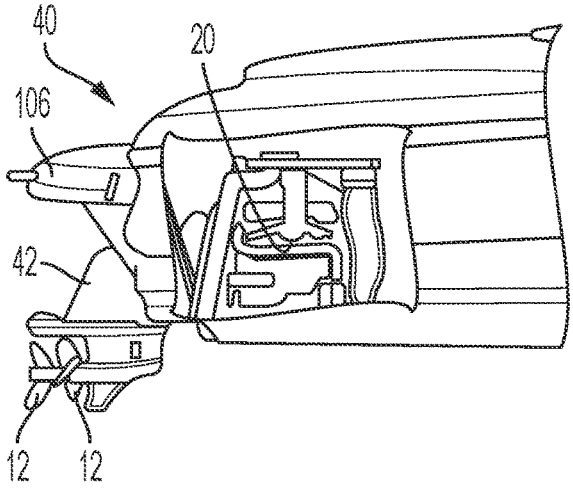
FIGS. 5A and 5B are partial cutaway views of the stern of the boat equipped with a stern drive.
Figure 5B:
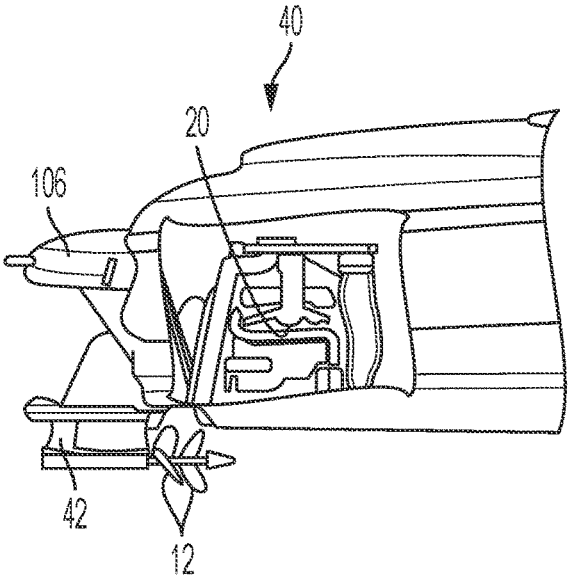

As shown in FIGS. 5A and 5B, the stern drive 40 includes an engine 20 positioned inside the hull 110 of the boat 100. Instead of being coupled to the propeller 12 beneath the hull bottom 115, the engine 20 of the stern drive 40 is coupled to an outdrive 42 (also referred to as a drive unit). The outdrive 42 includes a propeller 12 and, more specifically in the outdrives 42 depicted in FIGS. 5A and 5B, two counter rotating propellers 12. The outdrive 42 is attached to the transom 113 of the boat and extends aft of the transom 113. The boat 100 is steered by pivoting the outdrive 42 in port and starboard directions, thus controlling the direction of thrust produced by the propeller 12. Any suitable mechanism may be used, such as hydraulic cylinders, to pivot the outdrive 42 and the hydraulic cylinders on the outdrive 42 may be operated by turning the steering wheel 34 in the manner discussed above. The propeller 12 of a stern drive 40 may be positioned aft of the transom 113, as shown in FIG. 5A, but the stern drive 40 may also be a forward drive as shown in FIG. 5B, with the propeller 12 positioned forward of the transom 113 and underneath the hull bottom 115.

Figure 6:
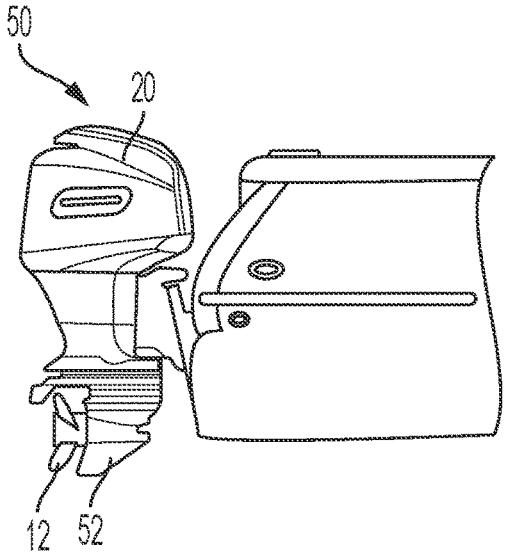
FIG. 6 shows the stern of the boat equipped with an outboard motor.

As shown in FIG. 6, the outboard motor 50 is attached to the stern of the boat 100, and more specifically, the transom 113. The engine 20 of the outboard motor 50 is positioned above the drive unit 52. The drive unit 52 includes the propeller 12. The outboard motor 50, and, more specifically, the engine 20, the drive unit 52, and the propeller 12 are positioned aft of the transom 113. Like the stern drive 40, the boat 100 is steered by pivoting the outboard motor 50 in port and starboard directions, thus controlling the direction of thrust produced by the propeller 12, and any suitable mechanism, like hydraulic cylinders, may be used to steer the boat 100 using the steering wheel 34.

Figure 7:
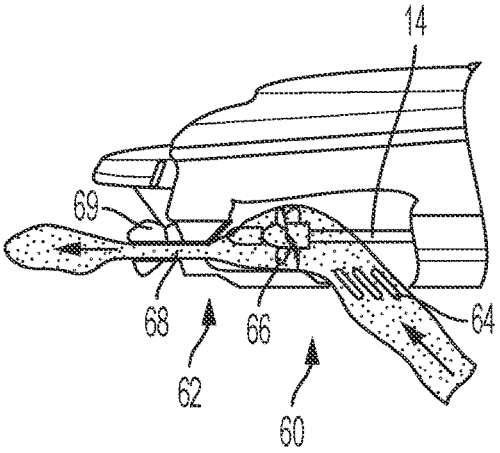
FIG. 7 is a partial cutaway view of the stern of the boat equipped with a jet drive.

FIG. 7 shows a jet drive 60. The jet unit 62 is mounted forward of the transom 113. Water enters an intake 64 of the jet unit 62 on the hull bottom 115, is accelerated through the jet unit 62, and is discharged through the transom 113 at a high velocity. The pumping portion (unit) of the jet unit 62 includes an impeller 66 and a stator (not shown) to increase the pressure of the flow. This high-pressure flow is discharged at a nozzle 68 as a high-velocity jet stream. The drive shaft 14 connects the engine 20 with the impeller 66, and the engine 20 thus drives the impeller 66 in a manner similar to a propeller. Steering is achieved by changing the direction of the stream of water as it leaves the jet unit 62, such as by rotating the nozzle 68, using a suitable mechanism, such as hydraulic cylinders and the hydraulic steering, discussed above. Directing the jet stream one way forces the stern of the boat 100 in the opposite direction, turning the boat 100. An astern deflector 69 may be lowered into the jet stream after it leaves the nozzle 68, reversing the direction of the force generated by the jet stream, forward and down, to keep the boat stationary or propel it in the astern direction.

As shown schematically in FIG. 4, the boat 100 also includes a controller 70. The controller 70 may be housed within the control console 30 and used to control various features of the boat 100 and surf devices discussed herein. In this embodiment, the controller 70 is a microprocessor-based controller that includes a processor 72 for performing various functions, discussed further below, and a memory 74 for storing various data. The controller 70 may also be referred to as a CPU. In one embodiment, the various methods discussed below may be implemented by way of a series of instructions stored in the memory 74 and executed by the processor 72.

The controller 70 may be communicatively coupled to at least one display screen 76, 78, and in this embodiment, the controller 70 is communicatively coupled to two display screens, a center display 76 and a side display 78. As can be seen in FIG. 4, the center display 76 is located at the top of a dash in the control console 30 and above and forward of the steering wheel 34. In this embodiment, the center display 76 is a 12-inch display having a generally rectangular shape in a landscape orientation and rounded inboard and outboard edges. Although the center display 76 may be a touchscreen, the center display 76 in this particular embodiment is not a touchscreen because of the positioning of the center display 76 and the type of information displayed on it. The positioning of the center display 76 makes it difficult or awkward for a user to reach with his or her hand, so to the extent user-selectable options are displayed on the center display 76, they may be selected by using a switch pad 82 or another suitable input device.

Many of the input devices (operator controls) on the boat 100 are located on the control console 30 to the side of the steering wheel 34. In this embodiment, the input devices are located on the outboard side of the steering wheel 34 and can be conveniently operated by the operator's right hand. One of the main input devices is the side display 78. In this embodiment, the side display 78 is a 10-inch, rectangular, touchscreen display that has a portrait orientation. A plurality of user-selectable controls (options) may be displayed on the side display 78 that enable a user to operate the surf devices in the manner discussed herein. Information regarding the position and/or condition of the surf devices may also be displayed (presented) on the side display 78 and/or displayed (presented) on the center display 76. The plurality of user-selectable options are icons displayed on the side display 78 may be selected by a user pressing the icon. The terms icon, virtual button, and button may be used interchangeably herein. Such user-selectable options may include, for example, options to fill or empty the ballast (e.g., ballast tanks 142, 144, 146) and to deploy or retract the various surf devices discussed herein.

The memory 74 may store preprogrammed or user-defined wakesurf configurations, also referred to as profiles. Such profiles may include settings for the ballast, position of the surf devices, and speed of the boat 100. The speed of the boat 100 for such a setting may be operated by cruise control. When activated, such as by a profile or when a user selects the cruise control, the controller 70 activates cruise control at the set speed stored in the memory 74 of the controller 70. Any suitable cruise control may be used, including, for example, GPS-based Zero Off® cruise control by Enovation Controls of Tulsa, OK, in which the controller 70 operates the throttle 24 of the engine 20 to maintain the boat 100 at the set speed based on the speed of the boat received by a GPS system. For the embodiments discussed herein, the set speed for the cruise control is a speed suitable for surfing, preferably between 9 mph to 12 mph.

Other input devices (controls) include the switch pad 82, an ignition button 84, and other static buttons and switches that are part of a switch pack 86. The buttons and switches of the switch pack 86 may be used to control various aspects of the boat 100. For example, the switch pack 86 may include buttons or switches that may be used to fill or empty the ballast (e.g., ballast tanks 142, 144, 146) and to deploy or retract the various surf devices discussed herein. Located near the control console 30 on the starboard side wall is a keyed switch 88. A key 89 unique to the boat can be inserted in the switch 88 and then rotated to turn on (or off) the electrical system of the boat. With the key 89 in the on position, an operator can press the ignition button 84 to turn on (or off) the engine 20.

First Embodiment

Figure 8:
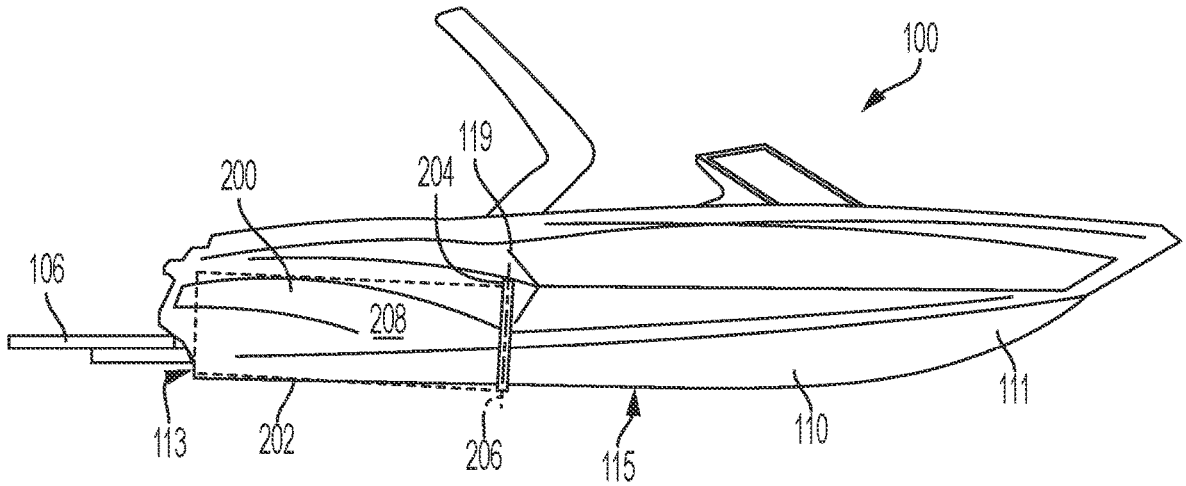
FIG. 8 is a starboard side view of a boat having a surf device according to a first preferred embodiment of the invention.
Figure 9:
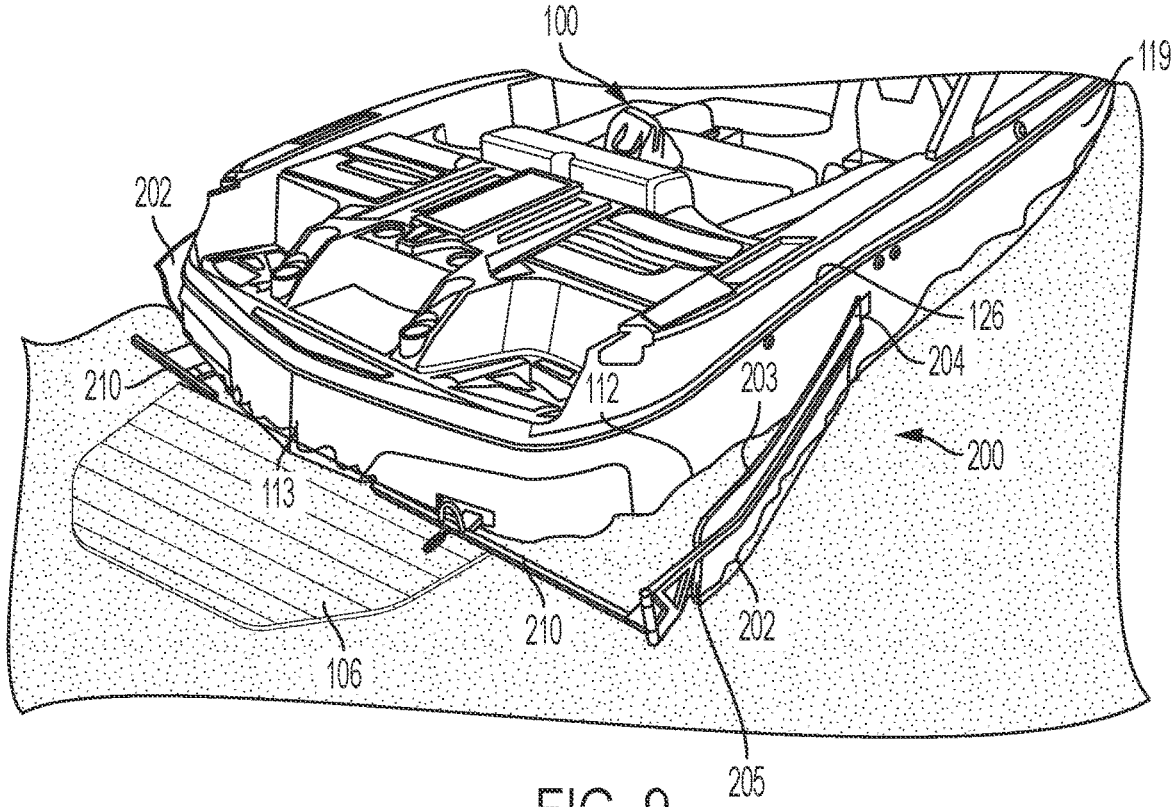
FIG. 9 is a perspective view of the boat shown in FIG. 8, showing the surf device in a deployed position.
Figure 10:
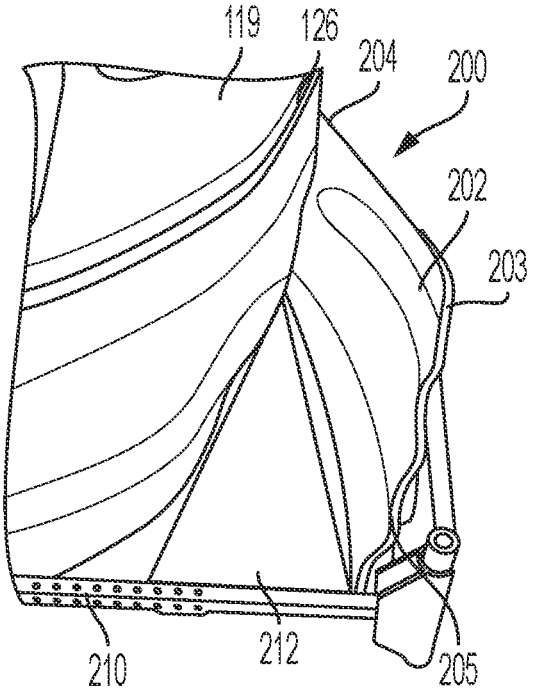
FIG. 10 is a perspective view of the starboard-side, aft corner of the boat shown in FIG. 8, showing the surf device in a deployed position.
Figure 11:
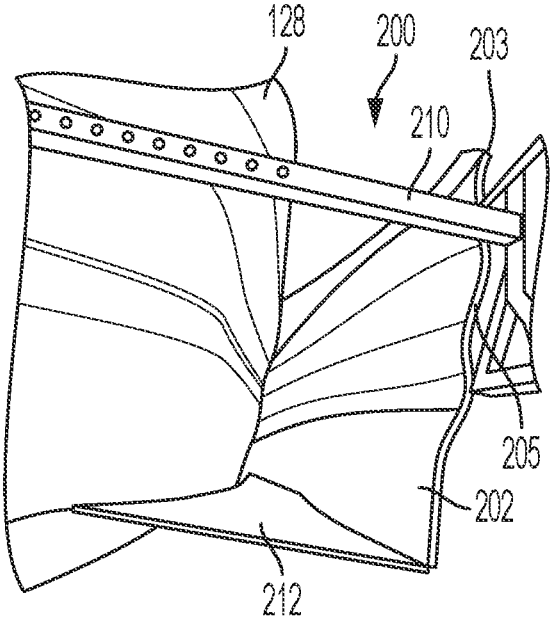
FIG. 11 is an aft view of the starboard-side, aft corner of the boat shown in FIG. 8, showing the surf device in a deployed position.

FIG. 8 shows a boat, such as the boat 100, equipped with a surf device 200 in accordance with a first preferred embodiment of the invention. FIG. 8 is a starboard side view of the boat 100. To distinguish it from the other surf devices discussed herein, the surf device 200 of this embodiment is referred to as a deployable hull side 200. The deployable hull side 200 is movable between a stowed position and a deployed position. The stowed position may also be referred to herein as a non-deployed position. FIG. 9 is a perspective view of the boat 100 in a body of water with the deployable hull side 200 in the deployed position. FIGS. 10 and 11 also show the deployable hull side 200 in the deployed position. FIG. 10 is a perspective view of the starboard-side, aft corner taken from above the deployable hull side 200, looking down, and FIG. 11 is an aft view of the starboard-side, aft corner, looking forward.

Figure 15:
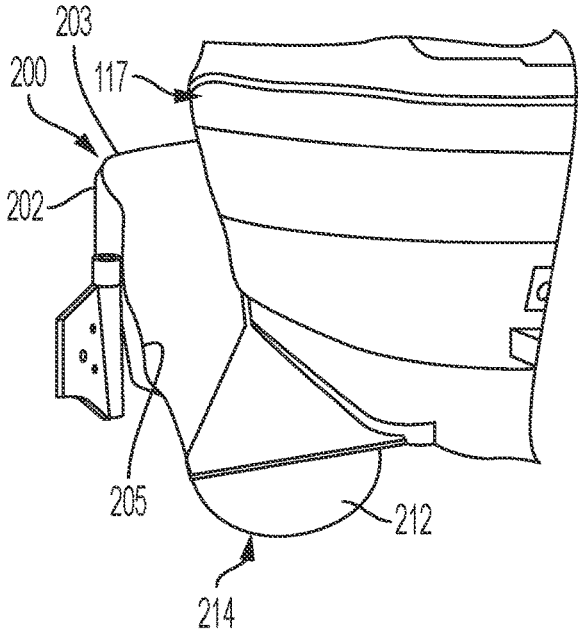
FIG. 15 is an aft view of the port-side, aft corner of the boat shown in FIG. 8, showing a variation of the surf device of the first embodiment in a deployed position.

The deployable hull side 200 shown in FIGS. 8-11 is on the starboard side of the boat 100 (a starboard-side deployable hull side 200). The boat 100 is also equipped with a deployable hull side 200 on the port side of the boat 100 (a port-side deployable hull side 200). The deployable hull side 200 on the port side of the boat 100 is a mirror image of the deployable hull side 200 on the starboard side of the boat 100, and thus a description and depiction of the deployable hull side 200 on the port side of the boat 100 is omitted here. FIG. 15, which shows a variation of the deployable hull side 200 of this embodiment, shows a port-side deployable hull side 200.

As shown in FIGS. 8-12, the deployable hull side 200 includes a flap 202 that is pivotably attached to the starboard side 119 of the hull 110. The flap 202 may be attached to the starboard side 119 of the hull 110 by any suitable pivot mechanism, including a hinge 204. The flap 202 rotates about a pivot axis 206 of the pivot mechanism (hinge 204) to move between the stowed position and the deployed position. In the stowed position, the flap 202 is positioned against the starboard side 119 of the hull 110. The starboard side 119 of the hull 110 may also include a recess or a cutout 209 (see FIG. 13) such that the outboard surface 208 of the flap 202 is coplanar or flush with adjacent sections of the starboard side 119 of the hull 110 in the stowed position, allowing the water to flow smoothly along the starboard side 119 of the hull 110. With the flap 202 being located in the aft section of the boat 100 in this embodiment, the leading edge of the outboard surface 208 is coplanar or flush with a forward section of the starboard side 119 of the hull 110. In this embodiment, the outboard surface 208 of the flap 202 is a generally planar surface having various style lines and contours that correspond to adjacent portions of the starboard side 119 of the hull 110.

Figure 12:
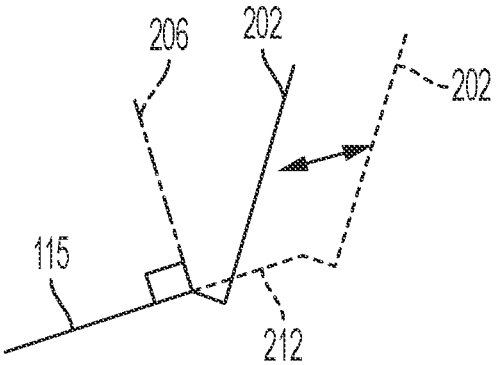
FIG. 12 is a schematic of the aft section of the boat shown in FIG. 11 at the transom illustrating the surf device in both the deployed position (dashed lines) and a stowed position (solid lines).

In FIGS. 9-11, the pivot axis 206 is aligned to be parallel to or coplanar with the starboard side 119 of the hull 110. In this embodiment, the starboard side 119 of the hull 110 has an inclination such that the lower portion of the starboard side 119 of the hull 110 (the portion proximate the chine) is inboard of an upper portion of the starboard side 119 of the hull 110, and the pivot axis 206 is aligned with this inclination. In this embodiment, the boat 100 includes a rub rail 126 (see FIG. 9) on each of the port side 117 and starboard side 119 of the hull 110, and the inclination of the hull side may be taken as a line from the chine to a portion of the side of the hull abutting the rub rail 126. The pivot axis 206 is not limited to this inclination; instead, the pivot axis 206 may be vertical or have another inclination such that the flap 202 swings outboard. FIG. 12 is a schematic of the aft section of the boat 100 at the transom. In this embodiment, the pivot axis 206 is perpendicular to the deadrise or chine angle of the boat 100, allowing the outboard surface 208 of the flap 202 to track out evenly. In FIG. 12, the solid lines indicate the location of the flap 202 in the stowed position and the broken lines indicate the location of the flap 202 in the deployed position. A separate flange or hinge point may be used to facilitate the movement illustrated in FIG. 12. The hinge 204 orientation can be that such the flap 202 can be deployed with its lowest point above the chine (as shown in FIG. 12), below the chine, or anywhere in between. In this embodiment, the hinge 204 is located proximate to a forward edge of the flap 202 such that an aft edge 205 of the flap 202 rotates outboard and the outboard surface 208 of the flap 202 forms an obtuse angle with the starboard side 119 of the hull, and in this embodiment, the hinge 204 is attached to the forward edge of the flap 202.

FIGS. 9-11 show the deployable hull side 200 of this embodiment in its deployed position. In its deployed position, the flap 202 pivots outboard from the starboard side 119 of the hull 110. In the deployed position, the flap 202 may be pivoted outboard from the starboard side 119 of the hull 110 at the transom 113 by 9 degrees to 14 degrees, for example, and the outboard surface 208 of the flap 202 in this embodiment forms an obtuse angle with the portion of the hull side forward of the flap 202. The flap 202 may have a plurality of deployed positions where the flap is deployed outward from the hull side (e.g., starboard side 119 of the hull 110) at different angles. The flap 202 is pivotably attached to the starboard side 119 of the hull 110 by the hinge 204 forward of the transom 113, and in this embodiment, the flap 202 is sized such that the entirety of the flap 202 is forward of the transom 113. Alternatively, the flap 202 may extend aft past the transom 113.

As noted above, the boat 100 is operable in a body of water, and the body of water has a water surface. As shown in FIG. 9, the hull 110 includes a waterline 112 where the water surface contacts the hull 110 of the boat 100. The flap 202 is preferably sized such that the flap 202 extends out of the water, and more specifically such that a top edge 203 of the flap 202 is higher than the waterline 112. In some embodiments, the waterline 112 may be determined when the boat 100 is in a static-flotation condition. As the flap 202 is preferably used for a water sport, the waterline 112 is preferably determined when the boat 100 is configured for the water sport, such as surfing. If the waterline is determined when the boat 100 is configured for surfing, for example, the boat 100 may be loaded with the appropriate ballast, and, preferably, the waterline may be determined when the boat 100 is moved through the body of water at a speed suitable for surfing. When a hydrofoil is used for surfing (such as the hydrofoil device 400, discussed below), the waterline 112 may be determined when the hydrofoil is in its deployed position and the boat 100 is moved through the water, again, preferably at a speed suitable for surfing.

In some embodiments, the height of the flap 202 may preferably be at least half the height of the starboard side 119 of the hull 110 (hull side), and more preferably, at least two-thirds the height of the hull side. In this embodiment, the height of the hull side may be taken as the distance from the chine to the sheer line. In this embodiment, the sheer line is located near the rub rail 126, and the height of the hull side may also be the distance from the chine to the rub rail 126. In the embodiment shown in FIG. 11, the hull includes a style line 128 where a portion of the hull side beneath the style line 128 is inboard of the portion of the hull side above the style line 128. Put another way, the portion of the hull side above the style line 128 protrudes outboard of the portion of the hull side beneath the style line 128. In this embodiment, the flap 202 is configured to be positioned under the style line 128 in the non-deployed position, and the top edge 203 of the flap 202 is proximate the style line 128. In some embodiments, the top edge 203 of the flap 202 will be located below the gunwales 122, 124 by, for example, a distance from 6-12 inches.

The flap 202 has a length, preferably, the flap has a length that is at least 12.5 percent of the length of the boat 100 and more preferably at least 15 percent of the length of the boat 100. The flap 202 preferably is positioned aft of the longitudinal center of gravity (LCG) of the boat 100. Preferably, the LCG is determined when the boat is configured for a water sport, such as surfing. The flap 202 preferably has a length less that is than the distance from the LCG to the transom 113 of the boat 100, and may, for example, have a length that is less than 33 percent of the length of the boat 100. The flap 202 shown in FIGS. 8-11 is 50 inches long and 36 inches tall.

As noted above, the flap 202 may be sized such that the entirety of the flap 202 is forward of the transom 113. In this embodiment, the aft edge 205 of the flap 202 is located proximate the transom 113 and may be located where the hull side (e.g., starboard side 119 of the hull 110) begins to transition to the transom 113. As can be seen in FIG. 9, the flap 202 has a length that extends from the rear of the primary seating area 134 (cockpit) to the transom 113. The flap 202 thus has a length that is the size of the motor box which houses the engine 20.

In this embodiment, the flap 202 is formed from fiberglass, but other suitable materials may be used instead, such as wood, plastic including a plastic membrane, fiber reinforced composites, or metals including aluminum and stainless steel.

Figure 13:
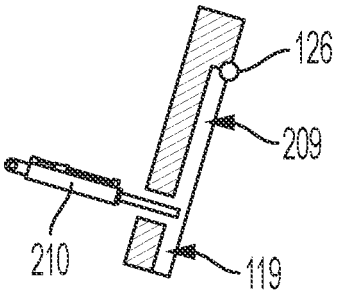
FIG. 13 is a schematic cross-sectional view of the port side of the hull with a flap of the surf device of the first embodiment removed for clarity.

In FIGS. 9-11, the movement mechanism 210 used to move the flap 202 to its deployed position and hold it in the deployed position is manual. As shown, the movement mechanism 210 is a bar with a plurality of holes used to engage with a pin and a bracket mounted to the transom 113, but any suitable movement mechanism 210 may be used, including, but not limited to, electric linear actuators, hydraulic linear actuators, gas assist pneumatic actuators, and electrical motors. A suitable actuator may include the electric linear actuator available from Lenco Marine. Another suitable linear actuator is an electro-hydraulic actuator, such as one available from Parker Hannifin Corp, of Marysville, OH. In addition, the movement mechanism 210 may be attached to the boat at other locations other than the transom 113, such as the starboard side 119 of the hull 110 and even located within the hull 110. For example, FIG. 13 is a schematic cross-sectional view of the port side 117 of the hull 110, with the flap 202 removed for clarity. A linear actuator is shown as the movement mechanism 210 located within the hull 110. The cutout 209 is also schematically illustrated in FIG. 13. With movement mechanisms 210 discussed herein that are not manually operated, the controller 70 is configured to operate the movement mechanisms 210 in response to input from the various input devices discussed above including the selection of programs stored in the memory 74.

Figure 14:
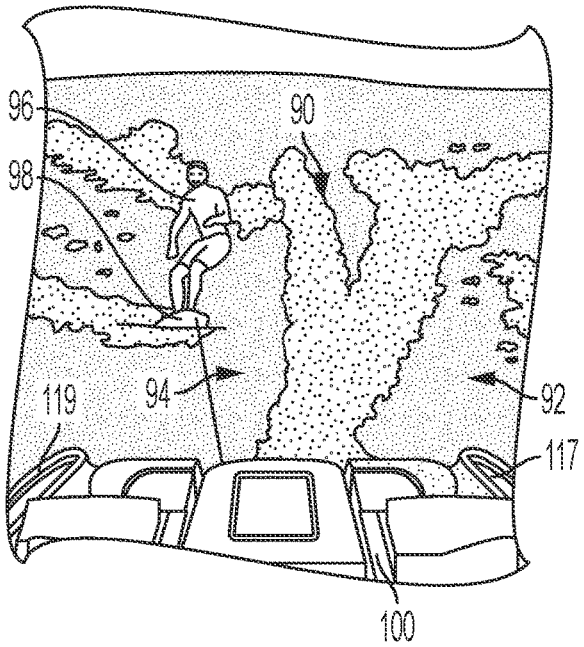
FIG. 14 shows the stern of the boat of FIG. 1 and the wake of the boat with a surfable wake on the starboard side of the boat. A surfer is shown surfing the surfable wake.

The flap 202 is moved to its deployed position as the boat 100 is moved through the water to modify the wake of the boat 100 for water sports. In particular, the deployable hull side 200 of this embodiment may be particularly suited to improve the wake of the boat 100 for wakesurfing. When the inboard boat 100 is moved through the water using the propulsion device 10, as discussed above, the inboard boat 100 generates a wake 90, as shown, for example, in FIG. 14. The wake 90 may include a port-side wave 92 and a starboard-side wave 94. The port-side wave 92 and the starboard-side wave 94 may also be referred to as a port-side wake and a starboard-side wake. By operating the surf devices discussed herein, the wake 90 may be made suitable for wakesurfing, generating a surfable wake. In some embodiments, the surfable wake will include both the port-side wave 92 and the starboard-side wave 94 being suitable for wakesurfing, but in other embodiments, one side of the wake (one of the port-side wave 92 and the starboard-side wave 94) may be suitable for wakesurfing while the other side is less suitable or not suitable for wakesurfing. As can be seen in FIG. 14, the starboard-side wave 94 is suitable for wakesurfing and is pushing a surfer 96 and, more specifically, a surfboard 98 of the surfer 96 forward with the starboard-side wave 94 of the surfable wake. The side or sides of the boat 100 with the desirable wave for wakesurfing is referred to as a surf side. In FIG. 14, for example, the starboard side is the surf side.

When the boat 100 is moved through the water as speeds suitable for surfing (approximately 9 mph to 12 mph) with the flap 202 in its deployed position, the flap 202 improves the wake 90 of the boat 100 for wakesurfing. In some embodiments, the flap 202 on the side of the boat opposite the surf side of the boat (non-surf side) may be moved to its deployed position to improve the wake 90 for wakesurfing, but in other embodiments, the flap 202 on the surf side of the boat may be moved to its deployed position to improve the wake 90 for wakesurfing. The flap 202 of this embodiment may be suitably used with other devices for wakesurfing, such as, for example, the downturned-surface surf devices 152, 154. When used with such surf devices, the flap 202 on the surf side of the boat 100 may be moved to its deployed position, and the downturned-surface surf devices 152, 154 on the side of the boat opposite the surf side is moved to its deployed position. To generate a surfable wave on the starboard side of the boat 100, for example, the starboard flap 202 is deployed and the port downturned-surface surf device 152 is deployed. To generate a surfable wave on the port side of the boat 100, for example, the port flap 202 is deployed and the starboard downturned-surface surf device 152 is deployed. Even further, it may be possible to deploy both the flap 202 on the port side of the boat 100 and the flap 202 on the starboard side of the boat 100 simultaneously to improve the wake 90 for surfing on both sides of the boat.

As shown in FIGS. 10 and 11, the deployable hull side 200 of this embodiment also includes a panel 212 used to fill the gap (space) between the flap 202 and the starboard side 119 of the hull 110. Such a panel 212 fills in this gap and prevents water from entering the space as the boat 100 moves through the water, such as from under the flap 202. Although shown with only one panel 212 on the bottom side of the flap 202, similar panels may also be located on the top side of the flap 202 and the aft side of the flap 202. When completely enclosed, using, for example, a flexible material, the enclosure may be filled with water or other ballast, further increasing the displacement of the boat 100 at that location. In FIGS. 10 and 11, the panel 212 is flat (generally planar), but the panel 212 may have any suitable shape. For example, as shown in FIG. 15, the bottom surface 214 of the panel 212 is convex and extends down into the water below the bottom of the flap 202. The shape of the bottom surface 214 in FIG. 15 is semi-circular, but other suitable shapes may be used, including concave shapes, for example. The panel 212 is optional and the deployable hull side 200 of this embodiment may be used without the panel 212.

As discussed above, the flap 202 is mounted with the hinge 204 forward of the transom 113 by at least a couple of feet. The flap 202 creates a water flow separation point from the hull side forward of the transom 113. In addition, the bottom surface 214 of the panel 212 extends the hull bottom 115 (running surface). This effectively widens the boat and creates a farther trailing edge width from hull side (e.g., port side 117 or starboard side 119) to the deployed flap 202, and changes the shape of the boat 100 to improve the surf wave rather than just divert water.

Second Embodiment

Figure 16:
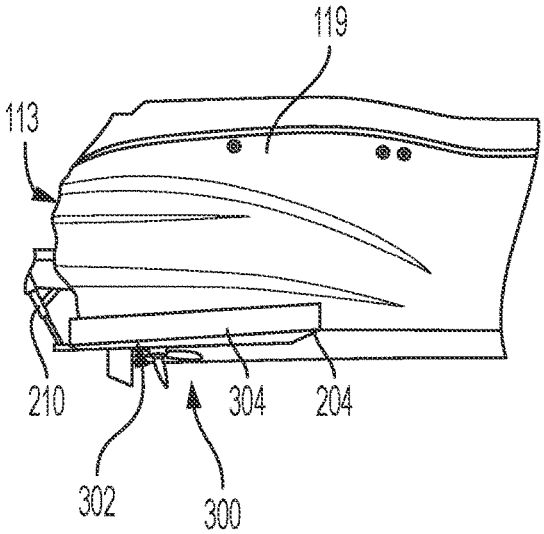
FIG. 16 is a starboard side view of a stern section of a boat having a surf device according to a second preferred embodiment of the invention. The surf device in FIG. 16 is shown in a deployed position.
Figure 17:
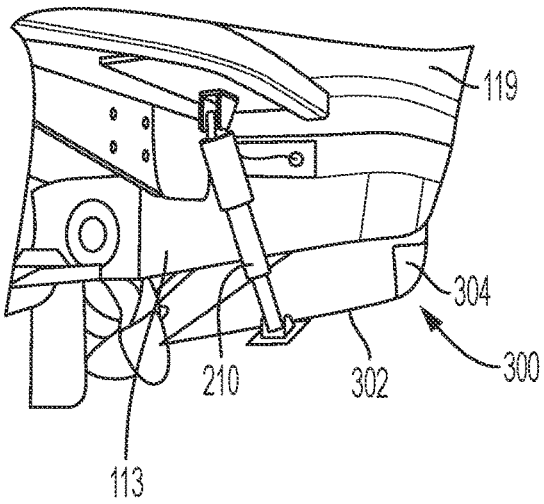
FIG. 17 is a perspective view of the starboard-side, aft corner of the boat shown in FIG. 16, showing the surf device in the deployed position.
Figure 18:
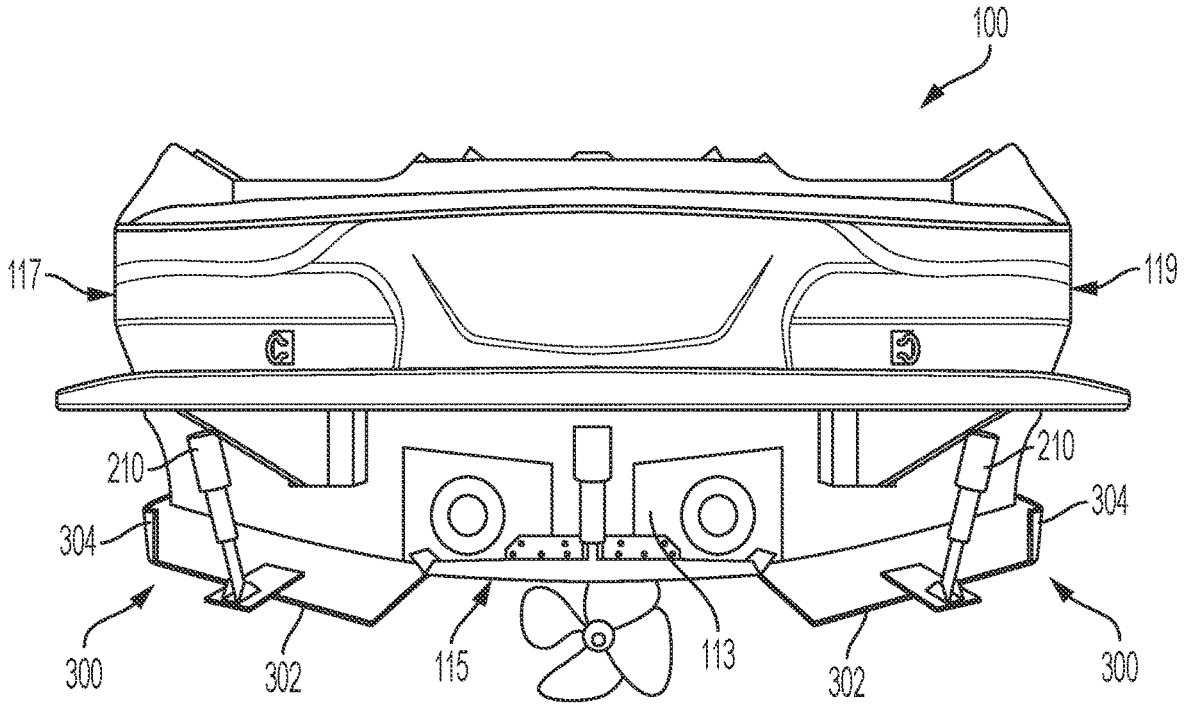
FIG. 18 is an aft view of the boat shown in FIG. 16 with the surf device on both the starboard side and the port side of the boat in the deployed position.
Figure 19:
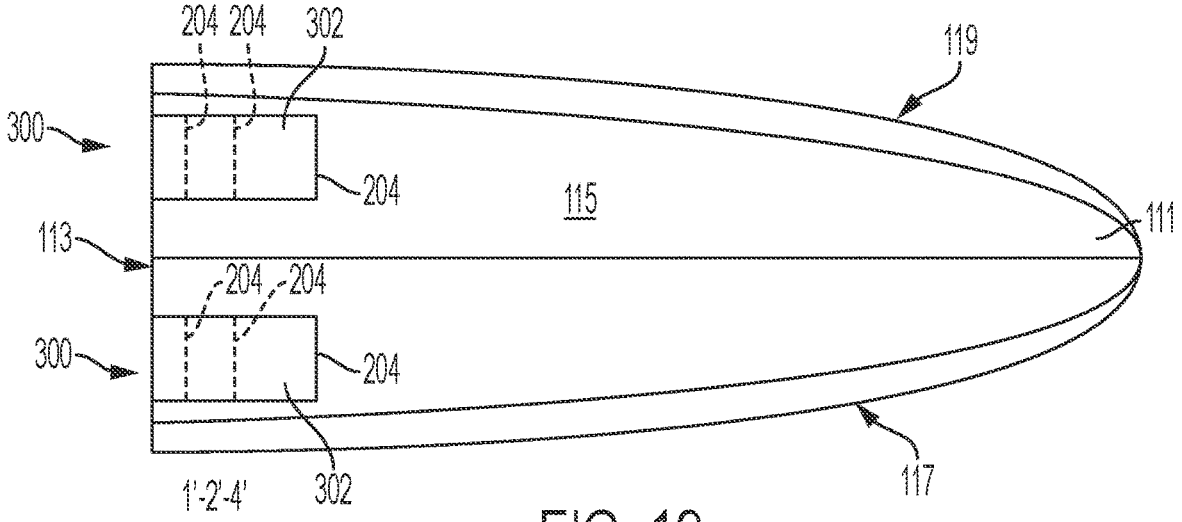
FIG. 19 is an underside view of the hull bottom of the boat shown in FIG. 16.

A boat, such as boat 100, with a surf device 300 according to a second preferred embodiment of the invention is shown in FIGS. 16-18. To distinguish it from the other surf devices discussed herein, the surf device 300 of this embodiment is referred to as a deployable hull bottom 300. FIG. 16 is a starboard side view of a stern section of a boat 100 with the deployable hull bottom 300. FIG. 17 is a perspective view of the starboard-side, aft corner of the boat 100. FIG. 18 is an aft view of the boat 100. FIG. 19 is an underside view of the boat 100. The starboard-side deployable hull bottom 300 is shown in FIGS. 16 and 17 in its deployed position. FIGS. 18 and 19 show both a port-side deployable hull bottom 300 and the starboard-side deployable hull bottom 300. In FIG. 18, both the port-side deployable hull bottom 300 and the starboard-side deployable hull bottom 300 are in their deployed position. The port-side deployable hull bottom 300 is a mirror image of the starboard-side deployable hull bottom 300, and thus a description and depiction of the deployable hull bottom 300 on the port side of the boat 100 is omitted here.

The deployable hull bottom 300 of this embodiment includes a panel 302 pivotably attached to the hull bottom 115. The surf device 300 of this embodiment is configured similarly to the deployable hull side 200, except the panel 302 pivots downward from the hull bottom 115 in the deployed position. In the stowed position, the panel 302 is positioned against the hull bottom 115, but the panel 302 may also be inset into a recess or a cutout such that the bottom surface of the panel 302 is coplanar with adjacent sections of the hull bottom 115 in the stowed position, allowing the water to flow smoothly along the hull bottom 115. The panel 302 is pivotably attached to the hull bottom 115 using a hinge 204 forward of the transom 113 such that the entirety of the panel 302 is forward of the transom 113. Alternatively, the panel 302 may extend aft past the transom 113. In this embodiment, the pivot axis 206 of the hinge 204 is transverse to the centerline 102 of the boat 100. In this embodiment, the pivot axis 206 is perpendicular to the centerline 102, but in other embodiments, the pivot axis 206 may be oriented obliquely to the centerline 102.

When the boat 100 is moved through the water for water sports, such as for wakesurfing, the panel 302 is moved to its deployed position using a movement mechanism 210 to improve the wake 90 for wakesurfing. The movement mechanism 210 shown in this embodiment is an electrical linear actuator, but any suitable movement mechanism 210 may be used, as discussed above. In this embodiment, the panel 302 on the side opposite the surf side of the boat 100 (non-surf side) is deployed as the boat 100 moves through the water to generate a surfable wake. The panel 302 is moved downward in its deployed position and, as with the flap 202 discussed above, may include a plurality of deployed positions, each having a different downward angle relative to the hull bottom 115.

The panel 302 may be made of any suitable material, including those discussed above for the flap 202 of the deployable hull side 200. The panel 302 may be of various sizes and lengths. For example, the panel 302 may be 1 foot, 2 feet, or 4 feet as shown in FIG. 19. Where the boat 100 is 22 feet in length, the panel 302 may have a length that is preferably from 4-20 percent of the length of the boat 100. The panel 302 of this embodiment could be used as a planing device, and preferably, the panel 302 is sized such that it is in the water when the boat 100 is on plane. Preferably, the panel 302 does not extend forward of the LCG, and the length of the panel 302 is less than one third of the length of boat 100.

The panel 302 of this embodiment preferably has a width of approximately 30 inches, and in some embodiments the width is constant over the length of the panel 302, as can be seen in FIG. 18. Although other suitable widths may be used, such as 1 inch or greater and widths that extend from the chine to just outside of the propeller 12 diameter. As can be seen in FIG. 18, the panel 302 is preferably located outboard of the propulsion device 10. Preferably, each panel 302 can be located between the propeller 12 and the chine, and may, for example, be located on the outer third of the hull bottom 115 outboard of either side of the propulsion device 10.

In this embodiment, the bottom surface of the panel 302 is curved with a convex shape that corresponds to the shape of the hull bottom 115. But other suitable shapes may be used, such as, for example, a flat, planar surface.

In this embodiment, the deployable hull bottom 300 also includes a side panel 304. The side extends in an upward direction from the bottom panel 302. The side panel 304 has an outer surface, which corresponds to the bottom portion of the side (the port side 117 or starboard side 119) of the hull 110. The height of the side panel 304 is preferably at least the height of the maximum deployment of the bottom panel 302 from the hull bottom. In this way, the side panel 304 may prevent water flowing along the side (the port side 117 or starboard side 119) of the hull 110 from flowing between the bottom panel 302 and the hull bottom 115.

Figure 20:
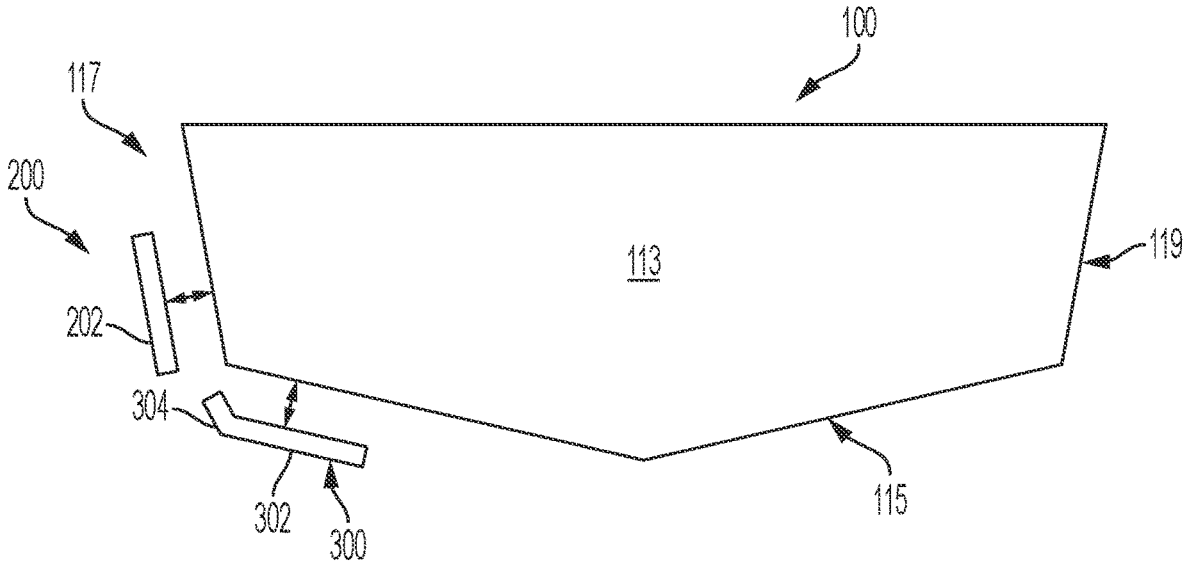
FIG. 20 is an aft view of a boat having surf devices according to both the first and second preferred embodiments of the invention.

As discussed above, the various embodiments discussed herein may be used together and with other surf devices. FIG. 20 is an aft view of a boat 100 having the deployable hull side 200 and the deployable hull bottom 300.

Third Embodiment

Figure 21:
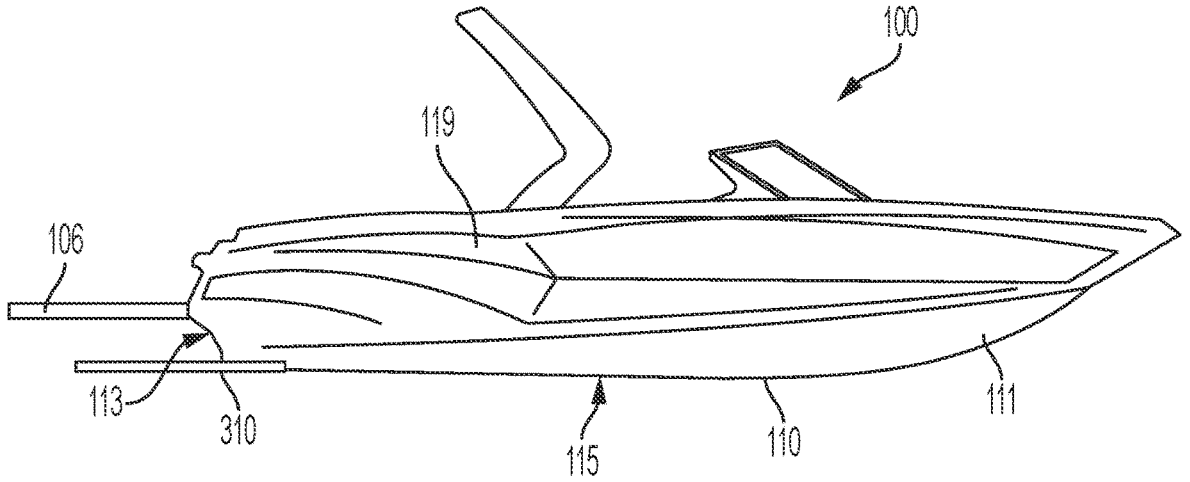
FIG. 21 is a starboard side view of a boat having a surf device according to a third preferred embodiment of the invention. The surf device in FIG. 21 is shown in a deployed position.
Figure 22:
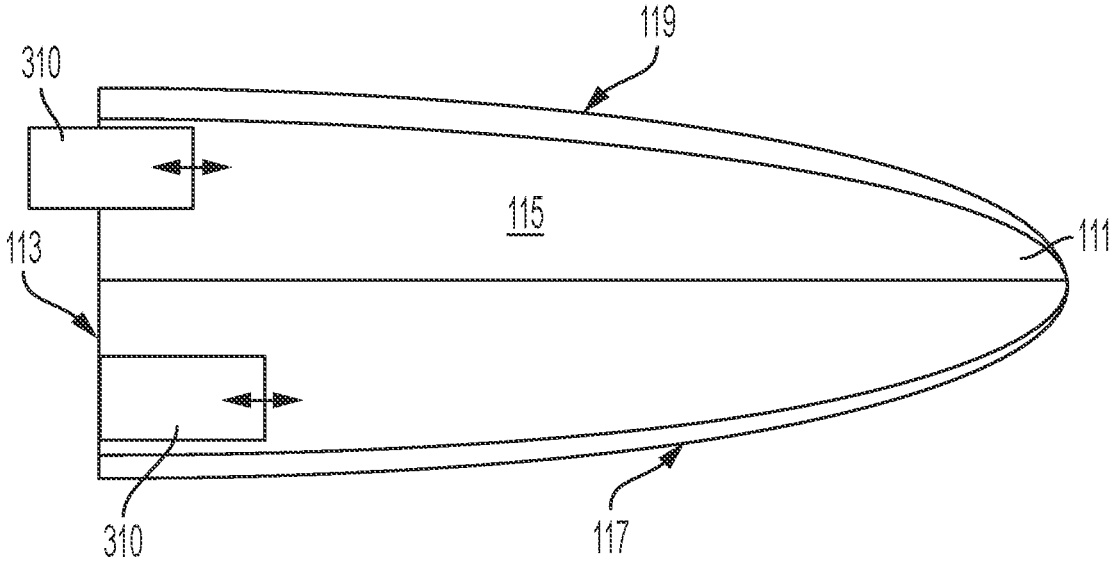
FIG. 22 is an underside view of the hull bottom of the boat shown in FIG. 21.
Figure 23:
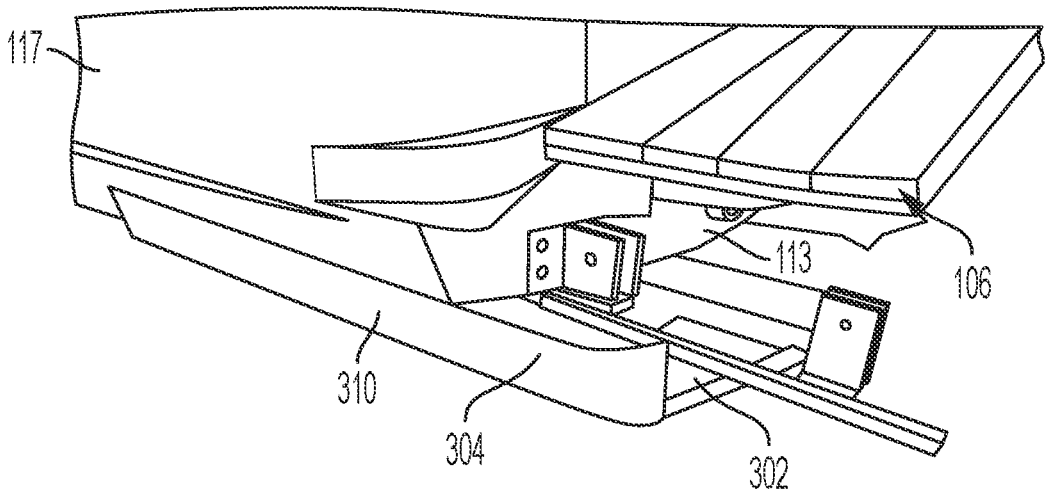
FIG. 23 is a perspective view of the port-side, aft corner of the boat shown in FIG. 21, showing the port-side surf device in the deployed position.

FIGS. 21-23 show a surf device 310 according to a third preferred embodiment of the invention. In the second embodiment, the deployable hull bottom 300 is attached to the hull bottom 115 and pivots down from the hull bottom 115 to move to the deployed position. In this embodiment, the surf device 310 is slidably attached to the hull bottom 115 using, for example, tracks, but other suitable means could be used. To distinguish it from the other surf devices discussed herein, the surf device 310 of this embodiment is referred to as a slidable hull bottom 310. In the non-deployed (or stowed) position, the slidable hull bottom 310 is positioned similarly to the surf device 200 of the second embodiment, except that to move to the deployed position, the slidable hull bottom 310 of the third embodiment slides aft past the transom 113, and more specifically, at least a portion of the panel 302 extends aft past the transom 113 in the deployed position.

FIG. 21 is a starboard side view of a boat, such as boat 100, with the surf device 310 in the deployed position. FIG. 22 is an underside view of the boat 100, showing both a port-side slidable hull bottom 310 and a starboard-side slidable hull bottom 310. In FIG. 22, the starboard-side slidable hull bottom 310 is shown in the non-deployed (stowed) position, and the port-side slidable hull bottom 310 is shown in the deployed position.

FIG. 23 is a perspective view of the port-side, aft corner of the boat 100, showing the port slidable hull bottom 310 in the deployed position. The slidable hull bottom 310 shown in FIG. 23 is 4 feet long and, when fully extended in the deployed position, is 2 feet aft of the transom 113. In this embodiment, the slidable hull bottom 310 is sized such that it does not extend past the aft end of the swim platform 106 in its fully extended position. Any suitable movement mechanism 210 may be used to move the surf device 310 between its deployed and non-deployed positions, including those discussed in the embodiments above.

When used for water sports such as wakesurfing, the surf device 310 of this embodiment is operated similarly to the deployable hull bottom 300 discussed above. The slidable hull bottom 310 of this embodiment on the opposite side of the boat from the surf side (non-surf side) is moved to its deployed position. In some embodiments, both slidable hull bottoms 310 may be moved to a deployed position when used for water sports, such as wakesurfing. In such embodiments, the slidable hull bottom 310 on the non-surf side may be deployed to a greater extent than the slidable hull bottom 310 on the surf side. In other words, the slidable hull bottom 310 on the surf side may be deployed aft of the transom 113 to a deployed position where the aft end of the slidable hull bottom 310 on the surf side is forward of the aft end of the slidable hull bottom 310 on the non-surf side.

Fourth Embodiment

Figure 24:
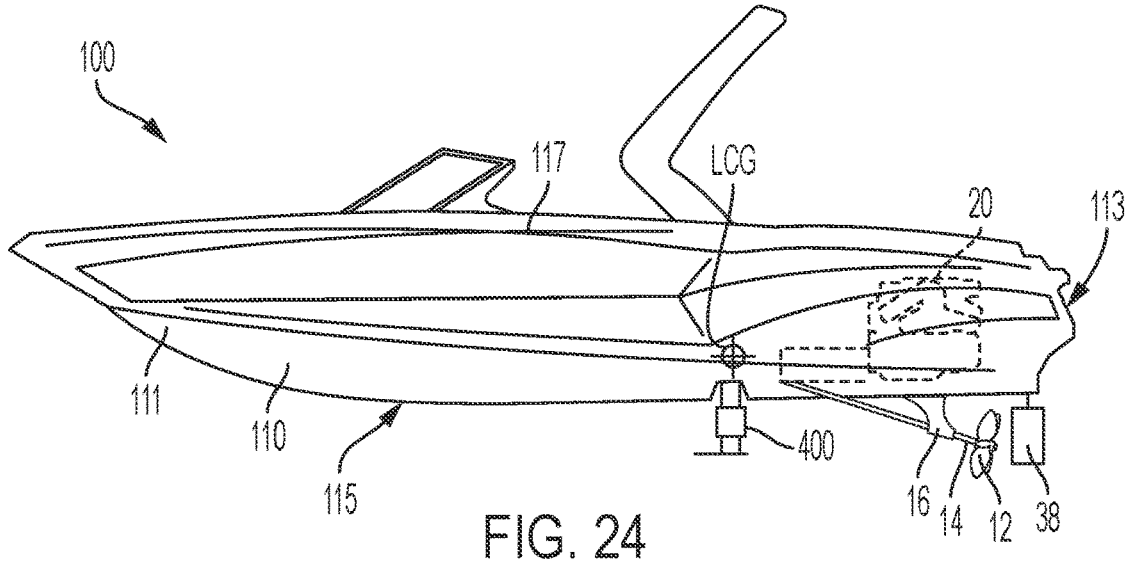
FIG. 24 is a port side view of a boat having a hydrofoil device according to a fourth embodiment of the invention.

As noted above, ballast (such as water in ballast tanks 142, 144, 146) may be used to increase the displacement of the boat 100 and thus increase the size of the wake 90 for water sports such as wakesurfing or wakeboarding. Instead of ballast or in addition to ballast, a hydrofoil device 400 may be used to further increase the displacement of the boat 100. Various hydrofoil devices 400 of this embodiment are shown in FIGS. 24-43. In this embodiment, the hydrofoil device 400 is installed on the bottom of the boat 100 near the longitudinal center of gravity (LCG), as shown in FIG. 24. FIG. 24 is a port side view of the boat 100 with the hydrofoil devices 400. When traveling at a speed used for wakesurfing, the boat 100 has an angle of attack (such as 12 degrees). By being located near the LCG, the hydrofoil device 400 pulls the entire boat 100 down, keeping a similar angle of attack but creating more displacement. In contrast, foils at the stern or transom 113 of the boat 100 pull the stern down, pivoting the boat 100 about the LCG and increasing the angle of attack.

In the boat 100 described herein, the LCG is in the aft half of the boat 100, and more specifically in the aft third of the boat 100, forward of the transom 113. Here the LCG and thus the hydrofoil device 400 are located forward of the rudder 38, the propeller 12, and the strut 16. In some embodiments, the LCG and thus the hydrofoil device 400 are located forward of the engine 20, but aft of the windshield 104 and the control console 30. The hydrofoil device 400 of this embodiment is preferably located near the center of gravity such that it is within 10 percent, relative to the length of the boat, in the forward or aft direction of the LCG.

Although only one hydrofoil device 400 is shown in this embodiment, multiple hydrofoil devices could be used. The hydrofoil devices 400 could be placed on either side of the centerline 102 of the boat 100, such as one on the port side and one on the starboard side, symmetrically with each other about the centerline 102. The hydrofoil devices 400 also could be positioned forward and aft of the LCG and positioned about the LCG such that the downward forces balance each other in a manner similar to that described below for the aft pair of foils 812, 814 and the forward pair of foils 822, 824. Where two hydrofoil devices 400 are used with one positioned forward of the LCG and the other positioned aft of the LCG, each hydrofoil device 400 is preferably centered on the centerline 102 of the boat 100.

Figure 25:
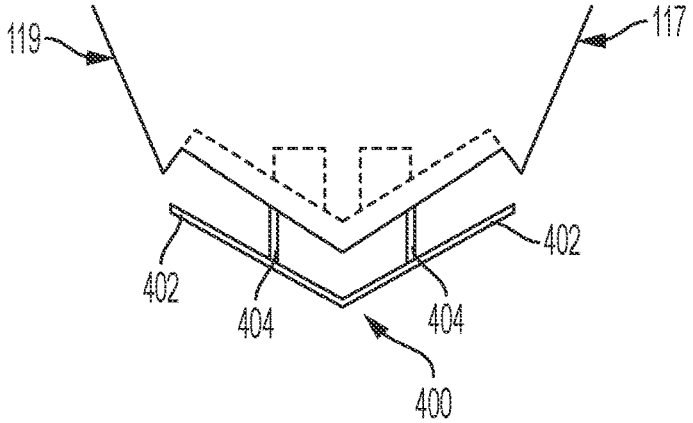
FIG. 25 is a bow view of the boat shown in FIG. 24 with the hydrofoil device in its deployed position.
Figure 26:
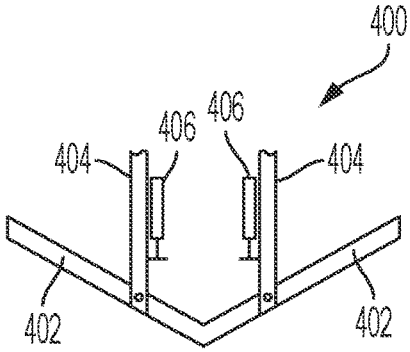
FIG. 26 is a schematic of the hydrofoil device in the non-deployed position.
Figure 27:
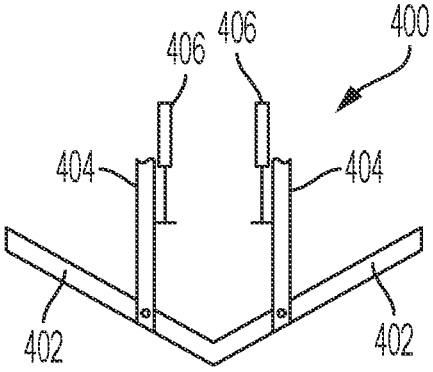
FIG. 27 is a schematic of the hydrofoil device in the deployed position.

The hydrofoil device 400 is movable between a non-deployed (or retracted) position and a deployed position. In the deployed position, the hydrofoil device 400 is lowered below the hull bottom 115. FIG. 25 is a forward view of the boat 100 with the hydrofoil device 400 in the deployed position. FIGS. 26 and 27 show the hydrofoil device 400 in greater detail. In FIG. 26 the hydrofoil device 400 is in the retracted position, and in FIG. 27 the hydrofoil device 400 is in the deployed position. The hydrofoil device 400 has a foil 402. The foil 402 has a suitable shape and orientation that is configured to pull the boat 100 downward as the boat 100 moves through the water at speeds suitable for water sports, such as wakesurfing and wakeboarding. The foil may be a flat plate, but other suitable hydrodynamic shapes to create upward or downward lift may be used, such as, for example, a tear drop shape having a rounded leading edge and a tapered trailing edge.

Figure 28:
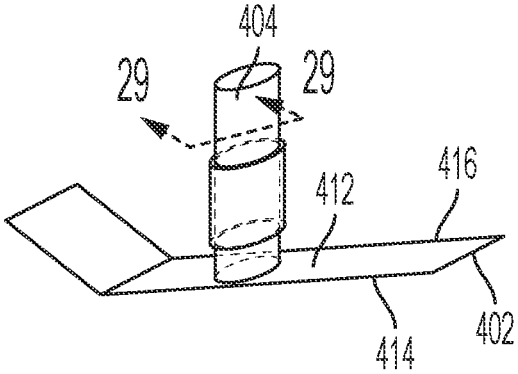
FIG. 28 is a partial view of the hydrofoil device.
Figure 29:
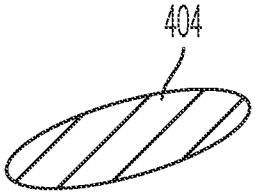
FIG. 29 is a cross-sectional view of a riser of the hydrofoil device taken along line 29-29 in FIG. 28.

The foil 402 is moved between the deployed position and the non-deployed position by any suitable means. In this embodiment, risers 404 connect the foil 402 to the hull bottom 115. FIGS. 26 and 27 show the risers being driven up and down by motors 406, but other mechanisms may be used, including, for example, a hydraulic cylinder and the other movement mechanisms discussed above. The riser 404 may be any suitable shape, but it may preferably have a foil shape, as shown in FIGS. 28 and 29. FIG. 28 is a partial view of the hydrofoil device 400 in the deployed position, and FIG. 29 is a cross-sectional view of a riser 404 taken along line 29-29 in FIG. 28. As can be seen in FIG. 29, the riser 404 may have an elliptical or teardrop shape.

Figure 30:
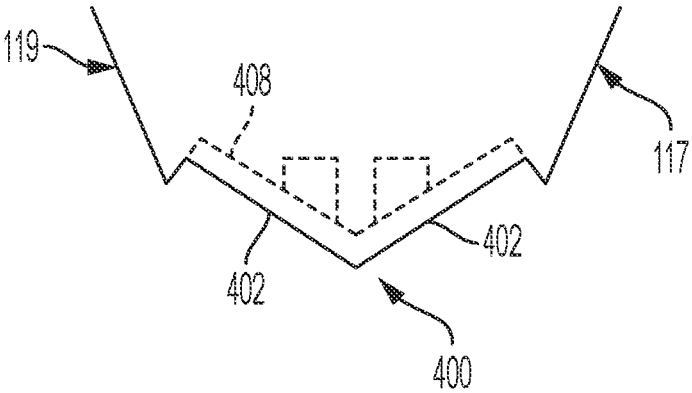
FIG. 30 is a bow view of the boat shown in FIG. 24 with the hydrofoil device in its non-deployed position.

FIG. 30 is a forward view of the boat 100 with the hydrofoil device 400 in the retracted position. The hydrofoil device 400, including the foil 402, may be retracted into a pocket or cavity 408 formed in the hull. The cavity 408 is shown by broken lines in FIG. 30. In such a configuration, the bottom of the foil 402 is flush with the hull bottom 115 in the retracted position, providing a smooth running surface. Alternatively, the foil 402 may be positioned against the hull bottom 115.

As can be seen in FIG. 25, the foil 402 preferably extends over the majority of the width of the hull bottom 115 nearly from chine to chine, but other suitable widths may be used. For example, the foil may be at least as wide as the diameter of the propeller 12 (such as from 12-16 inches). More preferably, the foil has a width that is at least two-thirds the width of the hull bottom 115. With such a large surface the foil 402 is able to generate large and stable downward forces on the boat 100. Preferably, the foil 402 is large enough to create displacement that approximates at least an additional 1,500 lbs. of ballast. The foil 402 shown in FIGS. 39-44, discussed further below, was able to generate around 4,500 lbs. of a combination of downward force and drag upon the foil 402. This measurement was at the maximum deflection and maximum pitch angle of the hydrofoil device 400. When used for surfing, the hydrofoil device 400 may be suitably configured to produce about 3,800 lbs. When implemented on boats with V-shaped hulls, the foil 402 is preferably V-shaped to match the hull shape, as can be seen in FIGS. 25-30. In some embodiments, each of a port-side portion of the foil 402 and a starboard-side portion of the foil 402 are angled upward from horizontal at an angle that matches the deadrise of the boat, such as, an upward angle that is 30 degrees or less, for example.

The foil 402 shown in FIGS. 25-30 may be a flat plate from front to back with a planar top surface 412, as shown in FIG. 28. The foil 402 has a leading edge 414 and a trailing edge 416 with the foil 402 angled upward from the leading edge 414 to the trailing edge 416. This upward angle creates a downward force on the top surface 412 as the boat 100 moves forward through the water.

Figure 31:
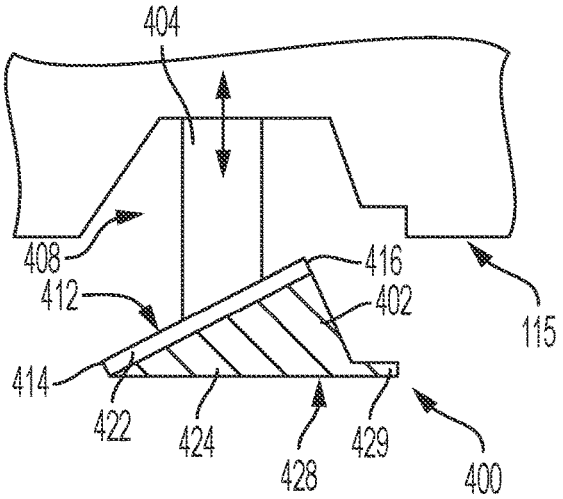
FIG. 31 is a cross-sectional view of an alternative foil of the hydrofoil device. The hydrofoil device is shown in its deployed position in FIG. 31.
Figure 32:
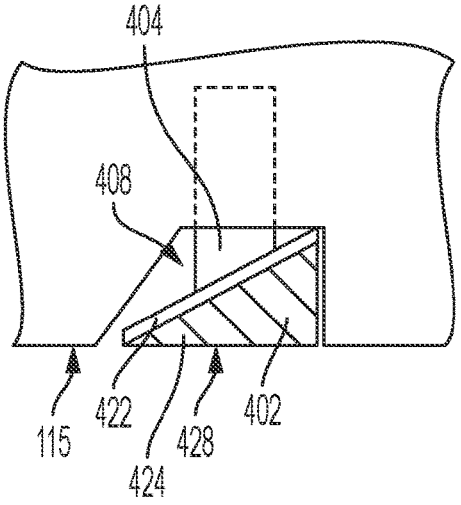
FIG. 32 is a cross-sectional view of a variation of the foil of the hydrofoil device shown in FIG. 31 in its non-deployed position.
Figure 33:
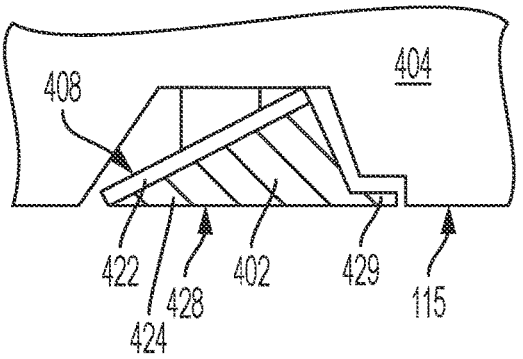
FIG. 33 is a cross-sectional view of the hydrofoil device of FIG. 31 in its non-deployed position.

As noted above, other suitable shapes may be used. One such shape is the wedge shape shown in FIGS. 31-33, for example. FIGS. 31-33 are detail views of the foil 402 having a wedge shape. FIG. 31 shows the foil 402 in the deployed position, and FIGS. 32 and 33 show the foil 402 in the retracted position. The foil 402 shown has a top plate 422 inclined at a fixed angle. Preferably, the angle of the top plate 422 is such that it creates a downward force even when the bow 111 of the boat 100 is pitched upward. The top plate 422 preferably is inclined at an angle that is less than an angle that would create stall for the hydrofoil device 400. In some embodiments, the top plate 422 may be inclined at an angle from 12-30 degrees.

The top plate 422 includes the top surface 412, the leading edge 414, and the trailing edge 416, as discussed above. Water impinges on this plate 422 and forces the plate 422 down, which in turn forces the boat 100 down. The plate, however, may also be adjustable so that the foil 402 creates different levels of drag and downward force. To adjust the angle of the plate, the plate of the foil 402 itself could be raised and lowered or the foil 402 pivoted, for example. The hydrofoil device 400 described herein could also be adjustable such that it produces an upward force on the boat 100. The foil 402 of this embodiment includes a fill material 424. The fill material 424 is used to form a flat (horizontal surface) when the foil 402 is in the retracted position, as can be seen in FIGS. 32 and 33, to provide the smooth running surface, as discussed above. The fill material 424 may thus be triangular with the top plate 422 forming an acute angle with a bottom surface 428 of the fill material 424. The fill material 424 may be formed from any suitable material used in the marine environment such as metal or fiberglass (FRP).

In the embodiment shown in FIG. 31, the hydrofoil device 400 includes a protrusion 429 that extends aft from the fill material 424 and spans the width of the bottom surface 428. This protrusion 429 may help integrate the hydrofoil device 400 into the hull in the non-deployed position by contacting a seating surface formed on the hull bottom 115. In addition, the protrusion 429 extends the bottom surface 428, lengthening the distance from the trailing edge 416 of the top plate 422 where water flowing over the top plate 422 and the bottom surface 428 meet, thereby leading to less turbulence and less drag.

Figure 34:
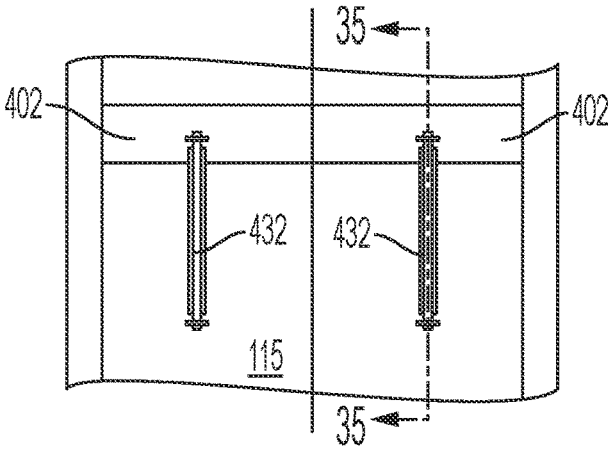
FIG. 34 is a view of the hull bottom of a boat equipped with a variation of the hydrofoil device.
Figure 35:
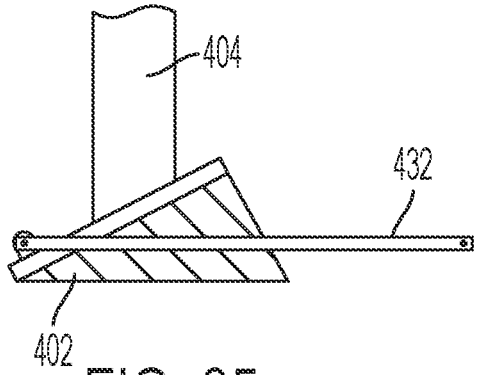
FIG. 35 is a cross-sectional view of the hydrofoil device shown in FIG. 34 taken along line 35-35 in FIG. 34. The hydrofoil device shown in FIG. 35 is in the non-deployed position. The hull of the boat is omitted for clarity.
Figure 36:
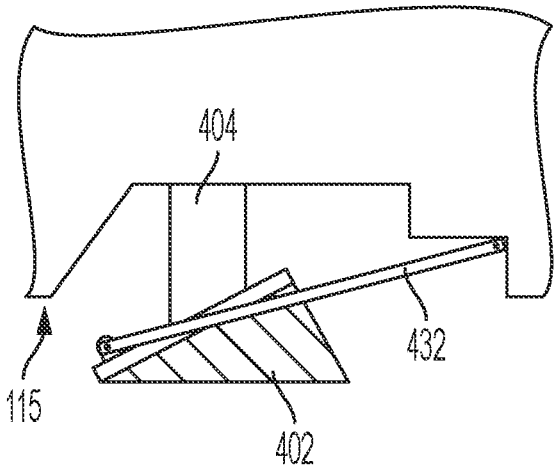
FIG. 36 is a cross-sectional view of the hydrofoil device shown in FIG. 34 taken along line 35-35 in FIG. 34. The hydrofoil device shown in FIG. 36 is in the deployed position.
Figure 37:
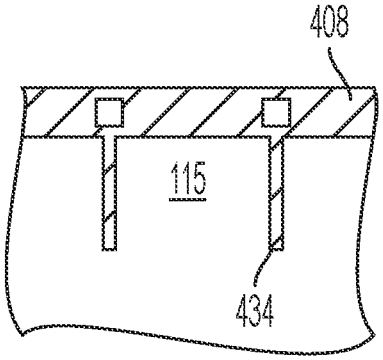
FIG. 37 is the bottom side of the hull shown in FIG. 34 with the hydrofoil device removed for clarity.
Figure 38:
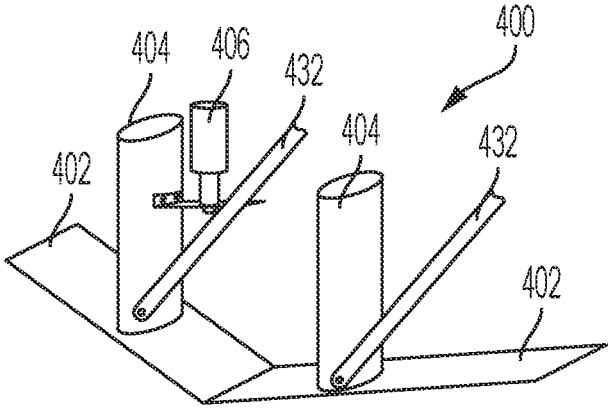
FIG. 38 shows the hydrofoil device shown in FIG. 28 with a support bar.

For further support of the hydrofoil device 400, the hydrofoil device 400 may also include a support bar 432 that acts like a truss to support the forces on the foil 402. Such a support bar is shown in FIGS. 34-36. FIG. 34 is a bottom view showing the hull bottom 115 with the hydrofoil device 400 having the support bar 432. FIGS. 35 and 36 show the hydrofoil device 400 with the support bar 432. FIGS. 35 and 36 are cross-sectional views of the hydrofoil device 400 taken along line 35-35 in FIG. 34. The hydrofoil device 400 is in the retracted position in FIG. 35 and the hydrofoil device 400 is in the deployed position in FIG. 36. The support bar 432 is pivotably attached to each of the foil 402 and the hull bottom 115. The support bar 432 extends aft of the foil 402 to brace the foil 402 against the hull bottom 115. FIG. 37 shows the hull bottom 115 with the hydrofoil device 400 removed for clarity. When the support bar 432 is used and the hydrofoil device 400 is recessed into the hull bottom 115, a trench 434 may be formed in the hull bottom 115 to accommodate the support bar 432 when the hydrofoil device 400 is in the non-deployed position such that a smooth running surface is provided. The cavity 408 for the foil 402 is also shown in FIG. 37. FIG. 38 shows the configuration of the hydrofoil device 400 previously described with reference to FIGS. 25-30 having a support bar 432. In this configuration, the support bar 432 is attached to the riser 404 at the end of the riser 404 where the riser 404 connects to the foil 402.

Figure 41:
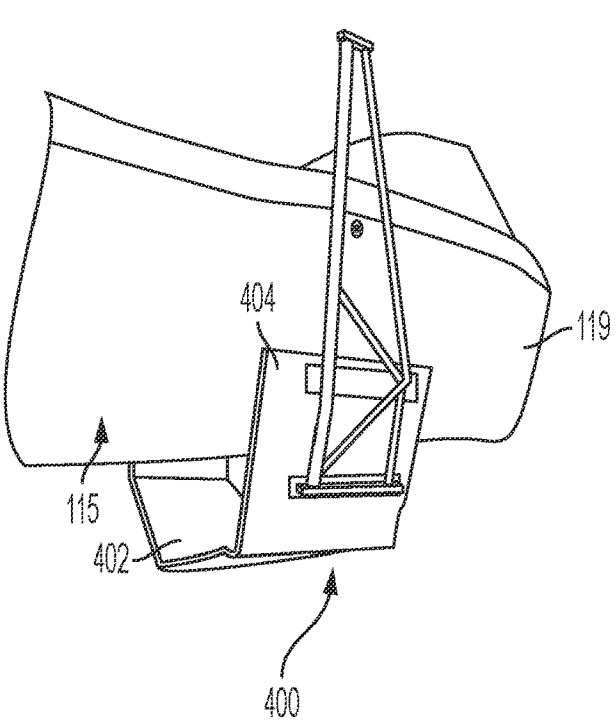
FIG. 41 is a perspective view of the boat shown in FIG. 39 with the hydrofoil device in a deployed position.
Figure 40:
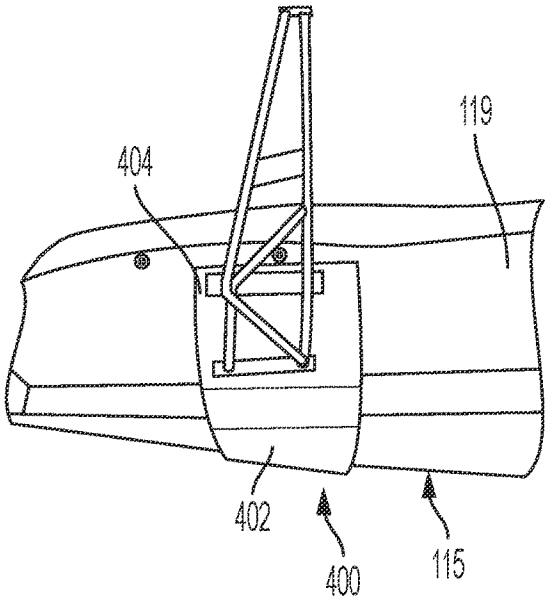
FIG. 40 is a perspective view of the boat shown in FIG. 39, showing the hull bottom of the boat. The hydrofoil device is in its non-deployed position in FIG. 40.
Figure 39:
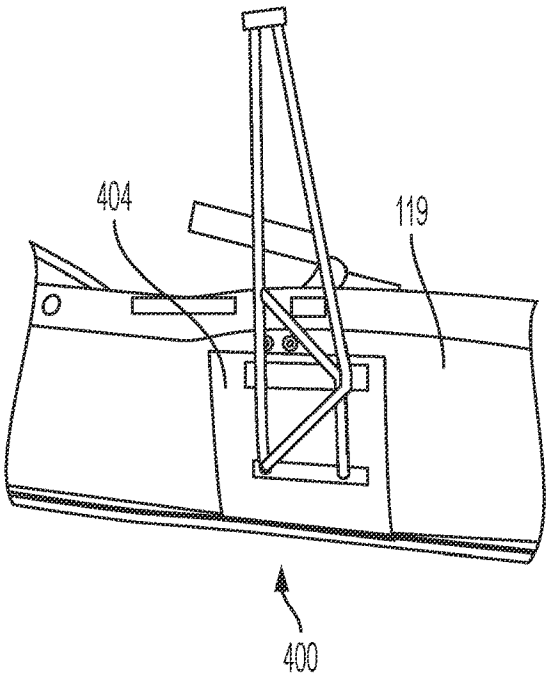
FIG. 39 is a port side view of a boat equipped with another variation of the hydrofoil device of the fourth embodiment. The hydrofoil device is in its non-deployed position in FIG. 39.
Figure 42:
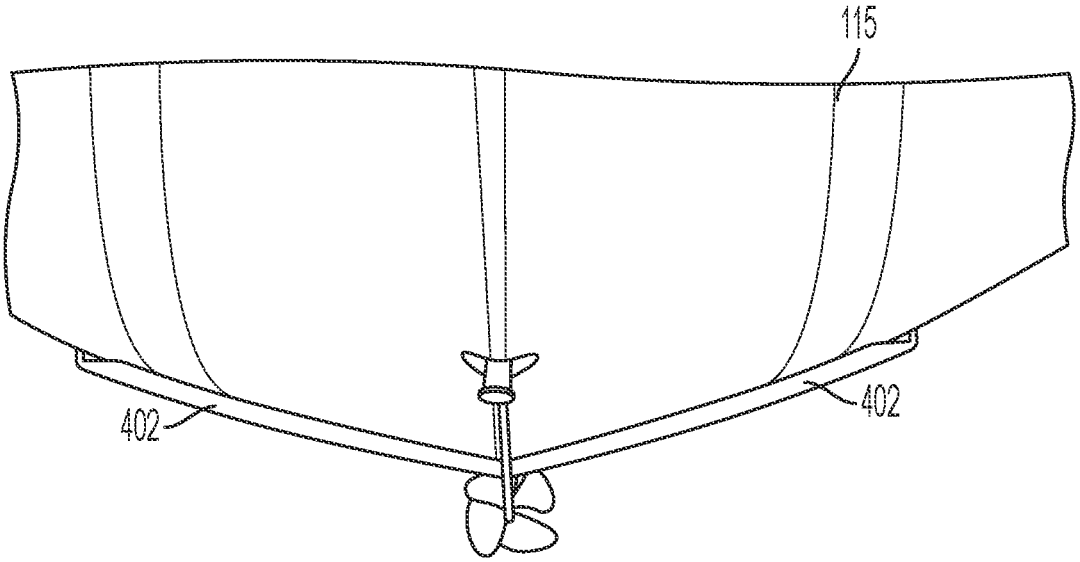
FIG. 42 is a bow view of the hull bottom of the boat shown in FIG. 39 with the hydrofoil device in the non-deployed position.
Figure 43:
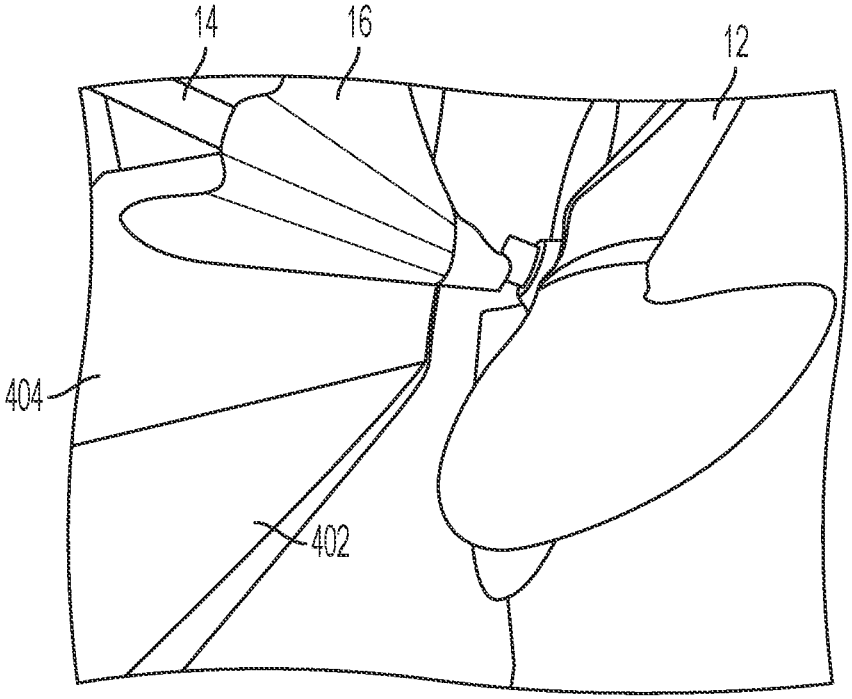
FIG. 43 shows the propeller of the boat shown in FIG. 39 with the hydrofoil device in the deployed position.

FIGS. 39-43 show another configuration of the hydrofoil device 400. FIGS. 39 and 40 are port side views of the boat 100 with the hydrofoil device 400 in its non-deployed position. The hull bottom 115 can be seen in FIG. 40. FIG. 41 is a perspective view of the boat 100 with the hydrofoil device 400 in a deployed position. FIG. 42 is a bow view of the transom 113 of the boat 100 with the hydrofoil device in the non-deployed position, and FIG. 43 shows the propeller 12 of the boat 100 with the hydrofoil device 400 in the deployed position.

In this configuration the foil 402 extends the entire width of the hull bottom 115 and has a length preferably between 6 inches and 4 feet. The foil 402 of this hydrofoil device 400 extends forward of the position where the drive shaft 14 penetrates the hull bottom 115. When retracted, the foil 402 may be positioned against the hull bottom 115, as shown in FIGS. 39, 40, and 42. When deployed, the foil 402 extends downward from the hull bottom 115. In this embodiment, the risers 404 are not located in the hull bottom 115 but rather are positioned along the sides (port side 117 and starboard side 119) of the hull 110. Although shown as outside the hull 110 in the non-deployed position, the foil 402 and risers 404 may be located in a cavity 408, in the manner discussed above, such that the bottom surface of the foil 402 is flush with the hull bottom 115 and the outboard surfaces of the risers are flush with the sides (port side 117 and starboard side 119) of the hull 110. As with the configurations of the hydrofoil device 400 discussed above, the pitch or angle of the foil 402 can be rotated to adjust the downward force (and drag) produced by the foil 402. A steeper angle of inclination results in additional downward force. The hydrofoil device 400 may be configured to have a plurality of angles of inclination to produce different levels of downward force. As noted above with respect to the angle of the top plate 422, the angle of the top plate 422 is such that it creates a downward force even when the bow 111 of the boat 100 is pitched upward, and preferably is inclined at an angle that is less than an angle that would create stall for the hydrofoil device 400. In some embodiments, the top plate 422 of the foil 402 may be inclined at an angle from 12-30 degrees.

Fifth Embodiment

Figure 44:
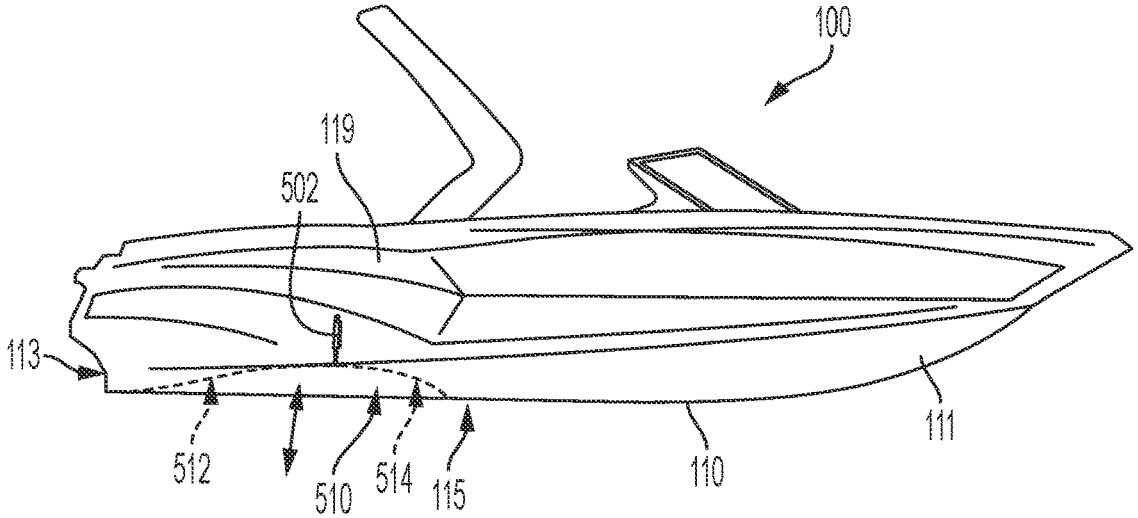
FIG. 44 is a starboard side view of a boat having a surf feature formed in the hull bottom of the boat according to a fifth preferred embodiment of the invention.
Figure 45:
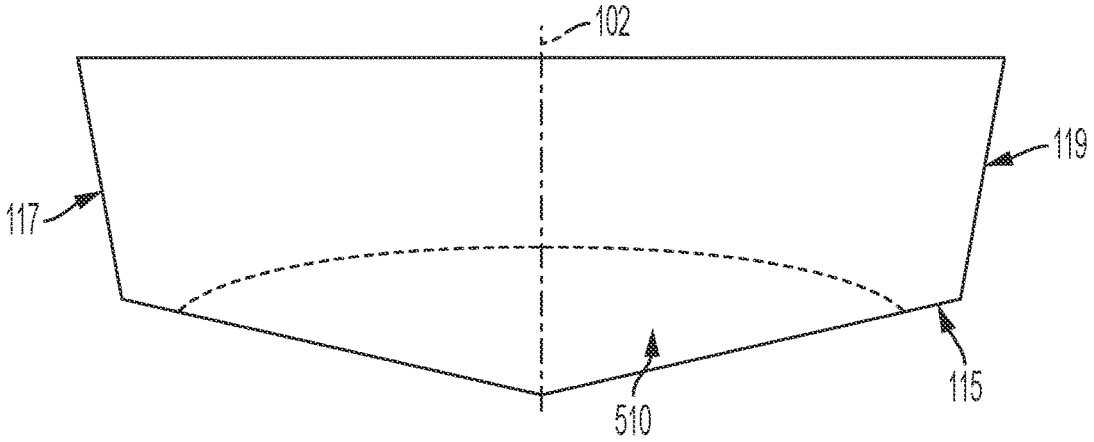
FIG. 45 is an aft view of the boat shown in FIG. 44 showing one pocket formed in the hull bottom.

In the previous embodiment, the hydrofoil devices 400 are used to increase the displacement of the boat 100. Instead of using the hydrofoil devices 400, the hull bottom 115 could be shaped to decrease the effective dynamic lift of the hull bottom 115 and increase the effective dynamic displacement of the hull bottom 115. FIG. 44 is a starboard side view of a boat having a surf feature 510 formed in the hull bottom of a boat, such as the boat 100, according to a fifth preferred embodiment of the invention. The surf feature 510 of this embodiment is shown with a broken line and is a curved section of the hull bottom 115 located in the stern of the boat. This surf feature 510 may be referred to herein as a pocket 510. FIG. 45 is a view of the stern of the boat 100 showing the pocket 510 with a broken line.

The pocket 510 is within the hull bottom 115 and may be used to slow the speed of the water flowing along the hull bottom 115. The slower water flow results in a lower overall pressure distribution, which in turn results in a lack of lift. The overall amount of hydrodynamic lift may decrease, resulting in an overall balance as if more weight had been added to the boat. Further, the pocket 510 may be shaped to change the waterflow angle at the transom 113, instead of the water flowing along the conventional keel (or hull bottom 115). The change in waterflow angle also creates a resultant force or other effects on the wake 90 of the boat. The pocket 510 thus includes a trailing surface 512, which is preferably located in the aft half of the hull bottom 115. The pocket 510 may also include a leading surface 514. In the embodiment shown, the pocket 510 has curvature both longitudinally (parallel to the centerline 102) and transversely (transverse to the centerline 102), like a dome, and may be dome shaped. In this embodiment, the pocket 510 is a concave portion of the hull bottom 115.

Preferably, the pocket 510 is adjustable to move between the position shown by the broken line and the position shown by the solid line to enable the negative lift to be turned on and off, respectively. By varying the size and location of the pocket 510, the resultant lift on the hull will increase or decrease. The angle that the pocket 510 creates affects the amount of lift and affects the wake 90 at the transom 113 and can therefore be varied from 0 degrees to a steeper angle to create more lift in either direction. To change the angle of the pocket 510, either the trailing surface 512 or the leading surface 514 may be varied, for example. A portion of the hull bottom 115 may be movable (a movable portion of the hull bottom 115) to form the pocket 510 by a movement mechanism 502. The movable portion of the hull bottom is movable between a position creating the dome shape and a position Any suitable movement mechanism 502 may be used, including, but not limited to, electric linear actuators, hydraulic linear actuators, gas assist pneumatic actuators, and electrical motors, as discussed above. In another variation, the pocket 510 may be formed by creating an opening in the hull bottom 115. A flexible membrane may be stretched over the opening of the pocket. Suction can be applied (using a pump located within the boat 100, for example) to create the concave shape or pressure can be applied to create a convex shape. A convex shape of the surf feature 510 may be used to increase the dynamic lift.

Figure 46:
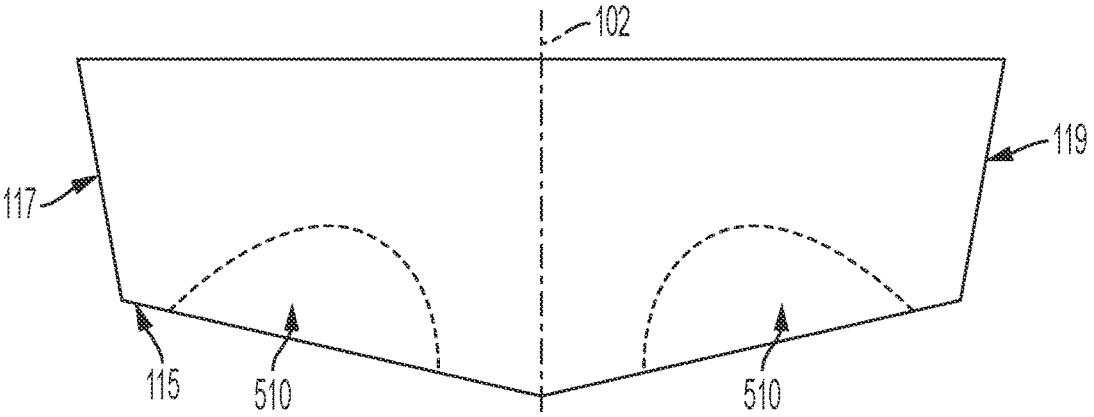
FIG. 46 is an aft view of the boat shown in FIG. 44 showing two pockets formed in the hull bottom.

A single pocket 510 can be used (see FIG. 45) or, as illustrated in FIG. 46, two or more independent pockets 510 can be used in tandem in varying states. FIG. 46 is a view of the stern of the boat 100 showing two pockets 510 with a broken line. One pocket is located on the starboard side of the centerline 102 and the other is located on the port side of the centerline 102. Both pockets 510, a port pocket and a starboard pocket, may be used such that they both decrease dynamic lift or both increase dynamic lift. The pockets 510 may also, however, be configured to create roll or asymmetrical flow. By varying the pocket on one or both sides of the hull about the centerline of the boat 100, a wave can be formed by the shift in lifting forces.

Sixth Embodiment

Figure 47:
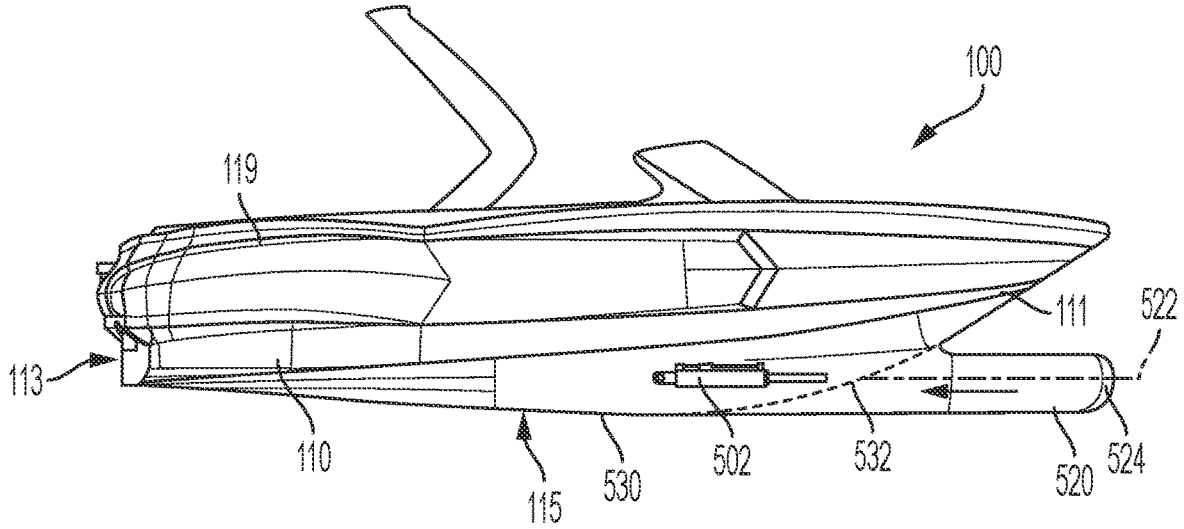
FIG. 47 is a starboard side view of a boat having a surf feature formed in the hull bottom of the boat according to a sixth preferred embodiment of the invention.
Figure 48:
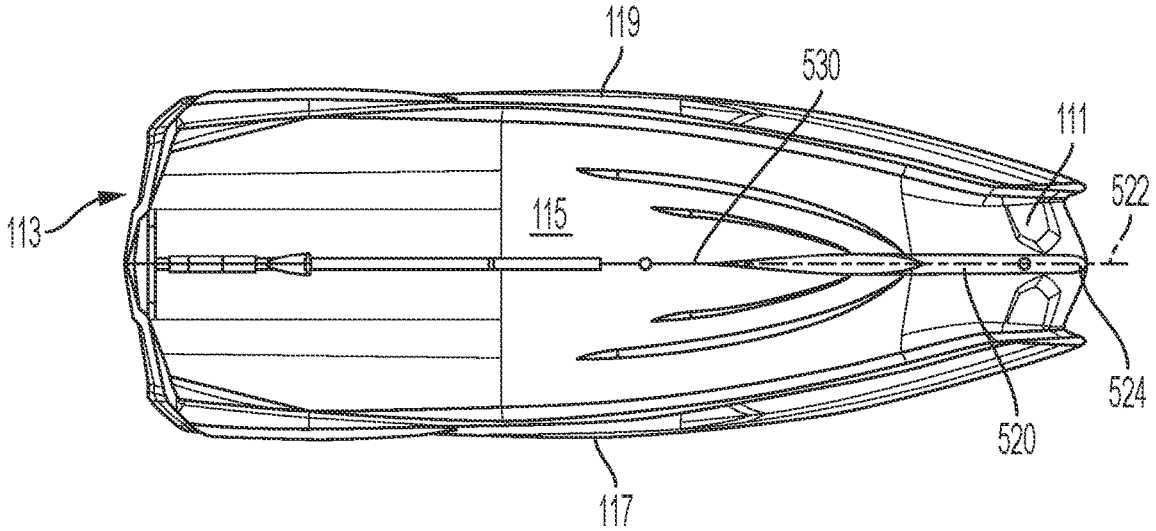
FIG. 48 is a bottom view of the boat shown in FIG. 47.
Figure 49:
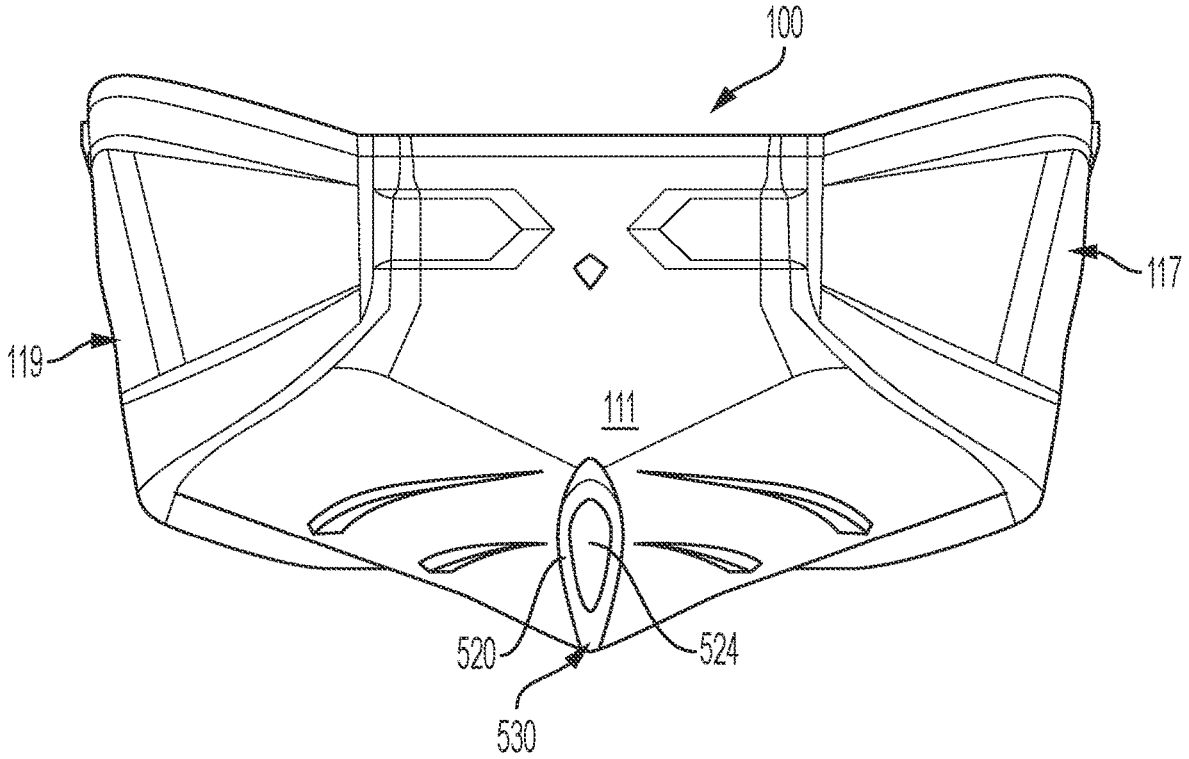
FIG. 49 is a forward view of the boat shown in FIG. 47.

Another modification to the hull bottom 115 that could be used to create surf wakes is shown in FIGS. 47-49. The hull 110 in this embodiment (the sixth embodiment of the invention) is a planing hull, as discussed above. The hull 110 includes a bulbous bow, having a bulb 520 located in the forward (bow 111) portion of the hull bottom 115. FIG. 47 is a starboard side view of a boat having bulb 520 formed in the hull bottom of the boat 100. FIG. 48 is a bottom view of the boat 100 with the bulb 520 formed in the hull bottom 115 of the boat 100, and FIG. 49 is a forward view of the boat 100.

The hull bottom 115 includes a keel 530. The keel 530 of this embodiment has a rocker and a forward portion 532 of the keel 530 curves upward. The bulb 520 protrudes forward of the forward portion 532 of the keel 530. The bulb 520 of this embodiment is cylindrical having a tear-drop-shaped cross section as can be seen in FIG. 49. The tear-drop shape of this embodiment includes a rounded upper surface and a tapered lower surface. Other suitable cross sections include elliptical shapes and circular shapes. Where an elliptical shape is used the major axis may be oriented in a vertical (up and down) direction with the minor axis oriented in an inboard and outboard direction transverse to the centerline 102 of the boat 100. The bulb 520 has a longitudinal axis 522, which, in this embodiment, is parallel to the centerline 102. The cross section is taken orthogonal to the longitudinal axis 522. The bulb 520 also includes a leading surface 524. As can be seen in FIG. 47, the leading surface 524 is rounded in an up-and-down direction in this embodiment, but the leading surface 524 may have other suitable shapes.

Here, the bulb 520 pushes water out at the front of the boat 100 to create a secondary wave. When the secondary wave is in phase with the primary wave (creating wake 90 behind the boat) a constructive interference pattern occurs, further enhancing the wake 90 for surfing, with the resultant wave being the added amplitude of both waves. Such constructive interference may be a function of the speed of the boat 100 and thus the bulb 520 may be preferably configured to create the constructive interference at speeds suitable for surfing. Conversely, the secondary wave and primary wave could be aligned out of phase where the resulting wave would subtract the amplitude of the two waves, resulting in a decrease in the wave size, which would be desirable for water skiing where flat water is preferred.

The bulb 520 may be adjustable and may even be retracted into the hull 110. The bulb 520 may be movable in the longitudinal axis 522, which in this embodiment is a forward-and-aft direction as indicated by the arrow in FIG. 47, by a movement mechanism 502, such as those discussed herein. The bulb 520 may be retracted into the entire boat 100 (non-deployed position) such that the hull 110 has the shape indicated by the forward portion 532 of the keel 530. The bulb 520 may be positioned in one of a plurality of deployed positions based on the speed of the boat 100. The deployed positions are forward of the non-deployed positions. The constructive interference may be turned on and off by positioning the bulb 520 in the deployed and non-deployed positions, respectively.

Seventh Embodiment

Figure 50:
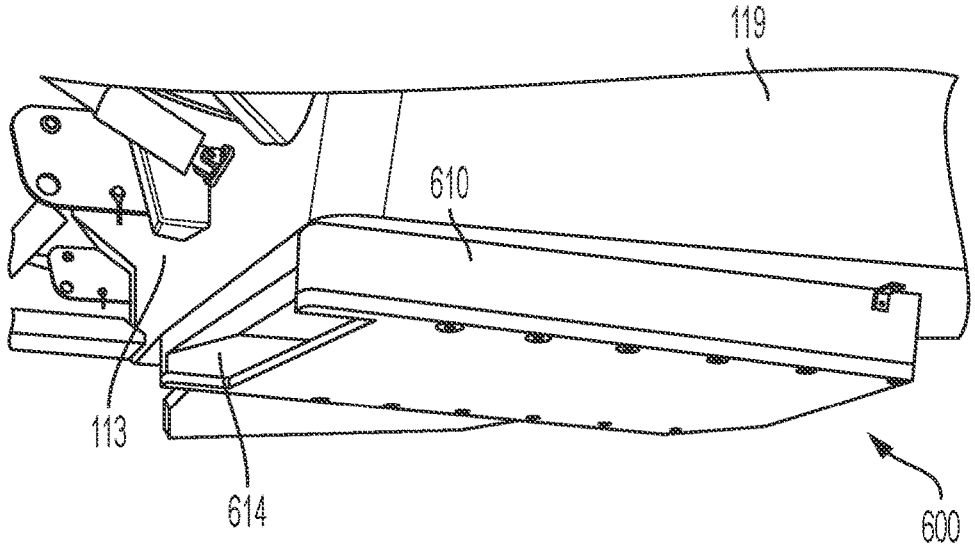
FIG. 50 is a perspective view of the starboard-side, aft corner of a boat having a surf device according to a seventh preferred embodiment of the invention.
Figure 51:
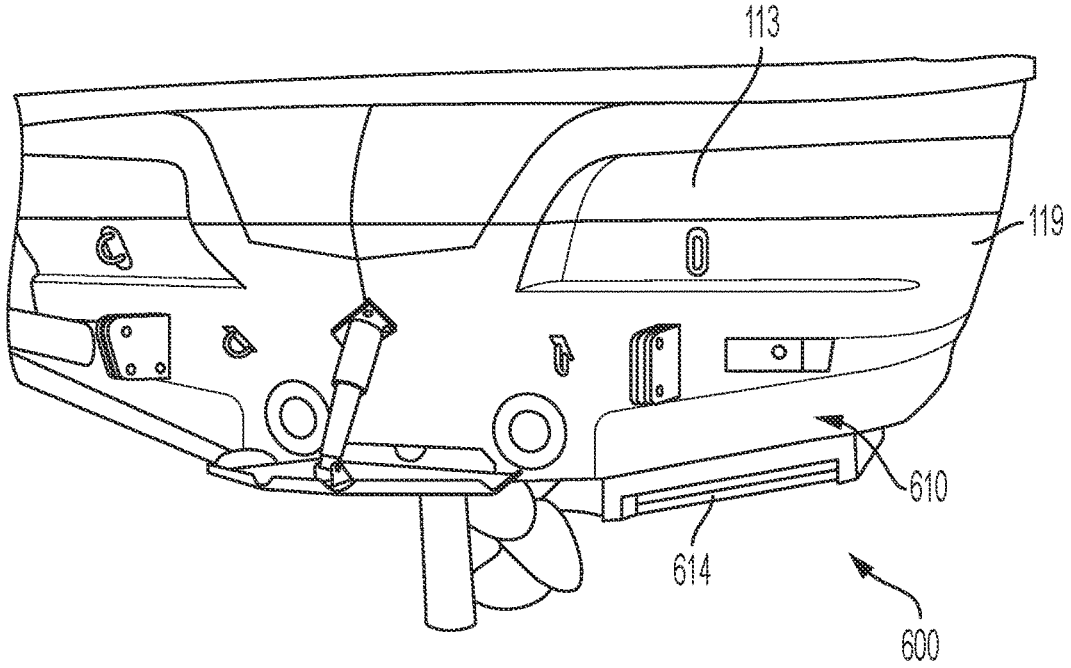
FIG. 51 is an aft view of the port-side, aft corner of the boat shown in FIG. 50.
Figure 52:
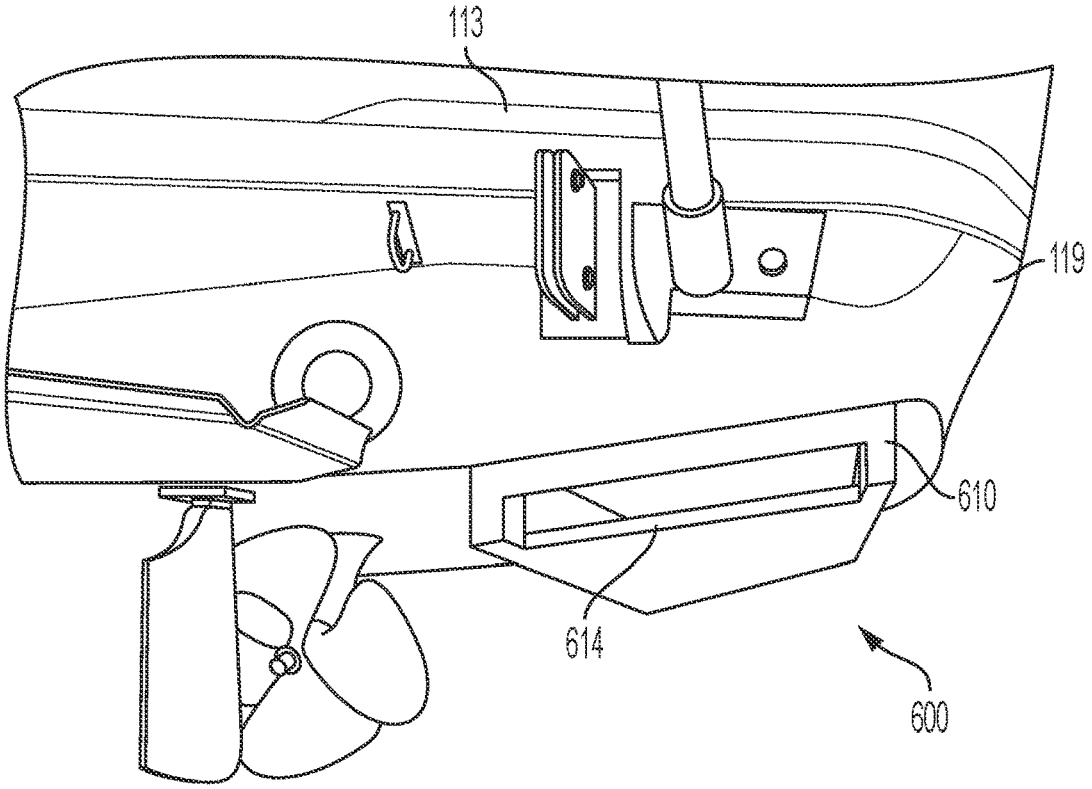
FIG. 52 is an aft view of the port-side, aft corner of the boat shown in FIG. 50 showing the outlet of the surf device.
Figure 53:
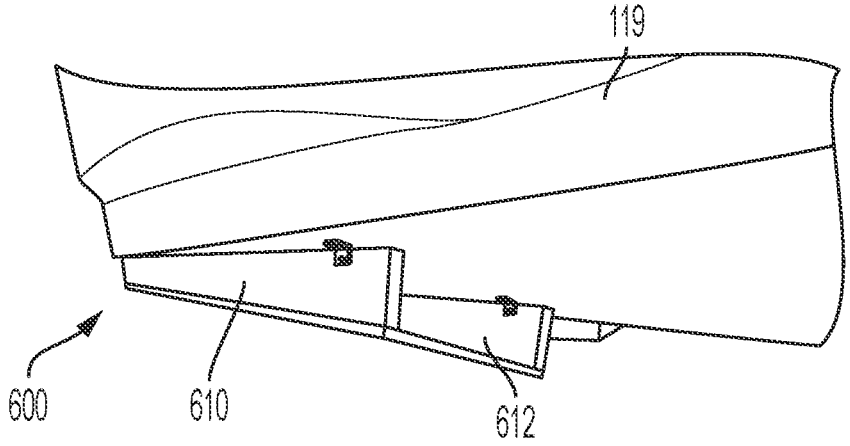
FIG. 53 is a perspective view of the starboard-side, aft corner of the boat shown in FIG. 50 showing the inlet of the surf device.

A surf device 600 according to a seventh preferred embodiment of the invention is shown in FIGS. 50-57. The surf device 600 of this embodiment includes one or more channels 610, 620. To distinguish it from the other surf devices discussed herein, the surf device 600 of this embodiment is referred to herein as a channel surf device 600. FIG. 50 is a perspective view of the starboard-side, aft corner of a boat, such as the boat 100, having the channel surf device 600 of the seventh embodiment. The channel surf device 600 shown in FIG. 50 includes one channel, an underside channel 610, having an inlet 612 and an outlet 614. FIGS. 51 and 52 are aft views of the port-side, aft corner of the boat 100, showing the outlet 614 of the underside channel 610, and FIG. 53 is a perspective view of the starboard-side, aft corner of the boat 100, looking in an aft direction to show the inlet 612 of the underside channel 610. The boat 100 includes a plurality of channel surf devices 600, one on each of the port side and the starboard side of the boat 100. The port-side channel surf device 600 is a mirror image of the starboard-side channel surf device 600, and thus a description and depiction of the channel surf device 600 on the port side of the boat 100 are omitted here.

As the boat 100 is moved through the water at speeds suitable for water sports, such as wakesurfing, water enters the inlet 612 of the underside channel 610. Water then flows through the underside channel 610 and out the outlet 614. The water flowing through the underside channel 610 is then directed by the outlet 614 and used to improve the wake 90 for water sports, such as wakesurfing. In this embodiment, the inlet 612 has a larger surface area than the outlet 614. The underside channel 610 is thus used to speed up and increase the pressure of the water flowing through the underside channel 610. In this embodiment, the flow area of the underside channel 610 is progressively and continuously reduced along the entire length of the channel, but other configurations may be used.

The inlet 612 should be positioned in the water when the boat is configured and operated for water sports such as wakesurfing. Preferably, the inlet 612 is be located aft of the flow separation point for planing, and more preferably may be located aft of the LCG. The underside channel 610 may be located in the aft third of the boat 100.

The underside channel 610 shown in this embodiment has a rectangular cross section. The underside channel 610 is elongated in an inboard and outboard direction, and in this embodiment is parallel to the deadrise of the hull bottom 115. Other suitable shapes may be used, such as channels having a circular cross section. The outlet 614 may have a nozzle to direct the water. In this embodiment, the outlet discharges the accelerated water in an aft direction and preferably into at least one of the port-side wave 92 and the starboard-side wave 94. The nozzle may be variable for different surfing or water sport configurations. Suitable nozzle configurations may be similar to those discussed below in the eighth embodiment and a detailed description of these nozzles and other devices used to direct the flow of water from the outlet 614 is omitted here. Also like in the eighth embodiment discussed below, the outlet 614, may be located on the hull bottom 115 instead of the transom 113 to direct the accelerated water at least downward if not both downward and aft.

Figure 54:
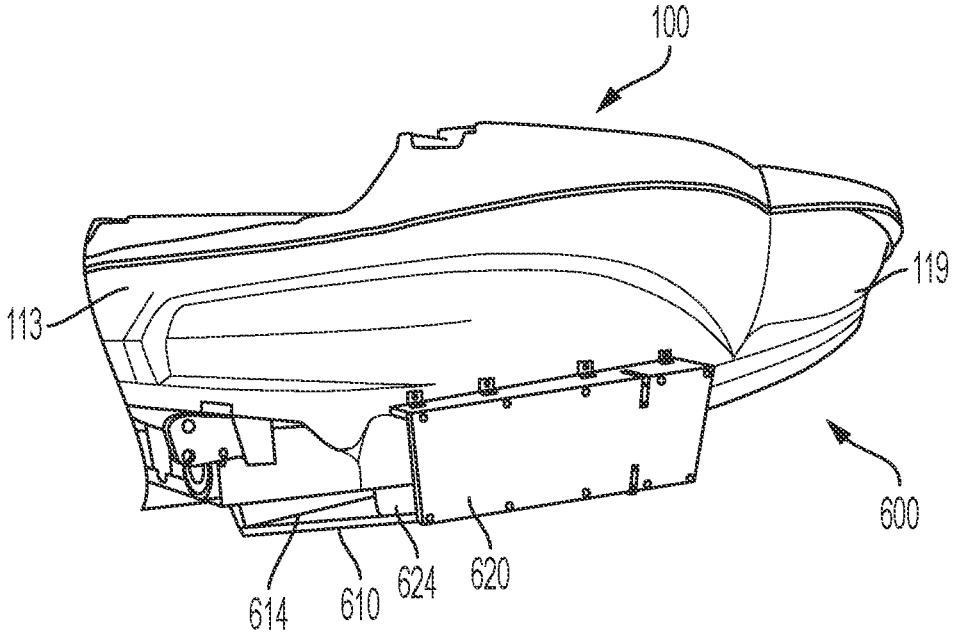
FIG. 54 is a perspective view of the starboard-side, aft corner of a boat having a surf device according to a variation of the seventh preferred embodiment of the invention.
Figure 55:
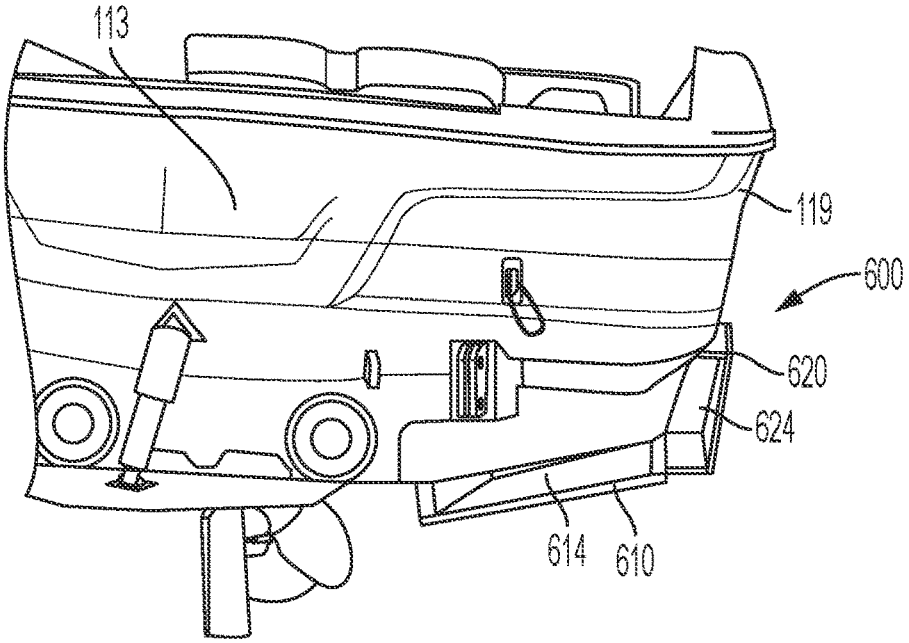
FIG. 55 is an aft view of the starboard-side, aft corner of the boat shown in FIG. 54.
Figure 56:
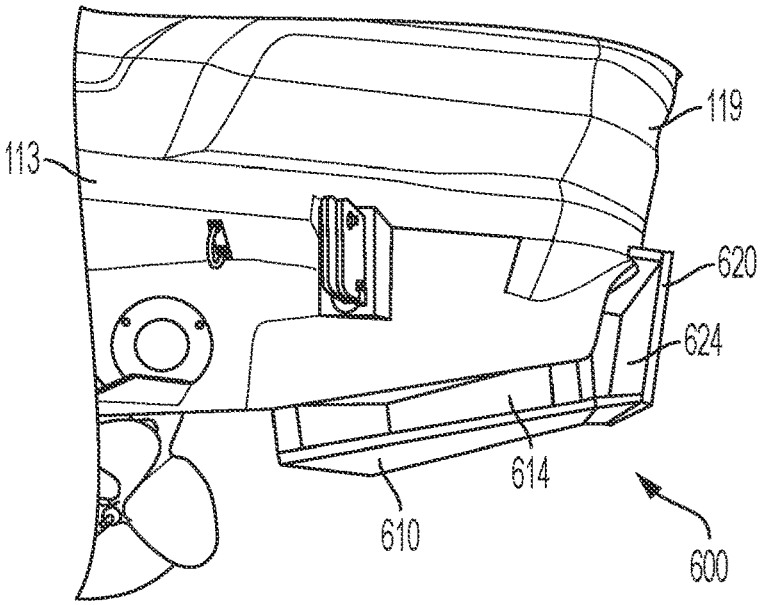
FIG. 56 is an aft view of the starboard-side, aft corner of the boat shown in FIG. 54 showing the outlet of the surf device.
Figure 57:
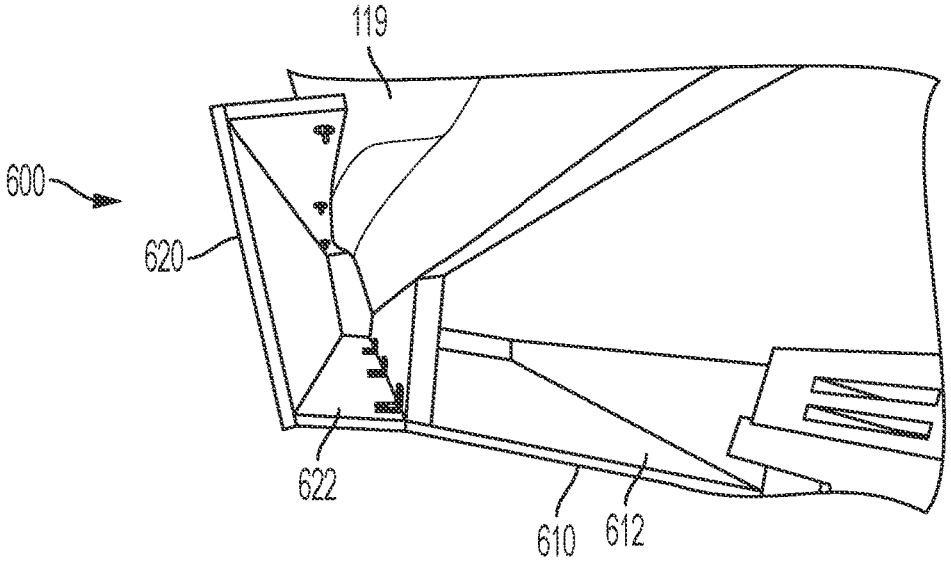
FIG. 57 is a perspective view of the starboard-side, aft corner of the boat shown in FIG. 54 showing the inlet of the surf device.

The channel surf device 600 may include a plurality of channels. The surf device 600 shown in FIGS. 54-57 includes a second, hullside channel 620. Although shown in combination with the underside channel 610, the hullside channel 620 may also be used alone. Like the underside channel 610, the hullside channel 620 includes an inlet 622 and an outlet 624. FIG. 54 is a perspective view of the starboard-side, aft corner of the boat 100 having the channel surf device 600 with two channels 610, 620. FIGS. 55 and 56 are aft views of the port-side, aft corner of the boat 100, showing the outlet 624 of the hullside channel 620, and FIG. 57 is a perspective view of the starboard-side, aft corner of the boat 100, looking in an aft direction to show the inlet 622 of the hullside channel 620.

The hullside channel 620 is configured like the underside channel 610 and has differing areas to speed up the water flowing through the hullside channel 620. In this embodiment, the hullside channel 620 is oriented along the starboard side 119 of the hull 110 to have a more vertical orientation. In this embodiment, the hullside channel 620 also has a rectangular cross section and is elongated in a direction that is parallel with the inclination of the starboard side 119 of the hull 110. The outlet 624 of the hullside channel 620 is shown directing the accelerated water discharged from the outlet 624 in an aft direction, but as with the underside channel 610, the accelerated water discharged from the outlet 624 may be directed in an outboard direction (e.g., a starboard direction or a port direction) in addition to or instead of being directed aft.

Although the underside channel 610 and the hullside channel 620 are shown attached to the outside of the hull 110, they may also be incorporated (imbedded) inside of the hull 110. The underside channel 610 and hullside channel 620 may also include features to turn off or otherwise open and close the underside channel 610 and hullside channel 620. Such features may include a gate located in the respective inlet 612, 622 or a valve.

The channel surf device 600 is preferably located outboard of the propulsion device 10, as can be seen, for example, in FIG. 55. Preferably, the outlet 614, 624 of each channel 610, 620 is located on the outer third of boat 100 at the transom 113, outboard on either side of the propulsion device 10, and more preferably on the outer quarter of the boat 100. In the embodiments shown herein, the underside channel 610 has an outer end proximate the side (port side 117 and starboard side 119) of the hull 110 and extends inboard from the side (port side 117 and starboard side 119) of the hull 110.

Eighth Embodiment

Figure 58:
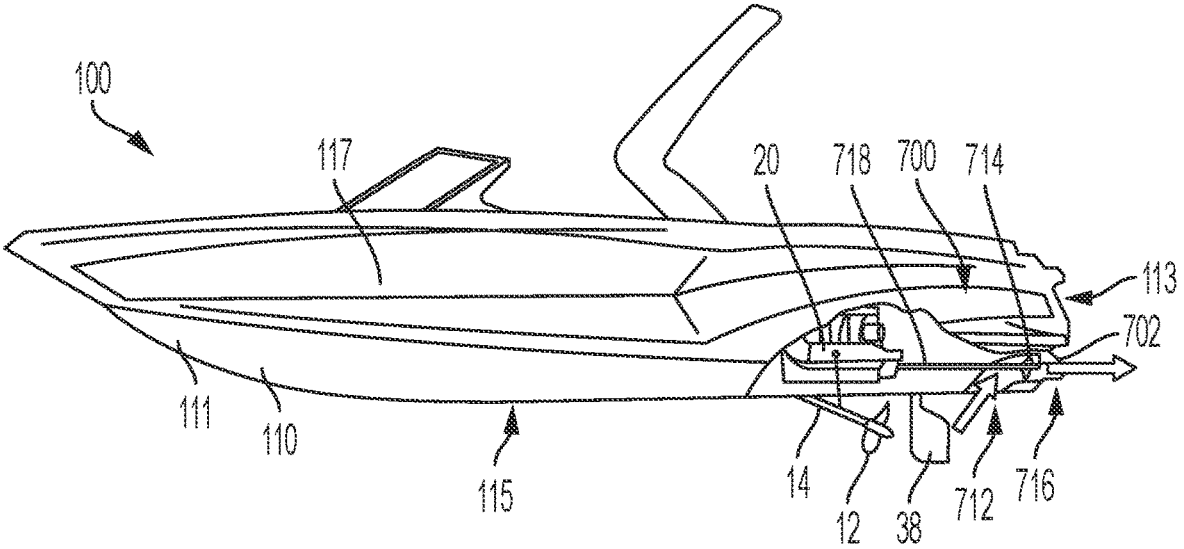
FIG. 58 is a port side view of a boat having a surf device according to an eighth preferred embodiment of the invention.
Figure 59:
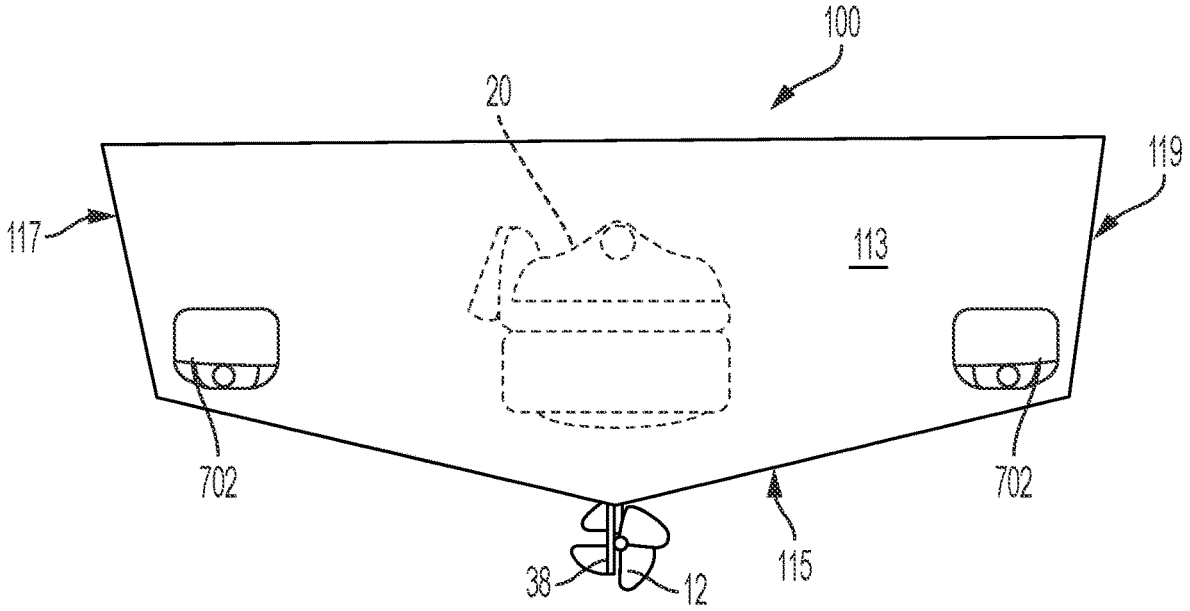
FIG. 59 is an aft view showing the transom of the boat shown in FIG. 58.

In the seventh embodiment, the speed of the water was increased, and the direction of the water changed to improve the wake 90 for wakesurfing by, among other things, progressively decreasing the cross-sectional area of the underside channel 610 and the hullside channel 620 through which the water flows. The speed of the water could also be increased by mechanical means, such as for example an impeller and stator vanes of a jet pump similar to those used with personal watercraft. The surf device 700 of the eighth embodiment uses two jet pumps, one on the port side of a boat, such as the boat 100, and one on the starboard side of the boat 100 to accelerate water and produce a surfable wake. To distinguish it from the other surf devices discussed herein, the surf device 700 of this embodiment is referred to herein as a jet surf device 700. FIG. 58 is a port side view of the boat 100 having the jet surf device 700 of the eighth embodiment, and FIG. 59 is an aft view showing the transom 113 of the boat 100 with the jet surf device 700.

The boat 100 is equipped with at least one jet surf device 700 on the port side of the boat 100 (a port jet surf device 700) and at least on a jet surf device 700 on the starboard side of the boat 100 (a starboard jet surf device 700). The starboard jet surf device 700 is a mirror image of the port jet surf device 700, and thus a description and depiction of the starboard jet surf device 700 is omitted here. The jet surf devices 700 are used to create a suitable wake for wakesurfing and are not used as the principal propulsion means. Instead, the boat 100 includes a separate propulsion device 10, as discussed above, to move the boat 100 through the water at speeds suitable for wakesurfing. The boat depicted in FIGS. 58 and 59 is an inboard boat with a propeller 12 and rudder 38 forward of the transom 113. The jet surf device 700 may also be used with other propulsion devices discussed above.

The jet surf device 700 includes a jet pump 710. The jet pump 710 includes an inlet 712, an impeller 714, and an outlet 716. The jet pump 710 draws water through the inlet 712 and into the jet pump 710 from the body of water in which the boat 100 sits. The impeller 714 is rotated by a drive source to accelerate the water drawn into the jet pump 710 through the inlet 712. The rotation of the impeller 714 may also draw the water into the jet pump 710 through the inlet 712. The impeller 714 is coupled to the drive source by a shaft 718. The drive source for the impeller 714 may be any suitable drive source, but in this embodiment, the drive source may be the engine 20 of the inboard boat 100. For example, a power-take-off (PTO) device coupled to the shaft 718 may be driven by the engine 20 to drive the impeller 714. Suitable PTO devices include, for example, a belt or a gear connected to the engine. In other embodiments, a drive source separate from the engine 20 used to drive the propeller 12 may be used to operate the impeller 714. Such sources may include, for example electrical motors or even a separate internal combustion engine.

The water accelerated by the impeller 714 is then discharged through an outlet 716. In some embodiments, such as the embodiment shown in FIG. 58, the outlet 716 includes a nozzle 702. In other embodiments, as will be discussed further below, the nozzle 702 may be located downstream of the outlet 716. The nozzle 702 may be used to direct the sped-up and pressurized water to improve the wake 90 for wakesurfing. Although shown with a single nozzle 702 for each of the jet surf devices 700. The jet surf device 700 may include a plurality of nozzles 702. As shown in FIG. 59, the outlets 716 and the nozzles 702 are located on the outboard corners of the transom 113. Preferably, the outlet 716 and the nozzle 702 are located outboard of the propulsion device 10, such as the propeller 12. More preferably, the outlet 716 and the nozzle 702 are located on the outboard third of the boat 100, and even more preferably, the outlet 716 and the nozzle 702 are located on the outboard quarter of the boat 100. In this embodiment, the engine 20 is located on the centerline and the outlet 716 and the nozzle 702 are located outboard of the engine 20.

Figure 60:
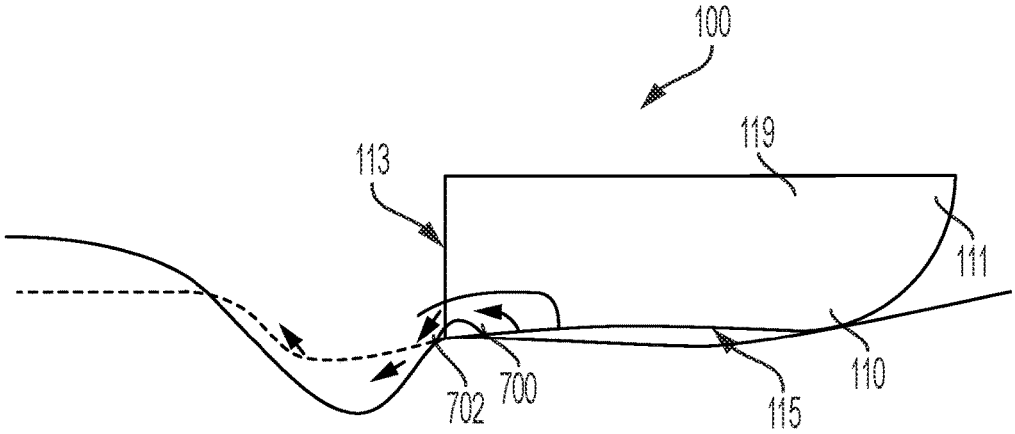
FIG. 60 is a starboard side schematic of the boat shown in FIG. 58.

As noted above, the outlet 716 and the nozzle 702 are located on the transom 113. The transom 113 is an aft-facing surface and the accelerated water is thus directed in an aft direction. As shown in FIG. 60, for example, the nozzle 702 (or the outlet 716 alone) also may direct the water in a downward direction. FIG. 60 is a schematic of the starboard side of the boat 100 conceptually illustrating a possible theory in which the jet surf device 700 produces a surfable wake. By using accelerated water to stagger flow convergence on the center of the wash produced by the propeller 12, a wave can be formed. The amplitude of the wave can be increased by displacing the water behind the boat and by accelerating the water downward. This causes an equal and opposite reaction of the water resulting in a higher (surfable) wave. In FIG. 60, the wake 90 without the accelerated water of the jet surf device 700 is shown with the broken line and the wake 90 with the accelerated water of the jet surf device 700 is shown with the solid line. The nozzle 702 may also be configured to direct the accelerated water in other directions, such as inboard or outboard depending on the desired shape of the wake 90.

Figure 61:
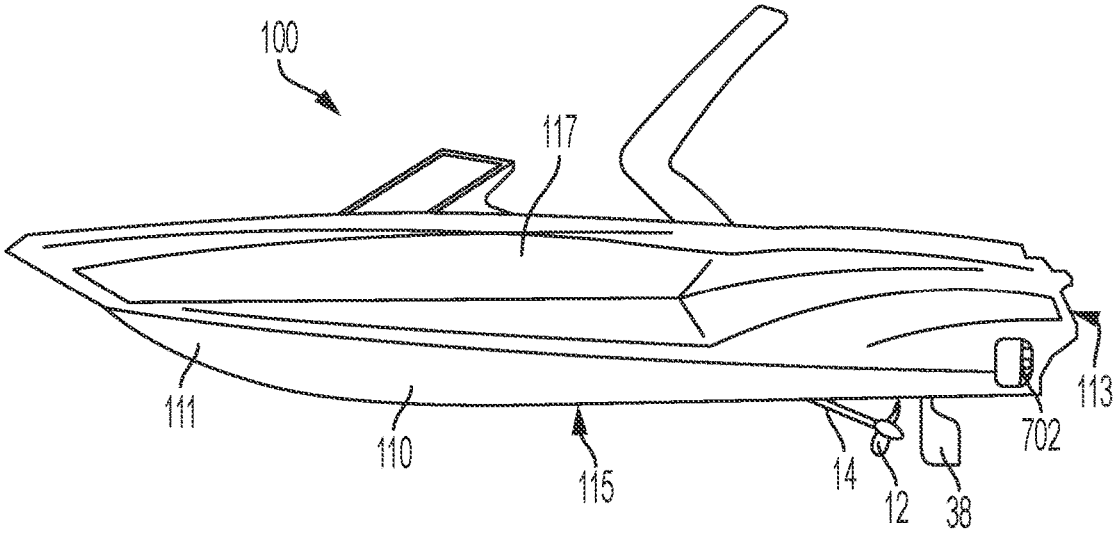
FIG. 61 is a port side view of the boat of FIG. 58 with a nozzle of the surf device in an alternative location.
Figure 62:
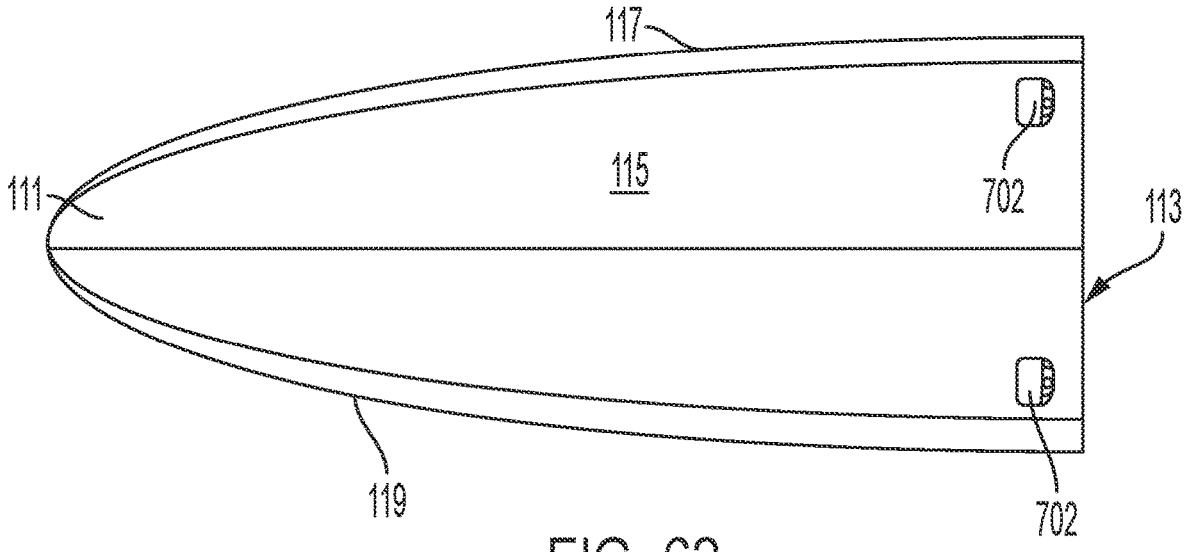
FIG. 62 is a bottom view of the boat of FIG. 58 with the nozzle of the surf device in another alternative location.

The nozzle 702 and the outlet 716 are not limited to being located on the transom 113 (an aft facing surface) instead, the nozzle 702 and the outlet 716 may be located on other parts of the hull 110 including the sides (port side 117 and starboard side 119) of the hull 110 and the hull bottom 115. When the nozzle 702 and the outlet 716 are located in these positions, they are located proximate the stern most portion of the boat 100, such as the transom 113. FIG. 61 is a port side view of the boat 100 having the nozzle 702 located on the port side 117 of the hull 110. With the nozzle 702 located as shown in FIG. 61, the accelerated water may be directed outward in a direction transverse to the centerline 102 of the boat 100. The accelerated water may be directed in a port or starboard direction and in some embodiments, the accelerated water may be directed in a direction perpendicular to the centerline 102 of the boat 100. The nozzle 702 in this position also may be configured to direct the accelerated water in a downward direction, in an upward direction, and/or in an aft direction. FIG. 62 is a bottom view of the boat 100 having the nozzle 702 located on the hull bottom 115. With the nozzle 702 located as shown in FIG. 62, the accelerated water may be directed downward. The nozzle 702 in this position also may be configured to direct the accelerated water in an outboard direction, in an inboard direction, and/or in an aft direction.

Figure 63A:
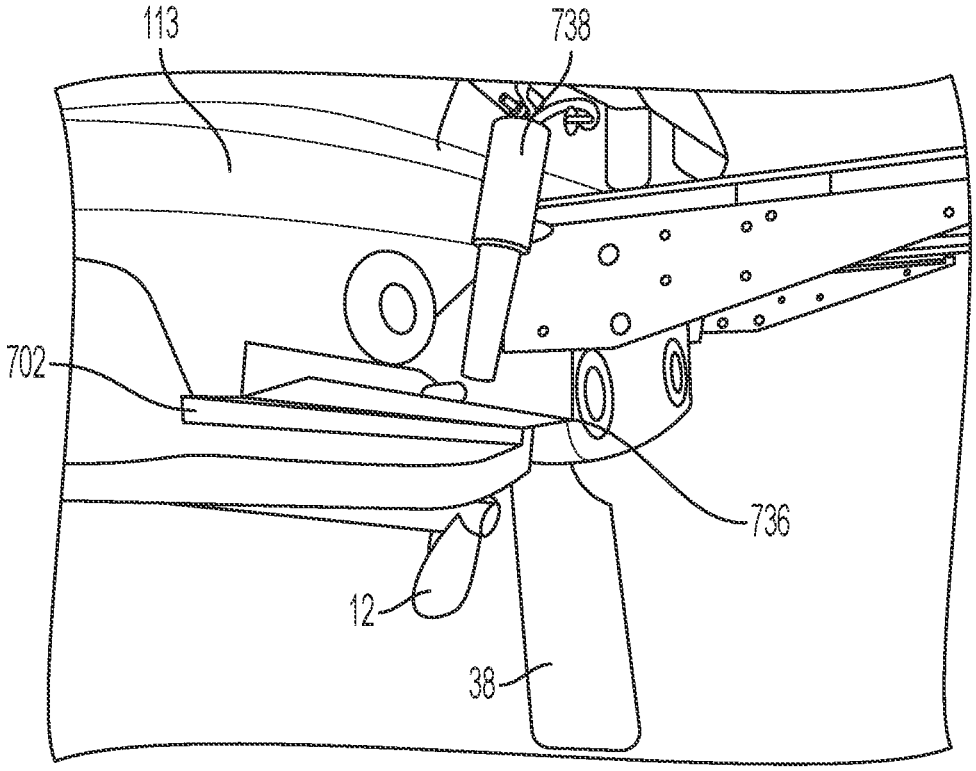
FIG. 63A is a perspective view of the port-side, aft corner of a boat having a surf device according to a variation of the eighth preferred embodiment of the invention.

As depicted in FIG. 59-62, the nozzle 702 has a circular shape, however, the nozzle 702 is not so limited. FIG. 63A is a perspective view of the port-side, aft corner of the boat 100 equipped with an alternate configuration of the nozzle 702. The nozzle 702 shown in FIG. 61 is a linear, elongated slot (more specifically rectilinear) that extends parallel to the deadrise of the boat 100 at the transom 113. The slot may also be rectangular. Although in this embodiment the outlet of the nozzle 702 is static and the water propelled by the impeller 714 is directed by deflector plates 732, 734, 736, discussed further below, the outlet of the nozzle 702 may also be movable.

Locating the nozzle 702 (outlet 716) along the edges of the transom 113, hull bottom 115, and/or side (port side 117 and starboard side 119) of the hull 110 where these components intersect using the elongated slot geometry of the nozzle 702 allows the water to be directed in such a way that the water promotes a smooth laminar flow of the water flowing around the hull 110 and producing the wake 90. The water accelerated by the jet surf device 700 and discharged from the nozzle 702 in such a manner further increases the speed of the water flowing adjacent to the nozzle 702. In this embodiment, the nozzle 702 is preferably positioned and oriented to produce this laminar (smooth) flow and avoid producing additional turbulence in the water.

Figure 63B:
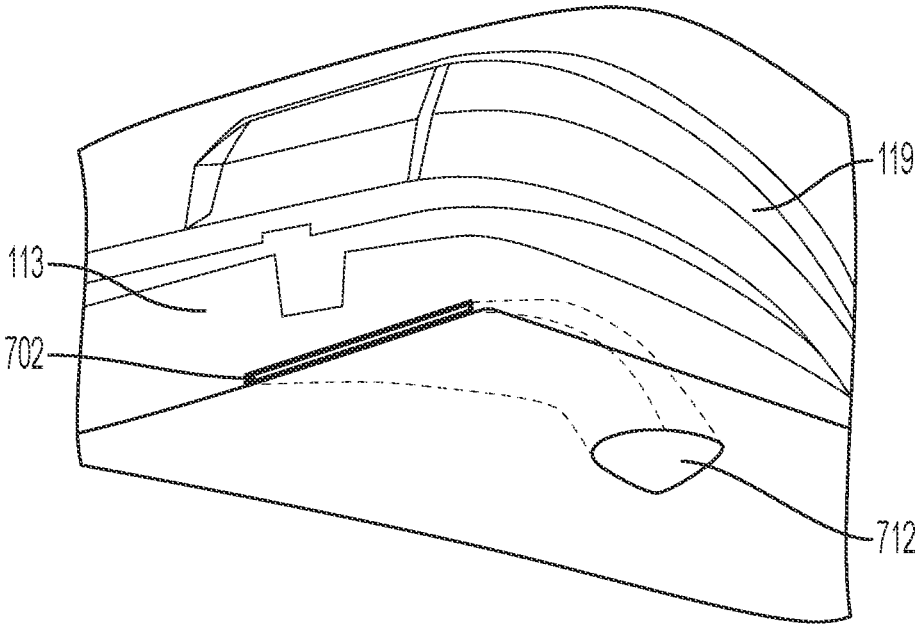
FIGS. 63B, 63C, and 63D are perspective views of the starboard-side, aft corner with different orientations of the nozzle of the surf device according to the variation of the eighth preferred embodiment shown in FIG. 63A.
Figure 63C:
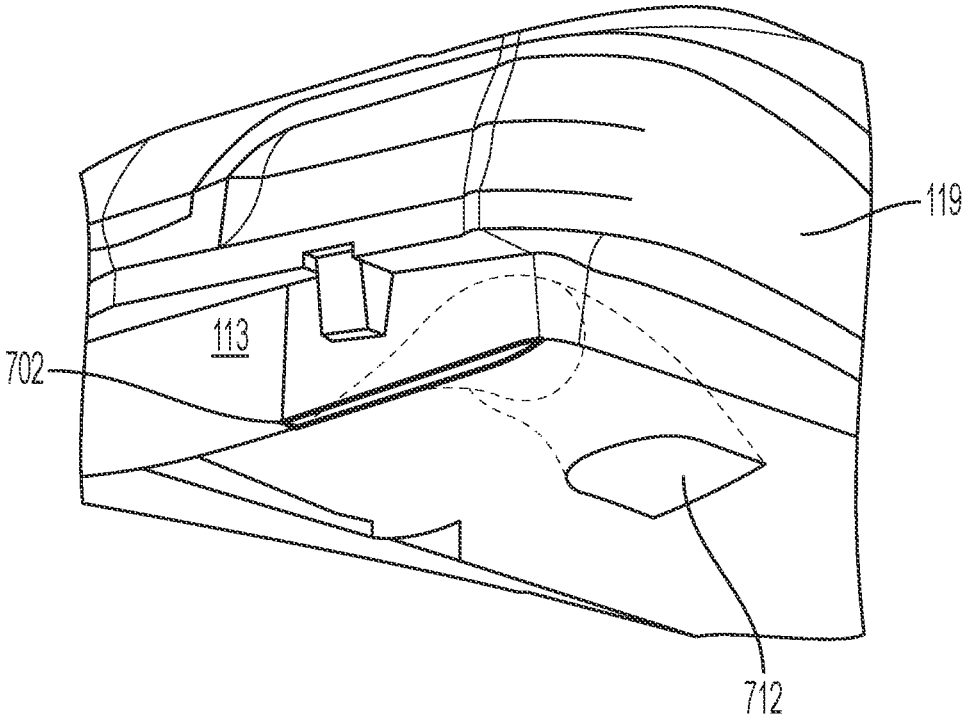
Figure 63D:
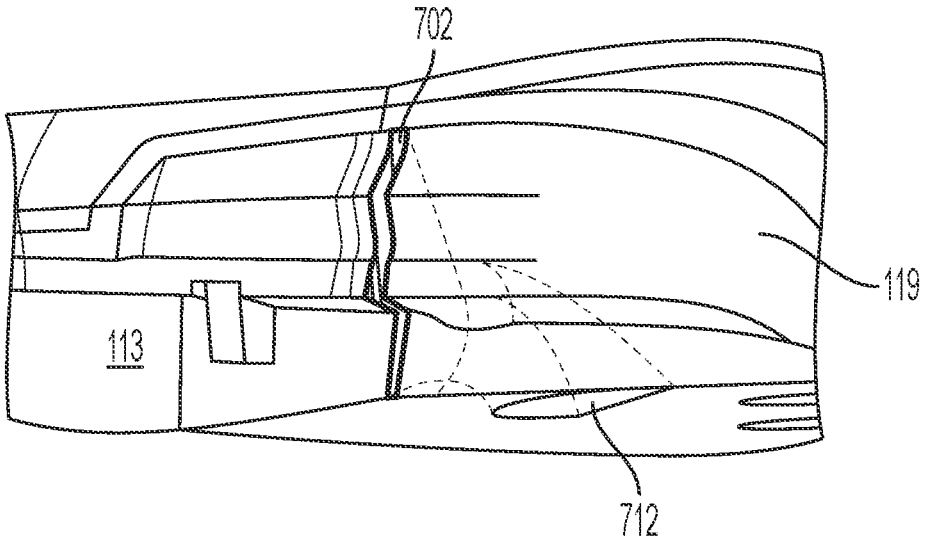

The nozzle 702 (outlet 716) may be located in any one of the transom 113, hull bottom 115, and/or side (port side 117 and starboard side 119) of the hull 110. FIG. 63B is a perspective view of the starboard-side, aft corner of the boat 100 having the linear, elongated nozzle 702 located on the transom 113, similar to the nozzle 702, shown in FIG. 63A. As noted and shown above, nozzle 702 and the outlet 716 are not limited to being located on the transom 113 (an aft facing surface) instead, the nozzle 702 and the outlet 716 may be located on other parts of the hull 110 including the sides (port side 117 and starboard side 119) of the hull 110 and the hull bottom 115. FIG. 63C shows the nozzle 702 with the elongated slot geometry located on the hull bottom 115. FIG. 63C is a perspective view of the starboard-side, aft corner of the boat 100. The nozzle 702 is preferably located proximate the edge of the hull bottom 115 with the transom 113. Likewise, to speed up the water flowing along the sides (port side 117 and starboard side 119) of the hull 110, the nozzle 702 having the elongated slot geometry may have an upright orientation as shown in FIG. 63D. FIG. 63C is a perspective view of the starboard-side, aft corner of the boat 100. In this embodiment, the nozzle 702 is elongated in a direction that is parallel with the inclination of the starboard side 119 of the hull 110.

As noted above, the elongated nozzles 702 are preferably located proximate the edges where the transom 113, the hull bottom 115, and the sides (port side 117 and starboard side 119) intersect. The elongated nozzles 702 are preferably positioned to promote the laminar flow of water past these edges and to accelerate this water while avoiding (or minimizing) the production of turbulent flow. In some embodiments, the nozzles 702 may be positioned less than 6 inches from the corresponding edge, more preferably less than 3 inches from the corresponding edge, and even more preferably less than 1 inch from the corresponding edge.

Figure 64:
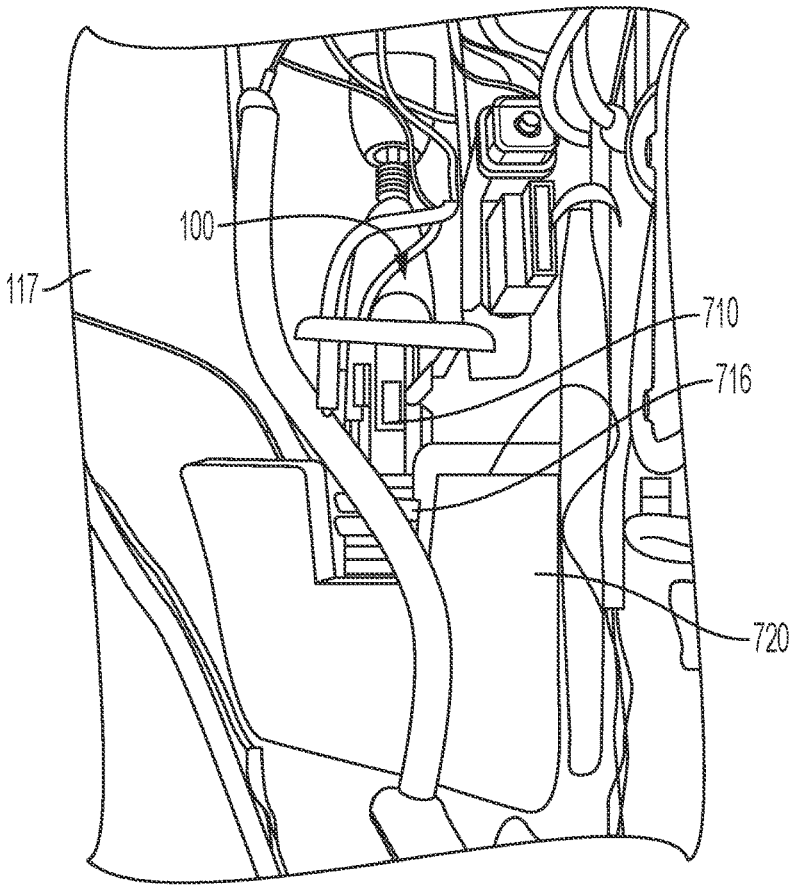
FIG. 64 is a top view inside the hull showing a box used with the surf device in FIG. 63A.
Figure 65:
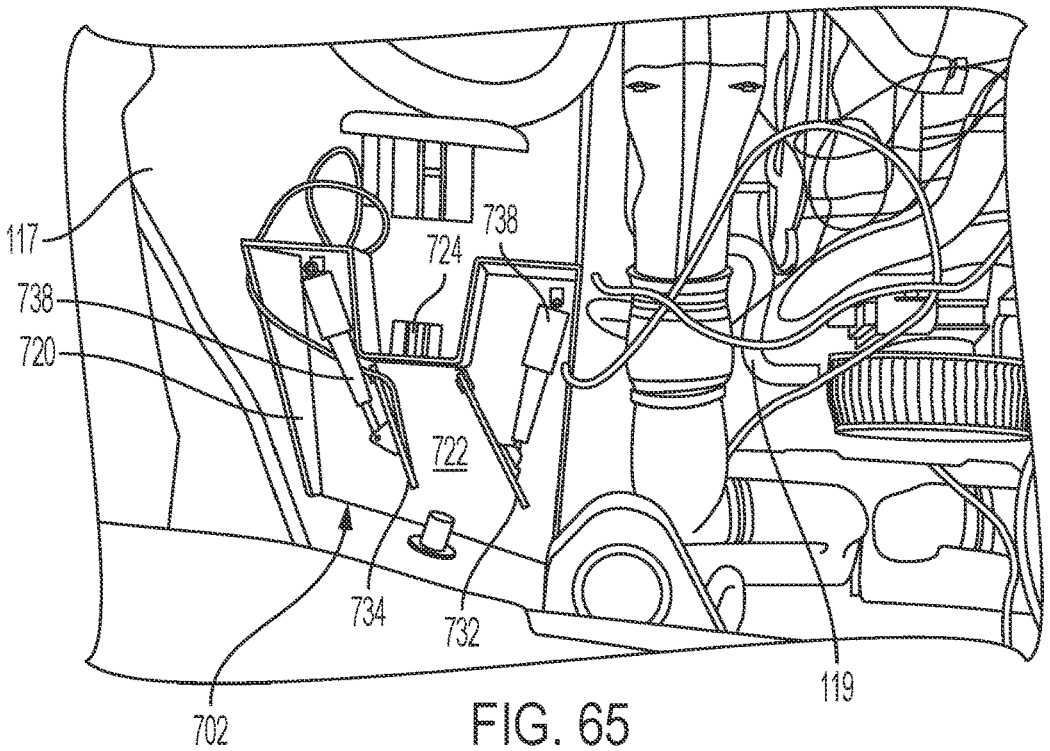
FIG. 65 is another top view inside the hull with a top surface of the box removed to show internal components of the box.

In this embodiment, the impeller 714 discharges into a flow cavity 722 formed by a box 720 inside of the hull 110. FIGS. 64 and 65 are top views of the inside of the hull 110 showing the box 720 used to create the flow cavity 722. In FIG. 65 the top panel of the box 720 is removed to show the inside of the box 720. Although formed on the interior of the hull 110, the box 720 may also be formed exterior to the hull 110 including on the hull bottom 115 or side of the boat 100 (port side 117 or starboard side 119) or extending aft of the transom 113.

Figure 66A:
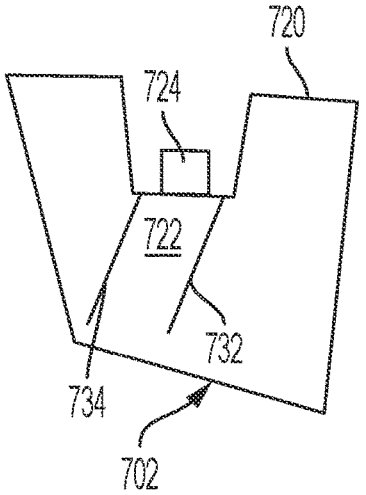
FIGS. 66A, 66B, and 66C are schematics illustrating different positions of the internal components of the box shown in FIG. 65.
Figure 66B:
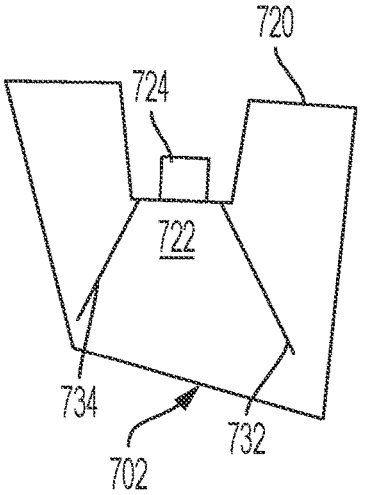
Figure 66C:
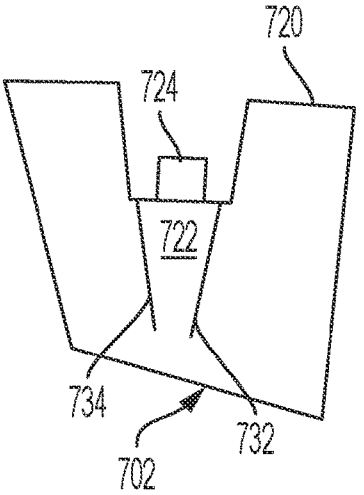

In this embodiment, the water accelerated by the impeller 714 is directed and shaped by the nozzle 702 and three deflector plates: an inboard deflector plate 732, an outboard deflector plate 734, and a vertical deflector plate 736. The inboard deflector plate 732 and the outboard deflector plate 734 are located within the box 720 and pivot about pivot points (hinges) on the inboard side and outboard side, respectively, of the inlet 724 from the impeller 714 to the box 720. The outlet 716 of the jet pump 710 discharges into the inlet 724 of the box 720. The inboard deflector plate 732 and the outboard deflector plate 734 are oriented such that they are generally perpendicular to the bottom of the box 720, which in this embodiment is also parallel to the deadrise of the boat 100. The inboard deflector plate 732 and outboard deflector plate 734 are configured to direct the water propelled by the impeller 714 in various directions and widths. For example, the inboard deflector plate 732 and the outboard deflector plate 734 are oriented to direct the water accelerated by the impeller 714 inboard. FIGS. 66A-66C are schematics showing other orientations of the inboard deflector plate 732 and the outboard deflector plate 734. In FIG. 66A the inboard deflector plate 732 and the outboard deflector plate 734 are oriented to direct the water accelerated by the impeller 714 outboard. The inboard deflector plate 732 and the outboard deflector plate 734 may also be moved to change the width over which the water accelerated by the impeller 714 exits the nozzle 702. In FIG. 66B, the inboard deflector plate 732 and the outboard deflector plate 734 are oriented to direct the water accelerated by the impeller 714 over the full width of the nozzle 702, and in FIG. 66C, the inboard deflector plate 732 and outboard deflector plate 734 are oriented to direct the water accelerated by the impeller 714 over only a portion of the nozzle 702 and, in this example, less than the width of the inlet 724.

As shown in FIG. 63, the vertical deflector plate 736 is configured to direct the flow of water exiting the nozzle 702 in a vertical direction, and more specifically in this embodiment, in a downward direction. The vertical deflector plate 736 may be located proximate the nozzle 702 either upstream of the nozzle 702 or downstream of the nozzle 702. The vertical deflector plate 736 of this embodiment is a plate that is pivotably attached to the transom 113 of the boat 100 by a hinge just above the top of the nozzle 702. The pivot axis of the vertical deflector plate 736 in this embodiment is oriented parallel to the deadrise of the boat 100 at the transom 113, and parallel with the top of the nozzle 702. The vertical deflector plate 736 is located downstream of the nozzle 702 in this embodiment and can be pivoted downward about its pivot axis to direct the water accelerated by the impeller 714 and exiting the nozzle 702 in a downward direction. The vertical deflector plate 736 of this embodiment may be oriented at various different downward angles.

The inboard deflector plate 732, the outboard deflector plate 734, and the vertical deflector plate 736 may be moved by any suitable movement mechanism 738 including, but not limited to, electric linear actuators, hydraulic linear actuators, gas assist pneumatic actuators, and electrical motors, as discussed above.

The port jet surf device 700 may be operated to produce a surfable wake on the port-side wave 92, and the starboard jet surf device 700 may be operated to produce a surfable wake on the starboard-side wave 94. Although each of the port jet surf device 700 and the starboard jet surf device 700 may be operated alone to generate the surfable wake, in some embodiments in may be preferable to operate both jet surf devices 700 at the same time. Doing so helps balance any force not in the forward direction, particularly in the embodiments where water is directed in an outboard or inboard direction, to counteract any yaw moment generated by operating only one of the jet surf devices 700. In addition, operating both jet surf devices 700 may allow both the port-side wave 92 and the starboard-side wave 94 to be a surfable wake with a surfer being pushed by each wave of the wake 90.

Ninth Embodiment

Figure 67:
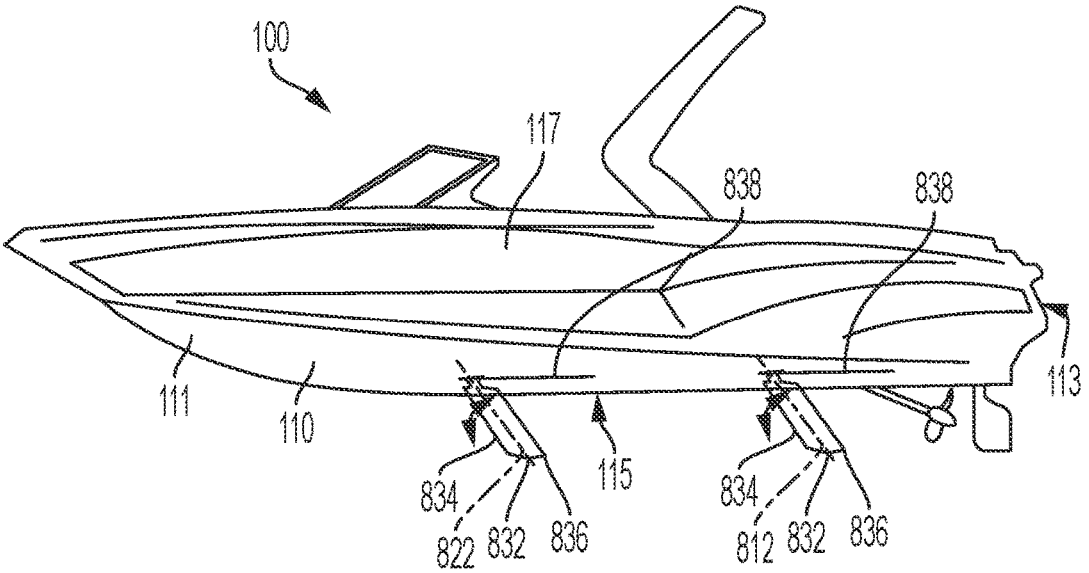
FIG. 67 is a port side view of a boat having a surf device according to a ninth preferred embodiment of the invention.
Figure 68:
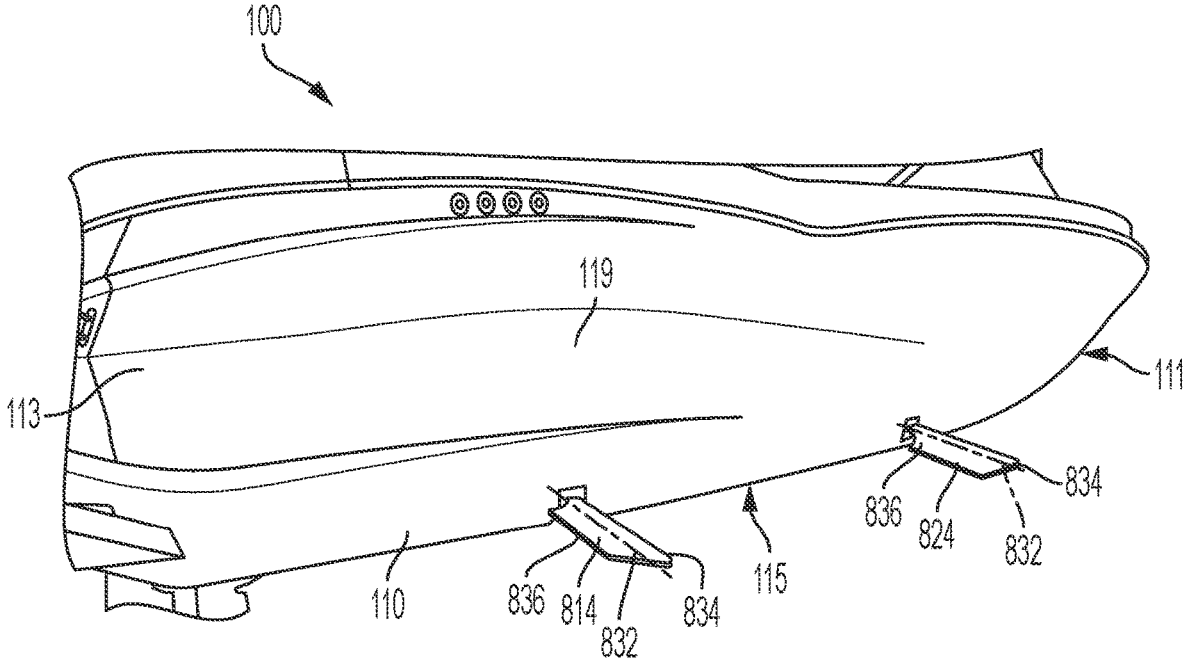
FIG. 68 is a starboard side view of the boat shown in FIG. 67.
Figure 69:
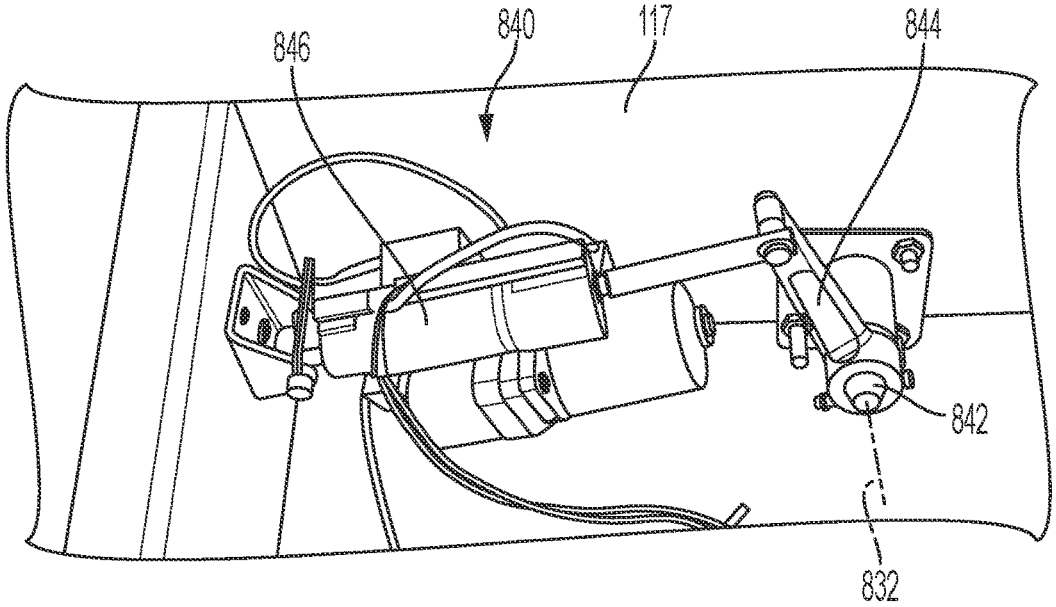
FIG. 69 shows the movement mechanism used with the foils shown in FIG. 67.

FIGS. 67-69 show a boat, such as the boat 100, using surf devices according to a ninth embodiment of the invention. FIG. 67 is a port side view of a boat 100 having a surf device of this embodiment and FIG. 68 is a starboard side view of the boat 100 of this embodiment. This embodiment uses at least one foil 812, 814, 822, 824 that extends outward from the side of the boat 100. In this embodiment, multiple foils are used including an aft pair of foils 812, 814 and a forward pair of foils 822, 824. The boat 100 of this embodiment thus includes a port-side aft foil 812, a starboard-side aft foil 814, a port-side forward foil 822, and a starboard-side forward foil 824. The foils on the port side of the boat 100 (the port-side aft foil 812 and the port-side forward foil 822) extend outward from the port side 117 of the boat 100, and the foils on the starboard side of the boat 100 (the starboard-side aft foil 814 and the starboard-side forward foil 824) extend outward from the starboard side 119 of the hull 110.

In this embodiment, each foil is positioned on the side of the hull 110 above the chine. Preferably each foil is positioned low enough on the side of the hull 110 such that it interacts with the water as the boat 100 moves through the water at speeds less than planing speed and particularly at speeds suitable for wakesurfing (approximately 9 mph to 12 mph). In this embodiment, the foils are placed as close as possible to the chine as the movement mechanism 840 (discussed below) allows. For example, each foil may be preferably positioned in the lower quarter of the hull side, and more preferably in the lower eighth of the hull side.

Each of the foils is rotatable about a rotation axis 832 and includes a leading edge 834 and a trailing edge 836. The leading edge 834 of each foil can be rotated upward or downward as indicated by the arrows shown in FIG. 67. By rotating the leading edge 834 of a foil upward, the foil creates an upward force on the part of the boat 100 to which the foil is connected when water flows past and/or contacts the foil. Conversely, by rotating the leading edge 834 of the foil downward, the foil creates a downward force on the part of the boat 100 to which the foil is connected when water flows past and/or contacts the foil. In this embodiment, the rotation axis 832 is located between the leading edge 834 and the trailing edge 836, and the trailing edge 836 moves in the opposite direction of the leading edge 834. Although the foils shown in FIGS. 67 and 68 are flat, the structure of the foils are not so limited and they may have other shapes, such as curved surfaces, to assist with the lift (positive or negative) that the foil preferably produces. The foils may also have, for example, a wedge shape. Although shown as symmetric foils, foils on the port side of the boat 100 (port-side aft foil 812 and port-side forward foil 822) may be asymmetrical with the foils on the starboard side of the boat 100 (starboard-side aft foil 814 and starboard-side forward foil 824).

FIG. 69 shows an example of a movement mechanism 840 that can be used with each of the foils. Each foil includes a post 842 that extends through the side (port side 117 or starboard side 119) of the hull 110 and is used to rotate the foil. The rotation axis 832 of the foil extends through the center of the post 842. One end of a lever arm 844 is attached to the post 842, and to the other end of the lever arm 844 the ram of an actuator 846 is attached. In this embodiment, the actuator 846 is electric linear actuators manufactured by Lenco Marine. Any suitable actuator 846 may be used including, but not limited, to electric linear actuators, hydraulic linear actuators, gas assist pneumatic actuators, and electrical motors, as discussed above. Other suitable devices to move the lever arm 844 may also be used in place of the actuator 846. Such devices include, for example, a cable-driven device similar to those used with steering mechanisms. In this embodiment, the lever arm 844 extends upward when the foil does not have an angle of attack. Moving the lever arm 844 forward rotates the post 842 such that the leading edge of the foil angles downward, and moving the lever arm 844 aft rotates the post 842 such that the leading edge of the foil angles upward.

The foils could be used to produce a surf wake in at least one of two ways. The foils could be used to create downward force on one side and an upward force on the other side. In this approach, for example, a surf wake could be produced on the port side by adjusting the angle of attack of the port-side aft foil 812 and port-side forward foil 822 downward to pull the port side of the boat 100 down and adjust the angle of attack on the starboard-side aft foil 814 and starboard-side forward foil 824 to create an upward force to roll (or create a list) in the boat 100. Alternatively, one set could be used to create either a downward force or an upward force. Another way the foils could be used is to create downward forces on both sides, basically to replace or supplement a ballast system. Another surf device, such as those discussed herein could then be used to shape the wake 90 for wakesurfing.

Positioning the foils on the side of the hull 110 maximizes the moment arm of each foil. For example, a foil on the side of the hull 110 can be used to produce a greater roll moment about the center of gravity of the boat 100 than the same sized foil positioned farther inboard. Further, positioning the foils on the side of the hull 110 allows each foil to be positioned orthogonal to the side of the hull 110 and thus have a generally horizontal orientation in the static flotation condition. With each foil having such an orientation, most of the forces generated by the foil are either positive or negative lift (in the vertical direction) as opposed to yaw forces turning the boat. Although shown as being on the side of the hull 110, the foils may be positioned on the hull bottom 115 instead. When positioned on the hull bottom 115 the foils are preferably located on the outboard third of the hull bottom 115 to create a larger moment arm.

Figure 70:
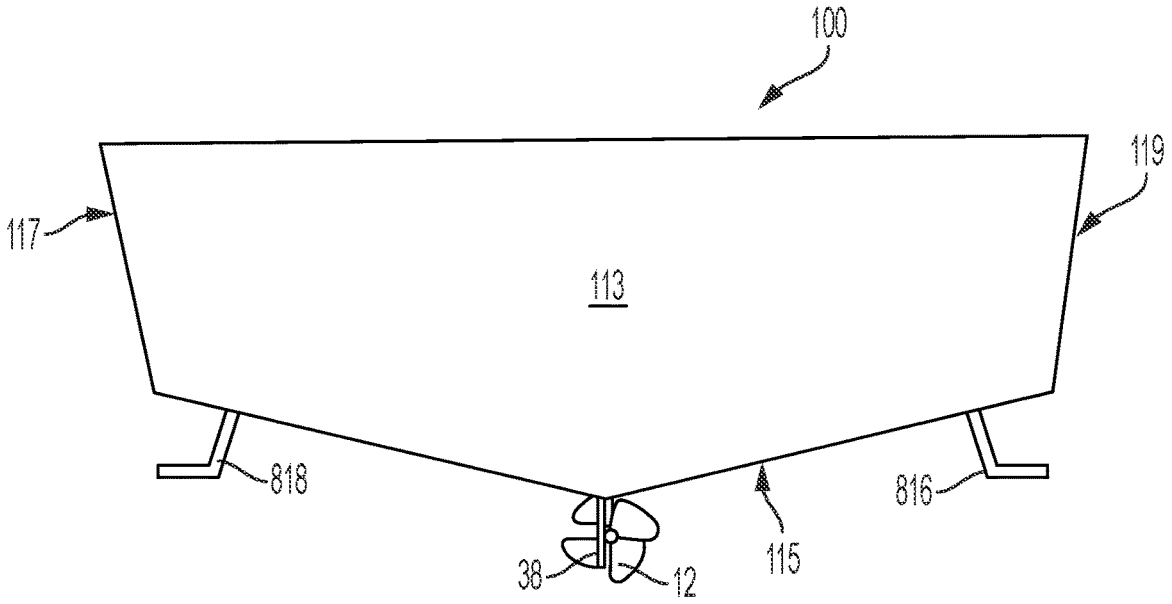
FIG. 70 is an aft view of a boat having variations of the surf device according to a ninth preferred embodiment of the invention located on the hull bottom.

The foils shown in FIGS. 67 and 68 are generally linear extending outboard from the side of the hull 110. But they are not so limited and may have other suitable shapes, such as a J-shape or an L-shape, for example, as shown in FIG. 70. FIG. 70 is an aft view showing the transom 113 of the boat 100 with foils located on the hull bottom. An L-shaped foil 816 is shown on the starboard side, and a J-shaped foil 818 is shown on the port side. When the foils are located on the hull bottom 115, for example, the foils may have a J-shape where a portion of the foil is orthogonal to the hull bottom 115 and another portion is generally horizontal when the boat is in its static flotation condition. This J-shape foil may have a curved section to transition between the orthogonal portion and the horizontal portion.

Positioning the foils to have larger moment arms is preferable as it allows the foils to be reduced in size for an equivalent amount of roll compared to larger foils positioned closer to the center of gravity of the boat 100. Reducing the size is preferable on a planing hull boat, such as the boat 100 used in the embodiments herein, as larger foils create larger drag forces, particularly if they interact with the water at planing speeds. Likewise, the number of foils also impacts the drag forces on the 100 with a higher number of foils creating more drag.

As with the outboard position of the foils, the port-side aft foil 812 and the starboard-side aft foil 814 are preferably located farther aft in the boat 100 to increase the moment arm of the port-side aft foil 812 and the starboard-side aft foil 814. Preferably, the port-side aft foil 812 and the starboard-side aft foil 814 are each located in the aft third of the boat 100. Positioning the port-side aft foil 812 and the starboard-side aft foil 814 near the transom 113 would maximize the moment arm, but foils have the potential to affect the shape of the wake 90 formed behind the boat 100. If such impacts are to be avoided, the port-side aft foil 812 and the starboard-side aft foil 814 are preferably positioned forward of the transom 113 by, for example, twice the length of the respective foil.

It may be desirable to avoid a pitch (or attack angle) change of the boat 100 when the port-side aft foil 812 and the starboard-side aft foil 814 are generating lift (either positive or negative). Thus, the port-side forward foil 822 and the starboard-side aft foil 824 may be positioned forward of the center of gravity of the boat 100 to produce a force that balances the force produced by the port-side aft foil 812 and the starboard-side aft foil 814, respectively, when they are generating lift. Where the size of each of the foils 812, 814, 822, 824 is the same, the port-side forward foil 822 and the starboard-side forward foil 824 may be positioned the same distance forward of the center of gravity of the boat 100 as the port-side aft foil 812 and the starboard-side aft foil 814 are positioned aft of the center of gravity of the boat 100.

The foils may be movable between a deployed position in which they extend outboard from the side of the hull 110 to a retracted position in which they are contained within the hull 110 or flush with the side of the hull 110 (or hull bottom 115). FIG. 67 shows slots 838 formed in the port side 117 of the hull 110 to accommodate the foils in the non-deployed position. In this embodiment, the foils pivot (are rotatable) between the deployed position and the non-deployed position and pivot in a forward/aft direction and an inboard/outboard direction. Other types of configurations for the foils to move between the deployed position and non-deployed position may be used, such as a telescoping foil assembly, for example. In addition, the foils could be configured such that they are not stowable, and instead, extend outward from the side of the hull 110 or hull bottom 115. When the foil is not stowable, positioning the foils on the hull bottom 115 may be preferred so that the foil does not extend outside of the beam of the boat 100 (or minimize the distance which it extends outside the beam of the boat 100).

The foils may be used for other operations on the boat 100 besides wakesurfing. Positioning both of the aft pair of foils (port-side aft foil 812 and port-side forward foil 822) so that their leading edges are angled upward can be used to help get the boat on plane, for example.

Tenth Embodiment

Figure 71:
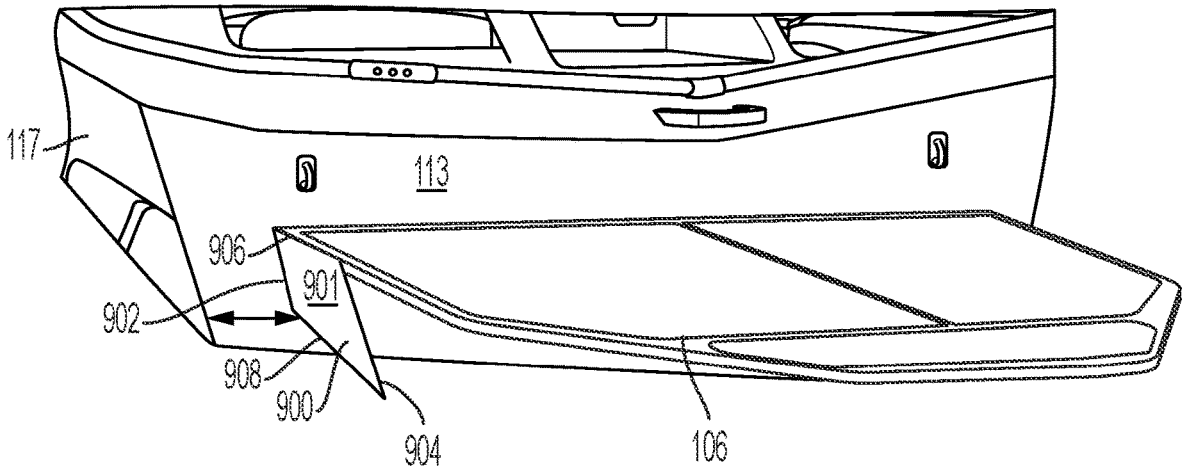
FIG. 71 is a perspective view of the port-side, aft corner of a boat having a surf device according to a tenth preferred embodiment of the invention.
Figure 72:
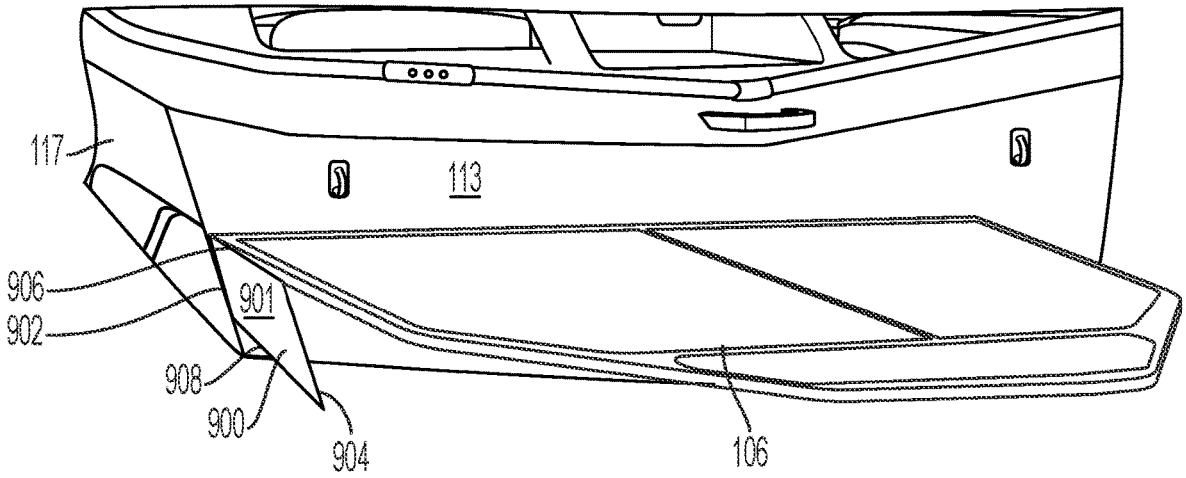
FIG. 72 is a perspective view of the port-side, aft corner of the boat shown in FIG. 71 with the surf device in its deployed position.

FIGS. 71 and 72 show a surf device according to a tenth embodiment of the invention. FIGS. 71 and 72 are perspective views of the port-side, aft corner of a boat having a surf device according to this embodiment. The swim platform 106 is in a neutral position in FIG. 71 and is in a deployed position in FIG. 72. In this embodiment, a panel 900 is formed on each of the outboard sides of a swim platform 106. FIGS. 71 and 72 show the port-side edge of the swim platform with the panel 900. The starboard-side edge of the swim platform 106 also includes a panel 900. The starboard-side edge of the swim platform 106 is a mirror image of the port-side edge thus a description and depiction of starboard-side edge is omitted here. The swim platform 106 of this embodiment slides in a port and starboard direction as indicated by the arrow in FIG. 71. The panel 900 has a shape that mimics the hull side (port side 117 in FIGS. 71 and 72), similar to the flap 202 discussed above. The swim platform 106 slides from the neutral position to the deployed position such that the panel 900 becomes a continuation of the hull side (port side 117), as shown in FIG. 72. More specifically, the panel 900 has an outboard surface 901 and in the deployed position the outboard surface 901 is flush with the port side 117 of the hull 110. The panel 900 also includes a leading edge 902 adjacent to the transom 113, and a trailing edge 904. Preferably, when the swim platform 106 is in the deployed position, the leading edge 902 is adjacent to the aft corner of the boat were the port side 117 of the hull 110 transitions to the transom 113. The panel further includes an upper edge 906 and a lower edge 908. Preferably, the upper edge 906 is at the top surface of the swim platform or lower and extends downward such that the lower edge 908 does not extend below the hull bottom 115. In some embodiments, the lower edge 908 may be an extension of the chine when the swim platform 106 is in the deployed position.

The swim platform 106 has a width that is less than the width of the boat 100 at the transom 113. Preferably, the swim platform 106 has a width that is from 70-95 percent of the width of the boat 100 at the transom 113. In the neutral position, the panel 900 (and thus outboard edge of the swim platform 106) is spaced inboard from the port side 117 of the hull 110. The swim platform 106 may have a centerline that is coincident with the centerline 102 of the boat 100 when the swim platform is in the neural portion.

To create a surf wake, the swim platform 106 and the panel is moved to toward the non-surf side of the boat 100. In FIG. 72, the swim platform 106 is moved (shifted) from its neutral position to the port side of the boat 100 to create a surfable starboard-side wave 94. Any suitable mechanism may be used to move the swim platform including those discussed in other embodiments above. The swim platform 106 may use a track or other suitable mechanism to allow the swim platform 106 to connect to the transom 113 and also slide.

Other Embodiments

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A boat comprising:

a propulsion device configured to move the boat in a forward direction through a body of water generating a wake having a port-side wave and a starboard-side wave;

a surf device including an inlet, an impeller, and an outlet, the surf device being configured to draw water from the body of water through the inlet, accelerate the water by rotating the impeller, and discharge the accelerated water through the outlet to create a surfable wake; and a controller operatively connected to the impeller, the controller being configured to receive an input from a user-selectable input device for wakesurfing and to rotate the impeller in response to receiving the input for wakesurfing.

2. The boat of claim 1, wherein the outlet is configured to discharge the accelerated water in at least one of an aft direction, an outboard direction, and a downward direction.

3. The boat of claim 2, wherein the outlet is configured to discharge the accelerated water in the aft direction into at least one of the port-side wave and the starboard-side wave.

4. The boat of claim 1, further comprising an aft-facing surface, the outlet being located on the aft-facing surface.

5. The boat of claim 4, wherein the outlet is located in an outboard third of the aft-facing surface.

6. The boat of claim 4, wherein the outlet is located in an outboard quarter of the aft-facing surface.

7. The boat of claim 4, further comprising a hull including a transom, the aft-facing surface being the transom.

8. The boat of claim 1, further comprising a hull including a port side and a starboard side, the outlet being located on one of the port side of the hull and the starboard side of the hull.

9. The boat of claim 1, further comprising a hull including a hull bottom, the outlet being located on the hull bottom.

10. The boat of claim 1, wherein the outlet is an elongated slot.

11. The boat of claim 10, further comprising a hull including a transom and a hull bottom, the hull bottom having a deadrise, the outlet being located on the transom and parallel to the deadrise.

12. The boat of claim 1, further comprising a cavity fluidly connecting the impeller to the outlet.

13. The boat of claim 12, further comprising at least one movable deflector located within the cavity configured to direct the accelerated water from the impeller through the outlet.

14. The boat of claim 13, further comprising an inboard movable deflector and an outboard movable deflector, each of the inboard movable deflector and the outboard movable deflector being located within the cavity and configured to direct the accelerated water from the impeller through the outlet.

15. The boat of claim 1, further comprising at least one movable deflector configured to direct the accelerated water exiting the outlet in a downward direction.

16. A boat comprising:

a hull having a bow, a hull bottom, a port side, a starboard side, and a transom;

a propulsion device configured to move the boat in a forward direction through a body of water generating a wake having a port-side wave and a starboard-side wave;

a port surf device including an inlet, an impeller, and an outlet, the outlet being located on the outer third of the port side of the boat, the port surf device being configured to draw water from the body of water through the inlet, accelerate the water by rotating the impeller, and discharge the accelerated water through the outlet to create a surfable wake;

a starboard surf device including an inlet, an impeller, and an outlet, the outlet being located on the outer third of the starboard side of the boat, the starboard surf device being configured to draw water from the body of water through the inlet, accelerate the water by rotating the impeller, and discharge the accelerated water through the outlet to create a surfable wake; and a controller operatively coupled to each of the port surf device and the starboard surf device, the controller being configured to:

receive an input from a user-selectable input device for wakesurfing on the port-side of the boat or for wakesurfing on the starboard-side of the boat;

rotate the impeller of the port surf device in response to receiving the input for wakesurfing on the port-side of the boat; and rotate the impeller of the starboard surf device in response to receiving the input for wakesurfing on the starboard-side of the boat.

17. The boat of claim 16, the boat further comprising a hull bottom, wherein the propulsion device includes a propeller positioned forward of the transom and beneath the hull bottom.

18. The boat of claim 16, wherein the outlet of the port surf device is located on the transom and configured to discharge the accelerated water in an aft direction into the port-side wave, wherein the outlet of the starboard surf device is located on the transom and configured to discharge the accelerated water in an aft direction into the starboard-side wave.

19. The boat of claim 16, wherein the outlet of the port surf device is located on the hull bottom and configured to discharge the accelerated water in a downward direction, wherein the outlet of the starboard surf device is located on the hull bottom and configured to discharge the accelerated water in a downward direction.

20. The boat of claim 16, wherein the outlet of the port surf device is located on the port side of the hull and configured to discharge the accelerated water in a port direction, wherein the outlet of the starboard surf device is located on the starboard side of the hull and configured to discharge the accelerated water in a starboard direction.

* * * * *